US009576439B2

(12) United States Patent
Fujisawa et al.

(10) Patent No.: US 9,576,439 B2
(45) Date of Patent: Feb. 21, 2017

(54) GAMING MACHINE CAPABLE OF REPEATEDLY EXECUTING A UNIT GAME

(71) Applicants: Universal Entertainment Corporation, Tokyo (JP); Aruze Gaming America, Inc., Las Vegas, NV (US)

(72) Inventors: Masumi Fujisawa, Tokyo (JP); Kenta Kitamura, Tokyo (JP); Susumu Mio, Tokyo (JP); Yoichi Kato, Tokyo (JP); Hiromoto Yamauchi, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 387 days.

(21) Appl. No.: 14/246,247

(22) Filed: Apr. 7, 2014

(65) Prior Publication Data

US 2014/0315618 A1 Oct. 23, 2014

(30) Foreign Application Priority Data

Apr. 17, 2013 (JP) ..... 2013-086613
May 13, 2013 (JP) ..... 2013-101617

(51) Int. Cl.
*G07F 17/34* (2006.01)
*G07F 17/32* (2006.01)

(52) U.S. Cl.
CPC ..... *G07F 17/34* (2013.01); *G07F 17/3211* (2013.01)

(58) Field of Classification Search
None
See application file for complete search history.

(56) References Cited

U.S. PATENT DOCUMENTS 9,286,748 B2 * 3/2016 Fujisawa ..... G07F 17/3211
2003/0195035 A1 * 10/2003 Onuki ..... G07F 17/3202 463/20
2009/0061985 A1 * 3/2009 Inamura ..... G07F 17/34 463/20
2013/0310141 A1 * 11/2013 Kitamura ..... G07F 17/34 463/20
2014/0342798 A1 * 11/2014 Fujisawa ..... G07F 17/34 463/20

FOREIGN PATENT DOCUMENTS

JP 2007-020954 2/2007

* cited by examiner

*Primary Examiner* — Jay Liddle
(74) *Attorney, Agent, or Firm* — Lex IP Meister, PLLC

(57) ABSTRACT

A gaming machine that is capable of achieving respectively different game patterns at a time of a bonus game is provided. A main CPU displays a selection screen in a case where a feature game trigger is established, and causes a player to select either one of a free game and a roulette game. In a case where the free game is selected, a total of values that correspond to BONUS symbols that correspond to the feature game trigger is determined as the number of free games. The main CPU conducts lottery processing for determination of symbols and lottery processing for determination of BONUS symbol values. The values that correspond to the BONUS symbols are added on one by one basis, and a progress of obtaining the number of free games is displayed as effect on a video display unit.

18 Claims, 43 Drawing Sheets

FIG. 17

PAYLINE DEFINITION TABLE

| No. | FIRST REEL | SECOND REEL | THIRD REEL | FOURTH REEL | FIFTH REEL |
|---|---|---|---|---|---|
| 1 | 1 | 1 | 1 | 1 | 1 |
| 2 | 0 | 0 | 0 | 0 | 0 |
| 3 | 2 | 2 | 2 | 2 | 2 |
| 4 | 0 | 1 | 2 | 1 | 0 |
| 5 | 2 | 1 | 0 | 1 | 2 |
| 6 | 0 | 2 | 0 | 2 | 0 |
| 7 | 2 | 0 | 2 | 0 | 2 |
| 8 | 1 | 0 | 1 | 0 | 1 |
| 9 | 1 | 2 | 1 | 2 | 1 |
| 10 | 0 | 0 | 1 | 0 | 0 |
| 11 | 2 | 2 | 1 | 2 | 2 |
| 12 | 1 | 0 | 2 | 0 | 1 |
| 13 | 1 | 2 | 0 | 2 | 1 |
| 14 | 0 | 2 | 2 | 2 | 0 |
| 15 | 2 | 0 | 0 | 0 | 2 |
| 16 | 0 | 1 | 0 | 1 | 0 |
| 17 | 2 | 1 | 2 | 1 | 2 |
| 18 | 1 | 1 | 0 | 1 | 1 |
| 19 | 1 | 1 | 2 | 1 | 1 |
| 20 | 1 | 0 | 0 | 0 | 1 |
| 21 | 1 | 2 | 2 | 2 | 1 |
| 22 | 0 | 1 | 1 | 1 | 0 |
| 23 | 2 | 1 | 1 | 1 | 2 |
| 24 | 0 | 0 | 2 | 0 | 0 |
| 25 | 2 | 2 | 0 | 2 | 2 |
| 26 | 0 | 0 | 1 | 2 | 2 |
| 27 | 2 | 2 | 1 | 0 | 0 |
| 28 | 1 | 2 | 1 | 0 | 1 |
| 29 | 2 | 0 | 1 | 0 | 2 |
| 30 | 0 | 2 | 1 | 2 | 0 |

FIG. 18

SYMBOL DETERMINTATION TABLE

| | FIRST REEL | | SECOND REEL | | THIRD REEL | | FOURTH REEL | | FIFTH REEL | |
|---|---|---|---|---|---|---|---|---|---|---|
| CODE NO. | SYMBOL | WEIGHT | SYMBOL | WEIGHT | SYMBOL | WEIGHT | SYMBOL | WEIGHT | SYMBOL | WEIGHT |
| 00 | BONUS | 4 | BONUS | 6 | BONUS | 3 | BONUS | 3 | BONUS | 5 |
| 01 | BLANK | 4 | BLANK | 5 | BLANK | 3 | BLANK | 3 | BLANK | 5 |
| 02 | BONUS | 4 | BONUS | 6 | BONUS | 3 | BONUS | 3 | BONUS | 5 |
| 03 | BLANK | 4 | BLANK | 7 | BLANK | 3 | BLANK | 3 | BLANK | 5 |
| 04 | 2BAR | 2 | 3BAR | 6 | 2BAR | 4 | 3BAR | 4 | 1BAR | 1 |
| 05 | BLANK | 3 | BLANK | 8 | BLANK | 4 | BLANK | 4 | BLANK | 1 |
| 06 | 1BAR | 3 | 1BAR | 7 | 1BAR | 4 | 2BAR | 3 | 3BAR | 3 |
| 07 | BLANK | 3 | BLANK | 3 | BLANK | 4 | BLANK | 3 | BLANK | 3 |
| 08 | RED7 | 4 | WILD | 3 | RED7 | 4 | WILD | 3 | RED7 | 3 |
| 09 | BLANK | 5 | BLANK | 3 | BLANK | 4 | BLANK | 3 | BLANK | 3 |
| 10 | BLUE7 | 4 | BLUE7 | 6 | BLUE7 | 4 | BLUE7 | 3 | BLUE7 | 3 |
| 11 | BLANK | 3 | BLANK | 7 | BLANK | 4 | BLANK | 3 | BLANK | 3 |
| 12 | 3BAR | 3 | 2BAR | 6 | 3BAR | 4 | 1BAR | 3 | 2BAR | 3 |
| 13 | BLANK | 3 | BLANK | 9 | BLANK | 4 | BLANK | 3 | BLANK | 3 |
| 14 | BLUE 7 | 5 | RED7 | 11 | WILD | 4 | RED7 | 3 | BLUE7 | 3 |
| 15 | BLANK | 6 | BLANK | 9 | BLANK | 4 | BLANK | 3 | BLANK | 3 |
| 16 | RED7 | 6 | BLUE7 | 10 | RED7 | 4 | BLUE7 | 3 | RED7 | 3 |
| 17 | BLANK | 2 | BLANK | 10 | BLANK | 4 | BLANK | 3 | BLANK | 3 |
| 18 | 1BAR | 3 | 1BAR | 4 | 1BAR | 4 | 2BAR | 4 | 3BAR | 1 |
| 19 | BLANK | 3 | BLANK | 4 | BLANK | 4 | BLANK | 4 | BLANK | 1 |
| 20 | 2BAR | 3 | 3BAR | 8 | 2BAR | 3 | 3BAR | 3 | 1BAR | 5 |
| 21 | BLANK | 4 | BLANK | 6 | BLANK | 3 | BLANK | 3 | BLANK | 5 |
| TOTAL | | 81 | | 144 | | 82 | | 70 | | 70 |

FIG. 19

PAYOUT TABLE

| SYMBOL COMBINATION | | | | | PAYOUT | WINNING COMBINATION |
|---|---|---|---|---|---|---|
| FIRST REEL | SECOND REEL | THIRD REEL | FOURTH REEL | FIFTH REEL | | |
| RED7 | RED7 | RED7 | (ANY) | (ANY) | 50 | RED7 |
| RED7 | RED7 | RED7 | RED7 | (ANY) | 200 | RED7 |
| RED7 | RED7 | RED7 | RED7 | RED7 | 1000 | RED7 |
| BLUE7 | BLUE7 | BLUE7 | (ANY) | (ANY) | 30 | BLUE7 |
| BLUE7 | BLUE7 | BLUE7 | BLUE7 | (ANY) | 150 | BLUE7 |
| BLUE7 | BLUE7 | BLUE7 | BLUE7 | BLUE7 | 500 | BLUE7 |
| RED7／BLUE7 | RED7／BLUE7 | RED7／BLUE7 | (ANY) | (ANY) | 20 | ANY7 |
| RED7／BLUE7 | RED7／BLUE7 | RED7／BLUE7 | RED7／BLUE7 | (ANY) | 80 | ANY7 |
| RED7／BLUE7 | RED7／BLUE7 | RED7／BLUE7 | RED7／BLUE7 | RED7／BLUE7 | 200 | ANY7 |
| 3BAR | 3BAR | 3BAR | (ANY) | (ANY) | 30 | 3BAR |
| 3BAR | 3BAR | 3BAR | 3BAR | (ANY) | 100 | 3BAR |
| 3BAR | 3BAR | 3BAR | 3BAR | 3BAR | 300 | 3BAR |
| 2BAR | 2BAR | 2BAR | (ANY) | (ANY) | 20 | 2BAR |
| 2BAR | 2BAR | 2BAR | 2BAR | (ANY) | 50 | 2BAR |
| 2BAR | 2BAR | 2BAR | 2BAR | 2BAR | 200 | 2BAR |
| 1BAR | 1BAR | 1BAR | (ANY) | (ANY) | 10 | 1BAR |
| 1BAR | 1BAR | 1BAR | 1BAR | (ANY) | 30 | 1BAR |
| 1BAR | 1BAR | 1BAR | 1BAR | 1BAR | 150 | 1BAR |
| 1BAR／3BAR | 1BAR／3BAR | 1BAR／3BAR | (ANY) | (ANY) | 5 | ANYBAR |
| 1BAR／3BAR | 1BAR／3BAR | 1BAR／3BAR | 1BAR／3BAR | (ANY) | 10 | ANYBAR |
| 1BAR／3BAR | 1BAR／3BAR | 1BAR／3BAR | 1BAR／3BAR | 1BAR／3BAR | 50 | ANYBAR |
| 1BAR／2BAR | 1BAR／2BAR | 1BAR／2BAR | (ANY) | (ANY) | 5 | ANYBAR |
| 1BAR／2BAR | 1BAR／2BAR | 1BAR／2BAR | 1BAR／2BAR | (ANY) | 10 | ANYBAR |
| 1BAR／2BAR | 1BAR／2BAR | 1BAR／2BAR | 1BAR／2BAR | 1BAR／2BAR | 50 | ANYBAR |
| 2BAR／3BAR | 2BAR／3BAR | 2BAR／3BAR | (ANY) | (ANY) | 5 | ANYBAR |
| 2BAR／3BAR | 2BAR／3BAR | 2BAR／3BAR | 2BAR／3BAR | (ANY) | 10 | ANYBAR |
| 2BAR／3BAR | 2BAR／3BAR | 2BAR／3BAR | 2BAR／3BAR | 2BAR／3BAR | 50 | ANYBAR |

FIG. 29

BONUS SYMBOL VALUE DETERMINATION TABLE

| No. | SYMBOL ID | BONUS SYMBOL VALUE | | WEIGHT | |
|---|---|---|---|---|---|
| | | Low | High | Low | High |
| 1 | A | 2 | 10 | 93 | 7 |
| 2 | B | 2 | 10 | 93 | 7 |
| 3 | C | 3 | 10 | 93 | 7 |
| 4 | D | 3 | 10 | 93 | 7 |
| 5 | E | 3 | 30 | 93 | 7 |
| 6 | F | 3 | 30 | 93 | 7 |
| 7 | G | 10 | 60 | 50 | 50 |
| 8 | H | 10 | 60 | 50 | 50 |
| 9 | I | 20 | 100 | 45 | 55 |
| 10 | J | 20 | 100 | 45 | 55 |

FIG. 31

BONUS SYMBOL PAYOUT TABLE

| NUMBER OF "KIND" SYMBOLS | BONUS |
|---|---|
| 1 | 0 |
| 2 | 0 |
| 3 | 1 |
| 4 | 2 |
| 5 | 3 |
| 6 | 5 |
| 7 | 10 |
| 8 | 20 |
| 9 | 30 |
| 10 | 50 |

(STOP OF SPINNING)

FIG. 41A

ROULETTE PAYOUT TABLE

| No. | PAYMENT | WEIGHT |
|---|---|---|
| 1 | 20 | 25 |
| 2 | 80 | 5 |
| 3 | 30 | 40 |
| 4 | 90 | 5 |
| 5 | 40 | 30 |
| 6 | 70 | 5 |
| 7 | 50 | 30 |
| 8 | 60 | 10 |
| 9 | 100 | 5 |
| 10 | 10 | 10 |
| TOTAL | | 165 |

FIG. 41B

EXPECTATION VALUE OF NUMBER OF PAYOUTS IN FREE GAME

EXPECTATION VALUE OF PAYMENT IN UNIT GAME × FG $$= \sum_{m=1}^{\text{NUMBER OF SYMBOL COMBINATIONS}} (\text{PAYMENT OF COMBINATION } m \times \text{WEIGHT OF COMBINATION } m \,/\, \text{TOTAL WEIGHT}) \times \text{FG}$$

EXPECTATION VALUE OF NUMBER OF PAYOUTS IN ROULETTE GAME

EXPECTATION VALUE PAYMENT IN ROULETTE GAME × FG × 20

$$= \sum_{i=1}^{10} (\text{PAYMENT OF DISPLAY REGION } i \times \text{WEIGHT OF DISPLAY REGION } i \,/\, \text{TOTAL WEIGHT } (165)) \times \text{FG} \times 20$$

GAMING MACHINE CAPABLE OF REPEATEDLY EXECUTING A UNIT GAME

CROSS-REFERENCE TO RELATED APPLICATIONS

This application is based on and claims a priority from the prior Japanese Patent Application No. 2013-086613 filed on Apr. 17, 2013 and Japanese Patent Application No. 2013-101617 filed on May 13, 2013, the entire contents of which are incorporated herein by reference.

BACKGROUND OF THE INVENTION

1. Field of the Invention

The present invention relates to a gaming machine that is capable of repeatedly executing a unit game.

2. Background of the Related Art

Conventionally, it has been known that there is provided a gaming machine played in such a manner that a player presses a spin button subsequent to entry of a gaming medium such as a coin, whereby symbols that are displayed for the player when a plurality of reels are stopped are determined by lottery processing; scrolling of symbol arrays of a respective one of the reels are started; the scrolling is stopped so that the determined symbols are displayed for the player, and then, the symbols are rearranged; it is determined whether or not a combination of the displayed symbols is associated with a prize; and in a case where the combination of the displayed symbols is associated with the prize, a bonus according to a kind of the winning combination of the symbols is awarded to the player.

In such a gaming machine, an allowable number of payouts at the time of a bonus game is determined and set as triggered by a prize of BB according to activation of a bonus (for example, refer to Japanese Unexamined Patent Application Publication No. 2007-20954). According to this gaming machine, a player can play a bonus game until the set allowable number of payouts has been reached.

However, in such a gaming machine, after a player has won the prize of BB according to actuation of a bonus, the game is merely played until the medals of which the allowable number of payouts is determined has been paid out. Therefore, the player merely consumes the predetermined allowable number of payouts and thus a variety of game patterns could not imparted to the player in a bonus game.

Accordingly, it is an object of the present invention to provide a gaming machine adapted to respectively determine values according to symbols, based on a prize by lottery processing, so that a total of the values that corresponds to these symbols is equal to the number of free games that can be played at the time of a bonus game, thereby making it possible to achieve respectively different game patterns at the time of the bonus game.

In addition, it is a further object of the present invention to provide a gaming machine adapted to partially change display colors of symbols according to values of the symbols determined by lottery processing, thereby making it possible to produce a situation that a player can approximately visually and intuitively predict the number of free games that can be played at the time of a bonus game, to provide diversified variations to the bonus game and to enable the player to feel a sense of expectation for the bonus game.

SUMMARY OF THE INVENTION

In a first embodiment of the present invention, a gaming machine is directed to a gaming machine in which a payment is determined based on rearranged symbols, the gaming machine comprising:

a reel assembly (for example, a reel assembly M11) including a plurality of reels in which a plurality of symbols are assigned on outer surfaces (five reels M3*a* to M3*e* displayed in a display window 150 of a symbol display unit 40) and a backlight illuminating a respective one of the reels from inside (for example, a backlight device M7);

a predetermined symbol included in the plurality of symbols, the predetermined symbol being capable of displaying a different symbol according to a light emitting color of the backlight (for example, a BONUS symbol);

a controller (such as a main CPU 222 or a main body PCB 240, for example) for controlling a first game (a normal game) to rearrange the plurality of symbols in a display region (a display window 150, for example) on a first display (for example, a symbol display unit 40), the controller being programmed to execute processing operations of (1-1) to (1-5) below:

(1-1) determining symbols to be rearranged, by a first lottery (for example, a lottery based on a symbol determination table);

(1-2) in a case where the rearranged symbols meet a first condition (for example, a case where BONUS symbols are displayed at least on the first reel M3*a* to the third reel M3*c*), with respect to the predetermined symbols meeting a second condition (for example, in a case where the BONUS symbols are displayed at least in the first reel M3*a* to the third reel M3*c*, and in a case where the BONUS symbols continuously exist from the fourth reel M3*d* and the fifth reel M3*e*, these BONUS symbols are included as well), determining respectively corresponding values thereto (for example, values that correspond to the BONUS symbols) by a second lottery (for example, a lottery based on a BONUS symbol value determination table);

(1-3) switching a light emitting color of the backlight so that a respective one of the predetermined symbols meeting the second condition displays a different symbol according to the values (for example, a symbol displaying a numeric portion "2" in a green color or a BONUS symbol displaying a numeric portion "10" in a red color);

(1-4) adding the values and obtaining the number of second games (for example, free games); and (1-5) displaying the allowable number of the second games on a second display (for example, a video display unit 110).

With such a configuration of the present invention, a total of values that correspond to predetermined symbols meeting a predetermined condition is determined and displayed as the number of second games. Thus, a second game is played based on a different number of games every time, diversified variations are imparted to the play of game, enabling a player to feel a sense of expectation or to have an interest. Also, it is possible to prompt the consciousness of the player at time intervals from start to stop of reel spinning to concentrate on the displayed contents or display positions of symbols. In addition, for example, among the predetermined symbols, a symbol of a high value is displayed so as to include a red color, and a symbol of a low value is displayed so as to include a green color, and thus, the player can visually and intuitively predict the number of the second games by the colors that are displayed for the player or by color arrangement at time intervals from start to stop of reel spinning, enabling the player to feel a sense of expectation or to have an interest more remarkably.

A second embodiment of the present invention is configured so that, in the first embodiment, the processing operation of (1-3) includes a processing operation of (1-3-1) switching a light emitting color after the predetermined symbols meeting the second condition have been rearranged (for example, after reel spinning has stopped after elapse of a predetermined period of time after a spin button has been pressed).

With such a configuration of the present invention, a hint by color is not imparted while predetermined symbols are spinning, and a player cannot predict whether the number of second game is large or small. Thus, the player's sense of expectation or tense atmosphere can be enhanced more remarkably.

A third embodiment of the present invention is configured so that, in the second embodiment, the processing operation of (1-3-1) includes a processing operation of (1-3-1-1) switching a light emitting color of the backlight so as to display a different symbol from a symbol to be displayed after the predetermined symbols have been rearranged, before the predetermined symbols meeting the second condition are rearranged and during spinning of the reels.

With such a configuration of the present invention, a hint by color is exactly imparted while predetermined symbols scrolls, and a player cannot predict whether the number of second games is small or large. Thus, the player's sense of expectation or tense atmosphere can be enhanced more remarkably.

A fourth embodiment of the present invention is configured so that, in the first embodiment, the processing operation of (1-3) includes a processing operation of (1-3-2) switching a light emitting color of the backlight so that a respective one of the predetermined symbols meeting the second condition displays a numeric shape representing a respective one of the values (for example, a numeric portion "2" and a "numeric portion "10" of a BONUS symbols).

With such a configuration of the present invention, values associated with predetermined symbols can be grasped merely by watching symbols displayed in a display region, and in addition to visual information by color, a player can predict the number of second games in more detail, enabling the player to feel a sense of expectation or to have an interest further remarkably.

A fifth embodiment of the present invention is configured so that, in the first embodiment, the processing operation of (1-5) includes a processing operation of (1-5-1) with respect to the predetermined symbols meeting the second condition in order to obtain the number of second games, sequentially adding respectively corresponding values thereto, and then, displaying display information including the number of games obtained by the adding processing (for example, information including the number of free games after added or images of BONUS symbols) with the elapse of the adding processing.

With such a configuration of the present invention, addition processing is sequentially conducted in a predetermined order for each predetermined symbol, and by watching the second display, a player can keep track of the progress of adding processing relevant to the number of second games. Thus, the player can enjoy the effects, and at the same time, the player can experience a sense of achievement or a sense of failure stepwise in accordance with the process of computation of the number of games or whether the number of games is small or large.

A sixth embodiment of the present invention is configured so that, in the fifth embodiment, the processing operation of (1-5-1) includes, in the adding processing, a processing operation of (1-5-1-1) adding the values that correspond to the predetermined symbols meeting the second condition in a predetermined sequential order according to rearranged positions in the display region of the predetermined symbols meeting the second condition (for example, a sequential order of a first line of the first reel M3*a*, a third line of the first reel M3*a*, a first line of the second reel M3*b*, . . . ).

With such a configuration of the present invention, adding processing is sequentially conducted in a predetermined sequential order for a respective one of predetermined symbols, and by watching a second display, a player can keep track of the progress of obtaining the number of second games, diversified variations are imparted to the play of game, and a sense of reality by an effect can be imparted to the player.

A seventh embodiment of the present invention is configured so that, in the fifth embodiment, the processing operation of (1-5-1) includes a processing operation of (1-5-1-2) changing a display mode or a voice of the display information relative to the second display, based on at least any one of rearranged positions in the display regions of the predetermined symbols targeted to be added, values that correspond to the predetermined symbols targeted to be added, and the number of second games before added or after added (for example, a processing operation of controlling the displayed contents, display timing, background music (BGM), effects or the like so as to be changed).

With such a configuration of the present invention, adding processing is sequentially conducted together with effects of a variety of conditions. Thus, a player can keep track of the progress of adding processing relevant to the number of second games by an effect that changes according to each situation by watching a second display, diversified variations are imparted to the play of game, and a sense of reality by the effects can be imparted to the player.

An eighth embodiment of the present invention is configured so that, in the fifth embodiment, the processing operation of (1-3) includes a processing operation of (1-3-3) switching a light emitting color of the backlight so that the predetermined symbols targeted to be added change displaying of the symbols in an exact timing with partway or completion of the adding processing (for example, a processing operation of displaying a numeric portion of BONUS symbol so as to be blinked in a green color or in a red color or to be turned OFF).

With such a configuration of the present invention, adding processing is sequentially conducted with effects of a variety of conditions. Thus, by watching a display region, a player can enjoy an effect that changes according to each situation as a part of the games with diversified variations.

In a ninth embodiment of the present invention, a gaming machine is directed to a gaming machine in which a payment is determined based on rearranged symbols, the gaming machine comprising:

a first display (for example, a symbol display unit 40) having a display region (for example, a display window 150) in which symbols associated with a respective one of a plurality of scroll lines (for example, five reels M3*a* to M3*e* displayed in the display window 150 of the symbol display unit 40) are to be displayed;

a controller (such as a main CPU 222, a main body PCB 240 or the like, for example) for controlling a first game in which the symbols associated with the scroll lines are moved and displayed in the display region, the controller being programmed to execute processing operations of (2-1) to (2-5) below:

(2-1) determining symbols to be rearranged, by a first lottery (for example, a lottery based on a symbol determination table);

(2-2) in a case where the rearranged symbols meet a first condition (for example, in a case where BONUS symbols are displayed at least in the first reel M3*a* to the third reed M3*c*), with respect to predetermined symbols (for example, BONUS symbols) meeting a second condition (for example, in a case where the BONUS symbols are displayed at least in the first reels M3*a* to the third reel M3*c* and in a case where the BONUS symbols continuously exist from the fourth reel M3*d* and the fifth reel M3*e*, these BONUS symbols are included as well), determining respectively corresponding values thereto (values that correspond to the BONUS symbols);

(2-3) controlling a respective one of the predetermined symbols meeting the second condition so as to change a display or color of at least part in accordance with the values (for example, displaying a numeric portion "2" in a green color or displaying a numeric portion "10" in a red color);

(2-4) adding the values and obtaining the number of second games (for example, free games); and (2-5) displaying the number of the second games on a second display (for example, a video display unit 110).

With such a configuration of the present invention, a total of values that correspond to predetermined symbols meeting a predetermined condition is determined and displayed as the number of second games. Thus, a second game is played based on a different number of games every time, diversified variations are imparted to the play of game, enabling a player to feel a sense of expectation or to have an interest. Also, it is possible to prompt the consciousness of the player at time intervals from start to stop of reel spinning to concentrate on the displayed contents or display positions of symbols. In addition, for example, among the predetermined symbols, a symbol of a high value is displayed so as to include a red color, and a symbol of a low value is displayed so as to include a green color, and thus, a player can visually and intuitively predict the number of second games by the colors that are displayed for symbols or by color arrangement at time intervals from start to stop of reel rotation, enabling the player to feel a sense of expectation or to have an interest more remarkably.

A tenth embodiment of the present invention is configured so that, in the ninth embodiment, the processing operation of (2-3) includes a processing operation of (2-3-1) controlling the predetermined symbols to change after the predetermined symbols meeting the second condition have been rearranged (for example, after reel spinning has stopped after elapse of a predetermined period of time after a spin button has been pressed).

With such a configuration of the present invention, a hint by color is not imparted during spinning of predetermined symbols, and a player cannot predict whether the number of second games is large or small cannot be predicted. Thus, the player's sense of expectation or tense atmosphere can be enhanced more remarkably.

An eleventh embodiment of the present invention is configured so that, in the tenth embodiment, the processing operation of (2-3-1) includes a processing operation of (2-3-1-1) controlling the predetermined symbols to change to a different symbol from a display mode after the predetermined symbols have been rearranged (for example, a symbol displayed in a green color regardless of whether or not values that correspond to BONUS symbols are large or small with respect to numeric portions of the BONUS symbols) before the predetermined symbols meeting the second condition are rearranged and during spinning of the reels.

With such a configuration of the present invention, during scrolling of predetermined symbols, a hint by color is not exactly imparted, a player cannot predict whether the number of second games is large or small. Thus, the player's sense of expectation or tense atmosphere can be enhanced more remarkably.

A twelfth embodiment of the present invention is configured so that, in the ninth embodiment, the processing operation of (2-3) includes a processing operation of (2-3-2) controlling a respective one of the predetermined symbols meeting the second condition to display a numeric shape representing a respective one of the values (for example, a numeric portion "2" and a numeric portion "10" of BONUS symbols).

With such a configuration of the present invention, values associated with predetermined symbols can be grasped merely by watching symbols that are displayed in a display region, and in addition to visual information by color, a player can predict the number of second games in more detail, enabling the player to feel a sense of expectation or to have an interest further remarkably.

A thirteenth embodiment of the present invention is configured so that, in the ninth embodiment, the processing operation of (2-5) includes a processing operation of (2-5-1) with respect to the predetermined symbols meeting the second condition, sequentially adding respectively corresponding values thereto in order to obtain the number of second games, and then, displaying the number of games that is obtained by the adding processing on the second display with the progress of the adding processing.

With such a configuration of the present invention, adding processing is sequentially conducted for a respective one of predetermined symbols, and a player can keep track of the progress of adding processing relevant to the number of second games by watching a second display. Thus, the player can enjoy the effect, and at the same time, the player can experience a sense of achievement or a sense of failure stepwise in accordance with the progress of computation of the number of games or whether the number of games is small or large.

A fourteenth embodiment of the present invention is configured so that, in the thirteenth embodiment, the processing operation of (2-5-1) includes, in the adding processing, a processing operation of (2-5-1-1) adding the values that correspond to the predetermined symbols meeting the second condition in a predetermined sequential order according to rearranged positions in the display regions of the predetermined symbols meeting the second condition (for example, in a sequential order of a first line of the first reel M3*a*, a third line of the first reel M3*a*, a first line of the second reel M3*b*, . . . ).

With such a configuration of the present invention, adding processing is sequentially conducted in a predetermined order, a player can keep track of the progress of adding processing relevant to the number the number of second games by watching a second display, diversified variations are imparted to the play of a game, and a sense of reality by an effect can be imparted to the player.

A fifteenth embodiment of the present invention is configured so that, in the thirteenth embodiment, the processing operation of (2-5-1) includes a processing operation of (2-5-1-2) changing a display mode or a voice of the display information relative to the second display, based on at least either of rearranged positions in the display regions of the predetermined symbols targeted to be added, values that correspond to the predetermined symbols targeted to be added, and the number of second games before or after added (for example, a processing operation of controlling displayed contents, a display timing, background music (BGM), an effect or the like).

With such a configuration of the present invention, adding processing is sequentially conducted for a respective one of predetermined symbols with effects of a variety of conditions. Thus, by watching a second display, a player can keep track of the progress of adding processing relevant to the number of second games by an effect that changes according to each situation, diversified variations can be imparted to the play of a game, and a sense of reality by the effect can be imparted to the player.

A sixteenth embodiment of the present invention is configured so that, in the thirteenth embodiment, the processing operation of (2-3) includes a processing operation of (2-3-3) controlling the predetermined symbols targeted to be added, to change displays of the symbols in an exact timing with partway or completion of the adding processing (for example, a processing operation of displaying a numeric portion of a BONUS symbol to be blinked in a green color or red color to be turned OFF).

With such a configuration of the present invention, adding processing is sequentially conducted with effects of a variety of conditions. Thus, by watching a display region, a player can enjoy an effect that changes according to each situation as a part of game with diversified variations.

In a seventeenth embodiment of the present invention, a gaming machine is directed to a gaming machine in which a payment is determined based on rearranged symbols, the gaming machine comprising:

a reel assembly (for example, a reel assembly M11) including a plurality of reels in which a plurality of symbols are assigned on outer surfaces (for example, five reels M3*a* to M3*e* displayed in a display window 150 of a symbol display unit 40) and a backlight illuminating a respective one of the reels from inside (for example, a backlight device M7);

a predetermined symbol included in the plurality of symbols, the predetermined symbol being capable of displaying a different symbol according to a light emitting color of the backlight (for example, a BONUS symbols); and a controller (such as a main CPU 222 or a main body PCB 240, for example) for controlling a first game (for example, a normal game) in which the plurality of symbols are rearranged in a display region (for example, a display window 150) of a first display (for example, a symbol display unit 40), the controller being programmed to execute processing operations (3-1) to (3-6) below:

(3-1) determining symbols to be rearranged, by a first lottery (for example, a lottery based on a symbol determination table);

(3-2) in a case where the rearranged symbols meet a first condition (for example, in a case where BONUS symbols are displayed at least in the first reel M3*a* to the third reel M3*c* and in a case where all of ten BONUS symbols are displayed), with respect to the predetermined symbols (for example, BONUS symbols) meeting a second condition (for example, all the BONUS symbols displayed), determining respectively corresponding values thereto (for example, values that correspond to the BONUS symbols) without conducting a lottery;

(3-3) in a case where the rearranged symbols meet a third condition (for example, in a case where BONUS symbols are displayed at least in the first reel M3*a* to the third reel M3*c*), with respect to the predetermined symbols (for example, BONUS symbols) meeting a fourth condition (for example, in a case where BONUS symbols are displayed at least in the first reel M3*a* to the third reel M3*c* and in a case where BONUS symbols continuously exist in the fourth reel M3*d* and the fifth reel M3*e*, these BONUS symbols are included as well), determining respectively corresponding values thereto (for example, values that correspond to the BONUS symbols);

(3-4) switching a light emitting color of the backlight so that a respective one of the predetermined symbols of which the corresponding values are determined display a different symbol in accordance with the value (for example, a symbol displaying a numeric portion "2" in a green color or a BONUS symbol displaying a numeric portion "10" in a red color);

(3-5) adding the values and obtaining the number of second games (for example, free games); and (3-6) displaying the number of the second games on a second display (for example, a video display unit 110).

With such a configuration of the present invention, an advantageous effect similar to that of the first embodiment described above can be attained, and a configuration is employed in such a manner that in a case where all of predetermined symbols (BONUS symbols) are displayed, a maximum value is always assigned, whereby a player's sense of expectation or interest can be enhanced more remarkably. It is to be noted that the configurations of the second to eighth embodiments described above can be applied to the seventeenth embodiment.

In an eighteenth embodiment of the present invention, a gaming machine is directed to a gaming machine in which a payment is determined based on rearranged symbols, the gaming machine comprising:

a first display (for example, a symbol display unit 40) having a display region (for example, a display window 150) in which a symbol associated with a respective one of a plurality of scroll lines (for example, five reels M3*a* to M3*e* displayed in the display window 150 of the symbol display unit 40) is displayed;

a controller (such as a main CPU 222 or a main body PCB 240, for example) for controlling a first game in which the symbols associated with the scroll lines are moved and rearranged in the display region, the controller being programmed to execute processing operations of (4-1) to (4-6) below:

(4-1) determining symbols to be arranged, by a first lottery (for example, a lottery based on a symbol determination table);

(4-2) in a case where the rearranged symbols meet a first condition (for example, in a case where BONUS symbols are displayed at least in the first reel M3*a* to the third reel M3*c* and in a case where all of ten BONUS symbols are displayed), with respect to predetermined symbols (for example, BONUS symbols) meeting a second condition (for example, all the BONUS symbols displayed), determining respectively corresponding values thereto (for example, values that correspond to the BONUS symbols) (For example, the process of determining the value of the High);

(4-3) in a case where the rearrange symbols meet a third condition (for example, in a case where BONUS symbols are displayed at least in the first reel M3*a* to the third reel M3*c*), with respect to the predetermined symbols meeting a fourth condition (for example, in a case where BONUS symbols are displayed at least in the first reel M3*a* to the third reel M3*c* and in a case where BONUS symbols continuously exist in the fourth reel M3*d* and the fifth reel M3*e*, these BONUS symbols are included as well), determining respectively corresponding values thereto (values that correspond to the BONUS symbols) by a second lottery (for example, a lottery based on a BONUS symbol value determination table);

(4-4) with respect to a respective one of the predetermined symbols of which the corresponding value is determined, controlling a display or a color of at least a part to change in accordance with the value (for example, displaying a numeric portion "2" in a green color or displaying a numeric portion "10" in a red color);

(4-5) adding the values and obtaining the number of second games (for example, free games); and (4-6) displaying the number of the second games on a second display (for example, a video display unit 110).

With such a configuration of the present invention, an advantageous effect similar to that of the ninth embodiment described above can be attained, and a configuration is employed in such a manner that in a case where all the predetermined symbols (BONUS symbols) are displayed, a maximum value is always assigned, whereby a player's sense of expectation or interest can be enhanced more remarkably. It is to be noted that the configurations of the tenth to sixteenth embodiments described above can be applied to the eighteenth embodiment.

A gaming machine that is capable of achieving respectively different game patterns at the time of a bonus game is provided. In addition, a gaming machine that is capable of imparting diversified variations to a bonus game and causing a player to feel a sense of expectation for the bonus game is provided.

BRIEF DESCRIPTION OF THE DRAWINGS

FIG. 17 is a view showing an example of a payline definition table;

FIG. 18 is a view showing an example of a symbol determination table;

FIG. 19 is a view showing a payout table;

FIG. 29 is a view showing an example of a BONUS symbol value determination table;

FIG. 31 is a view showing an example of a BONUS symbol payout table;

FIGS. 41A and 41B are views showing an example of a roulette payout table and a formula for obtaining an expectation value of the number of payouts;

DESCRIPTION OF PREFERRED EMBODIMENTS

[Description of Functional Flowchart]

Figure 1:
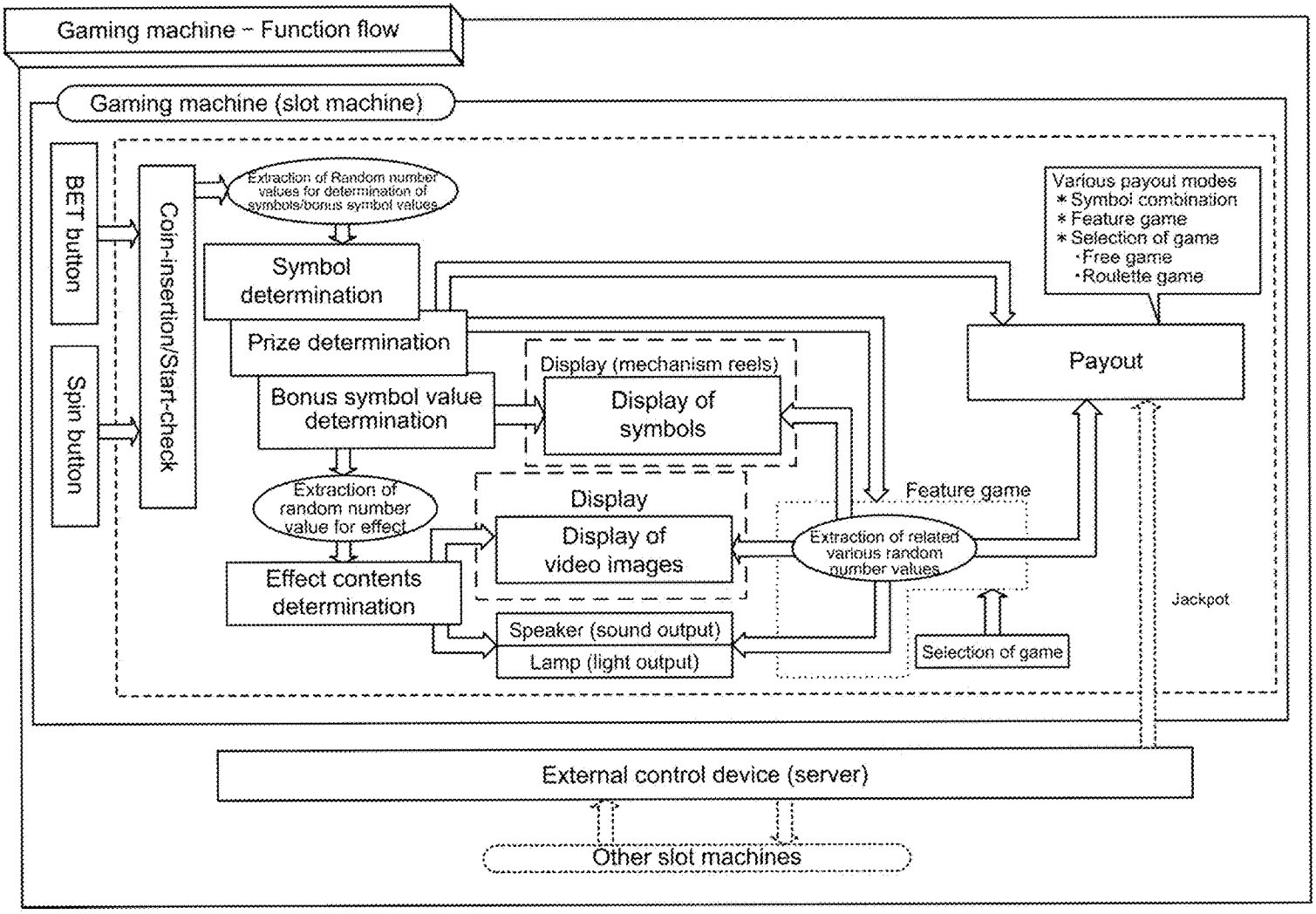
FIG. 1 is a chart showing a functional flow of operation in a gaming machine.

With reference to FIG. 1, basic functions of a gaming machine according to the embodiments will be described. FIG. 1 is a view showing a functional flow of operation in a gaming machine according to an embodiment of the present invention.

(Coin Entry/Start Check)

First, a gaming machine checks whether or not a BET button has been pressed by a player, and subsequently, checks whether or not a spin button has been pressed by a player.

(Determination of Symbols)

Next, when the spin button has been pressed by the player, the gaming machine extracts random number values for determination of symbols, and determines symbols to be displayed for the player when scrolling of symbol arrays has been stopped, in accordance with a respective one of a plurality of reels that are displayed on a display.

(Determination of Prizes)

Next, the gaming machine determines whether or not a combination of the symbols displayed for the player is associated with a prize.

(Determination of BONUS Symbol Values)

Next, the gaming machine extracts random number values for determination of symbol values when the combination of the symbols displayed for the player is associated with a feature game (bonus game) trigger at the time of determination of prizes, and determines a value for a respective one of BONUS symbols according to the feature game triggers from among the symbols displayed on the display.

(Display of Symbols)

Next, the gaming machine starts scrolling of symbol arrays of a respective one of the reels, and rearranges symbols so as to stop scrolling so that the determined symbols are displayed for the player. In addition, with respect to the symbols associated with the feature game trigger, a display color of a part of the symbols is changed based on the values of the determined BONUS symbols (the values that correspond to the BONUS symbols).

(Payout)

Next, the gaming machine awards a bonus according to a kind of a combination of the symbols to the player when the combination of the symbols that are displayed for the player is associated with a prize. For example, the gaming machine pays out to the player coins in number according to the combination of the symbols when the combination of symbols associated with payout of the coins is displayed. In addition, with respect to a combination of BONUS symbols according to the feature game trigger, a bonus according to the number of the symbols is awarded to the player.

Also, in the gaming machine of the embodiment, when the combination of the symbols associated with the feature game trigger is displayed, a selection screen for selecting a free game or a roulette game is displayed on the display. It is to be noted that the free game is a game in which a lottery relevant to the determination of symbols and determination of BONUS symbol values mentioned previously is conducted over a predetermined number of times without consuming any coin.

In addition, the gaming machine can pay out coins of the amount of jackpot to the player in a case where the player has won a predetermined level in a jackpot game. The jackpot refers to a function of accumulating a part of coins that are consumed by the player in the gaming machine as the amount of jackpot, and in a case where the player has won the predetermined level of jackpot, paying out the number of payouts according to the amount of payment of that level. The gaming machine computes the amount that is accumulated as the amount of jackpot (accumulated amount) every time one game is played, and accumulates the consumed coins as the amount of jackpot.

The jackpot may be of a standalone type such that a single gaming machine is employed, and a part of coins consumed in a single gaming machine is accumulated as the amount of jackpot in that gaming machine, or alternatively, may be of a network type such that a jackpot is shared by connecting gaming machines to each other in a single gaming facility or in a plurality of gaming facilities, and the accumulated amount of jackpot is transmitted via an external control device.

In the network type, a part of coins consumed by a player in each gaming machine is transmitted as the amount of jackpot to the external control device, and in the external control device, the received amount of jackpot is accumulated, and is shared by each gaming machine. In a case where a gaming machine has won the predetermined level of jackpot, the amount of jackpot is transmitted from the external control device to that gaming machine.

In addition, in a gaming machine, in addition to the bonus mentioned above, a bonus such as a mystery bonus may be provided. The mystery bonus is a bonus in which payout of a predetermined amount of coins is conducted by winning an exclusive lottery. When the spin button is pressed, the gaming machine extracts random number values for mystery bonus, and determines whether or not a mystery bonus trigger is established, by a lottery.

(Determination of Effects)

The gaming machine conducts effects by displaying an image by the display, outputting light by a lamp, and outputting a sound by a speaker. The gaming machine extracts random number values for effects, and determines the contents of the effects based on symbols or the like that are determined by a lottery. In a free game, the contents of the effects are determined based on rearranged positions of BONUS symbols or the number of free games or the like.

[Entire Game System]

Figure 2:
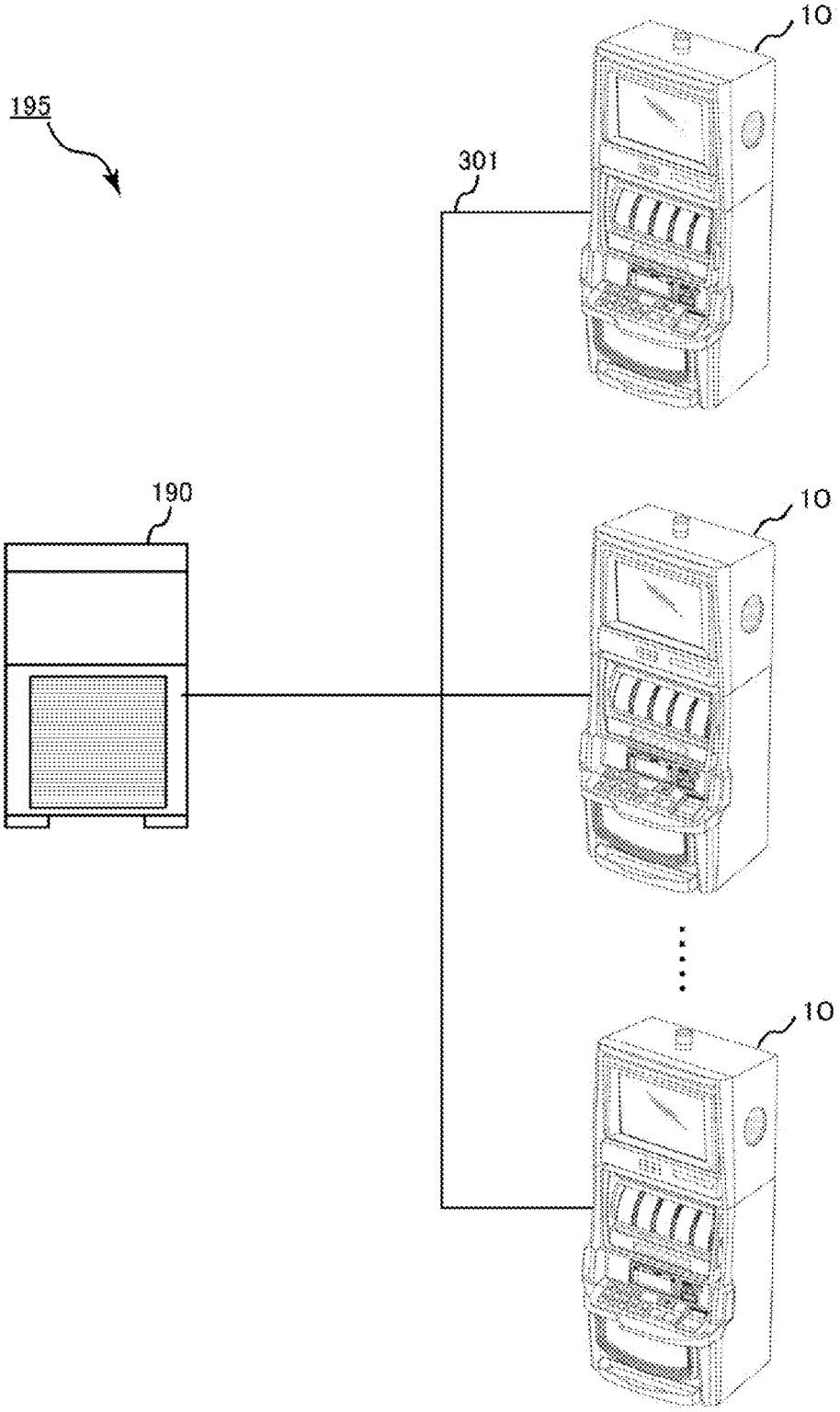
FIG. 2 is a view showing a game system including gaming machines.

A description of the basic functions of the gaming machine has been given hereinabove. Next, with reference to FIG. 2, a game system including gaming machines will be described. FIG. 2 is a view showing a game system including gaming machines, according to an embodiment of the present invention.

A game system 195 includes a plurality of gaming machines 10 and an external control device 190 that is connected to a respective one of the gaming machines 10 via a communication line 301.

The external control device 190 controls the plurality of gaming machines 10. In the embodiment, the external control device 190 is a so called "hall server" that is installed in a gaming facility having the plurality of gaming machines 10. A respective one of unique identification numbers is assigned to a respective one of the gaming machines 10, and by using the identification numbers, the external control device 190 determines a source of data that is transmitted from a respective one of the gaming machines 10. In addition, data is transmitted from the external control device 190 to any one of the gaming machines 10 as well, and a transmission destination is specified by employing the identification number.

The game system 195 may be constructed in one gaming facility in which a variety of games such as casino can be played, or alternatively, may be constructed among a plurality of gaming facilities. Also, in a case where the game system is constructed in one gaming facility, the game system 195 may be constructed by divisional floor or section in the gaming facility. The communication line 301 may be wired or wireless, and a leased line or a switchboard line or the like can be employed.

[Entire Structure of Gaming Machine]

Figure 3:
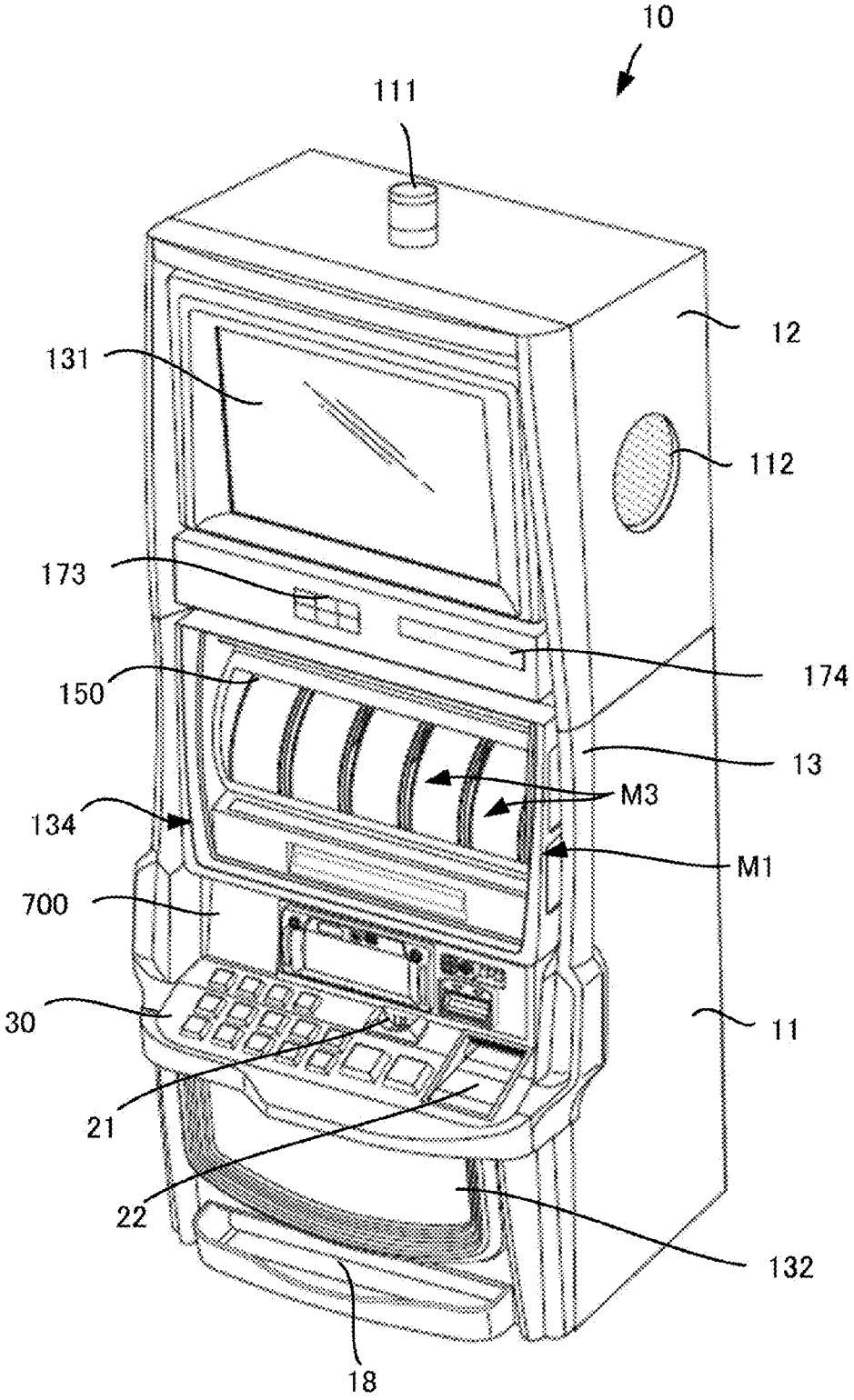
FIG. 3 is a view showing an entire configuration of a gaming machine.
Figure 4:
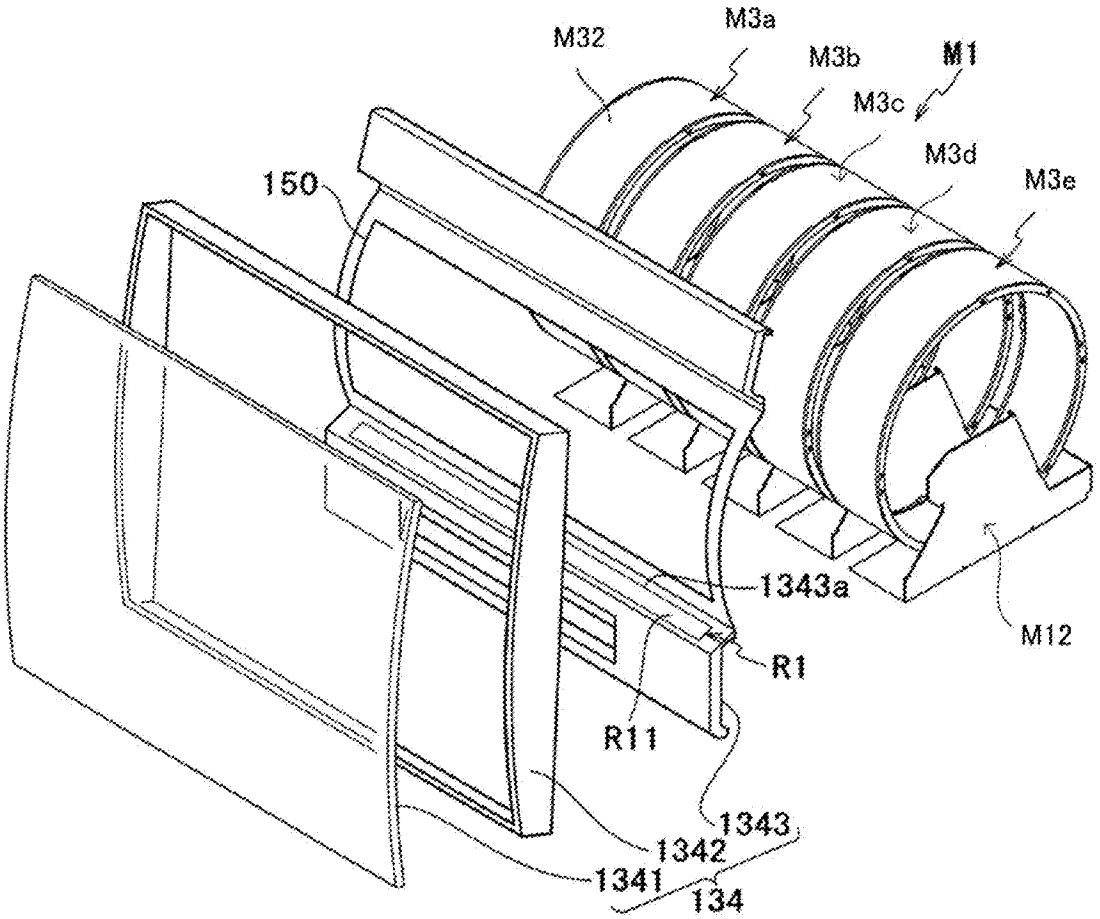
FIG. 4 is an exploded perspective view of a reel unit and a reel cover.

A description of the game system according to the embodiment has been given hereinbefore. Next, with reference to FIG. 3, an entire structure of a gaming machine 10 will be described. FIG. 3 is a view showing an entire construction of a gaming machine according to an embodiment of the present invention.

In the gaming machine 10, coins, bills, or electronic valid information equivalent thereto are employed as gaming mediums. In particular, in the embodiment, credit-related data such as cash data that is stored in an IC card 450 is employed.

The gaming machine 10 includes: a cabinet 11; a top box 12 that is installed at an upper side of the cabinet 11; and a main door 13 that is provided on a front face of the cabinet 11.

At the main door 13, a reel unit M1 is provided. On a front face of the reel unit M1, a reel cover 134 is provided. As shown in FIG. 4 to FIG. 7, the reel cover 134 has: a transparent panel 1341; a panel frame 1342 in which the transparent panel 1341 is provided at a front face portion; and a panel supporting body 1343 adapted to support the panel frame 1342. On the panel support body 1343, a light emitting device R1 is provided. The light emitting device R1 has: a transparent panel R11 that is provided in an opening portion 1343*a* of the panel support body 1343; and a light source device R12 emitting visible light 901. A detailed description of the light emitting device R1 will be given later.

The reel cover 134 has a display window 150 at a central part thereof, as shown in FIG. 3. The display window 150 is capable of visually recognizing fifteen symbols of five columns and three lines from the outside. Three symbols of each column are part of symbols that are arranged on outer circumferential faces of reels M3*a* to M3*e*. In a respective one of the reels M3*a* to M3*e*, three symbols are movably displayed in a lower direction or in an upper direction while the reel spinning speed is entirely changed, thereby enabling symbol rearrangement to be conducted in such a manner as to stop the symbols that are displayed on a respective one of the symbols after these symbols have been spun in a vertical direction.

Although the embodiment describes a case in which the gaming machine 10 includes a reel unit M1 of a mechanical reel system, the gaming machine 10 of the present invention may be a video reel system of displaying simulative reels, or alternatively, may be a mixture of the video reel system and the mechanical system. Also, in the reel cover 134, a touch panel may be provided. In this case, a player can input a variety of instructions by operating the touch panel. From the touch panel, an input signal is transmitted to a main CPU 222. Further, the reel cover 134 may have a transparent liquid crystal panel in place of the transparent panel 1341. In a case where the reel cover has the transparent liquid crystal panel, effect is possible by using: a combination of symbols in the reel unit M1; visible information 902 that is produced by the visible light 901 from the light emitting device R1; and an effect image that is produced by the transparent liquid crystal panel.

Inside of the reel unit M1, a backlight device M7 is arranged. A detailed description of the backlight device M7 will be given later with reference to FIG. 8.

On a lower side of the reel unit M1, a control panel 30 is arranged. The control panel 30 includes a variety of buttons, a coin entry 21 receiving coins in the cabinet 11; and a bill entry 22.

Figure 9:
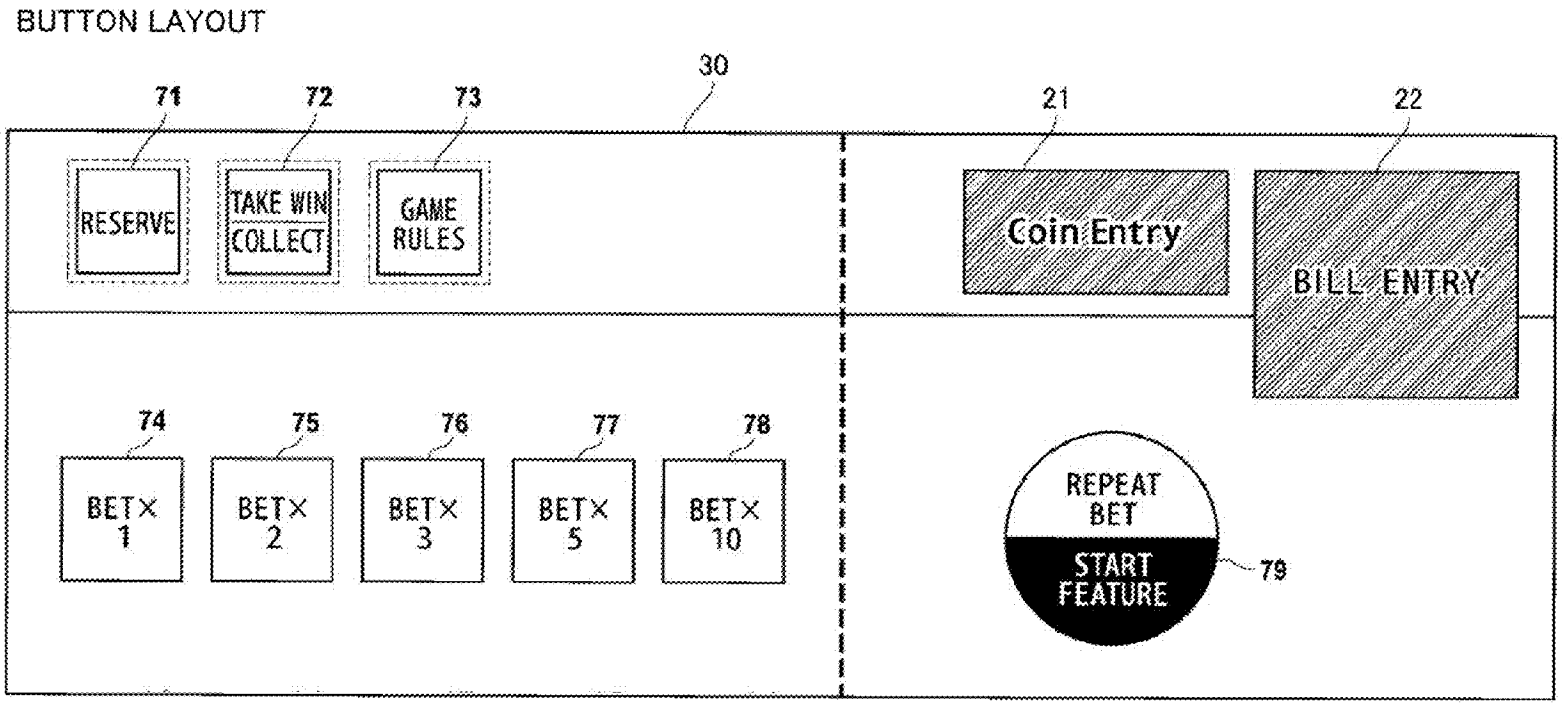
FIG. 9 is a schematic view showing a layout of buttons on a control panel of a gaming machine.

Specifically, as a part of the control panel 30 is schematically shown in FIG. 9, the control panel 30 includes a REVERSE button 71, a COLLECT button 72, a GAME RULES button 73, a 1-BET button 74, a 2-BET button 75, a 3-BET button 76, a 5-BET button 77, and a 10-BET button 78. The REVERSE button 71, the COLLECT button 72, and the GAME RULES button 73 are provided in an upper left region of the control panel 30. The 1-BET button 74, the 2-BET button 75, the 3-BET button 76, the 5-BET button 77, and the 10-BET button 78 are provided in a lower left region of the control panel 30. Also, a START button 79 is provided at a lower center of the control panel 30.

The REVERSE button 71 is employed when a player is temporarily away from a seat of a gaming machine to be played or when a player wants to ask a staff in a gaming facility for exchange of money. Also, the REVERSE button 71 can be used to store the credits that remain in an IC card inserted into an IC card reader 60. The COLLECT button 72 is used to supply an instruction to a gaming machine 10 in order to pay out the credited coins to a coin tray 92. The GAME RULES button 73 is used when a player is unfamiliar with game rules or an operating method. When the GAME RULES button 73 is pressed, a variety of help information is displayed on an upper image display panel 131.

The BET buttons 74 to 78 are used to set the amount of bets. Every time the 1-BET button 74 is pressed, one credit is bet for a respective one of active paylines from the current credits that are owned by a player. When the 2-BET button 75 is pressed, a unit game is started on condition that two credits are betted for a respective one of the active paylines. When the 3-BET button 76 is pressed, the unit game is started on condition that three credits are betted for a respective one of the active paylines. When the 5-BET button 77 is pressed, the unit game is started on condition that five credits are betted for a respective one of the active paylines. When the 10-BET button 78 is pressed, the unit game is started on condition that ten credits are betted for a respective one of the active paylines. The spin button (START switch) 79 is used to instruct the start of spinning of the reels M3*a* to M3*e* on a bet condition set earlier.

As shown in FIG. 3, on a lower front face of the main door 13, that is, on a lower side of the control panel 30, a coin acceptance slot 18 for accepting a coin and a belly glass 132 on which a popular character or the like of a gaming machine 10 is drawn are provided.

On a front face of the top box 12, an upper image display panel 131 is provided. The upper image display panel 131 is made of a liquid crystal panel, and constitutes a display. On the upper image display panel 131, an image relevant to effects or an image indicating an introduction to the contents of a game or an explanation of rules is displayed. Also, in the top box 12, a speaker 112 and a lamp 114 are provided. In the gaming machine 10, effects are executed by image display, sound output, and light output.

On a lower side of the upper image display panel 131, a data display 174 and a keypad 173 are provided. The data display 174 is made of a fluorescent display or an LED, and displays members data that is read from an IC card 450 inserted from a PTS terminal 700 or data that is input by a player via the keypad 173. The keypad 173 is adapted to input data.

<Reel Unit M1>

The reel unit M1 included in the gaming machine 10 is a configuration adapted to support a plurality of reels M3*a* to M3*e* so as to be a rotary shaft on a same straight line in a horizontal direction, as shown in FIG. 4 to FIG. 7. That is, the reel unit M1 has: a reel assembly M11 configured to rearrange symbols by rotatably driving the reels M3*a* to M3*e* in which the symbols are arranged on outer circumferential faces; and a reel unit retaining mechanism M12 adapted to detachably retain the reel assembly M11.

In the following description, in a case where an installation location of the reel assembly M11 is specified, this location is referred to as a respective one of the first to fifth reel assemblies M11*a* to M11*e* in a sequential order from a left end when these assemblies are seen from a front side.

The reel assembly M11 has: reels M3*a* to M3*e* in which symbols are arranged on outer circumferential faces; and a reel supporting mechanism M6 adapted to support the reels M3*a* to M3*e*. The reels M3*a* to M3*e* have circular ring-shaped reel bands 32 in which one or more symbols are arranged.

Figure 10:
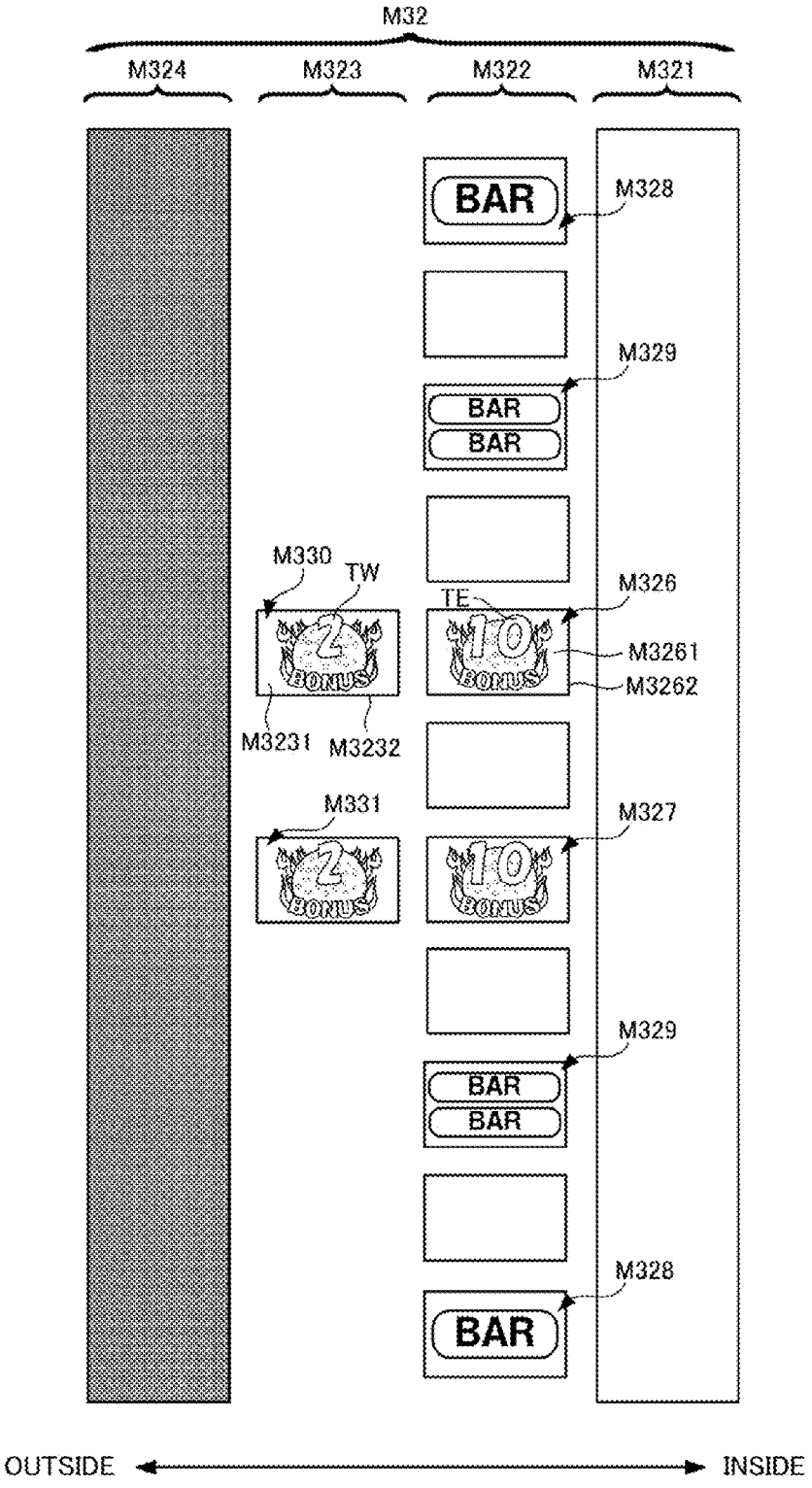
FIG. 10 is a plan view showing a reel band in an exploded manner.
Figure 11:
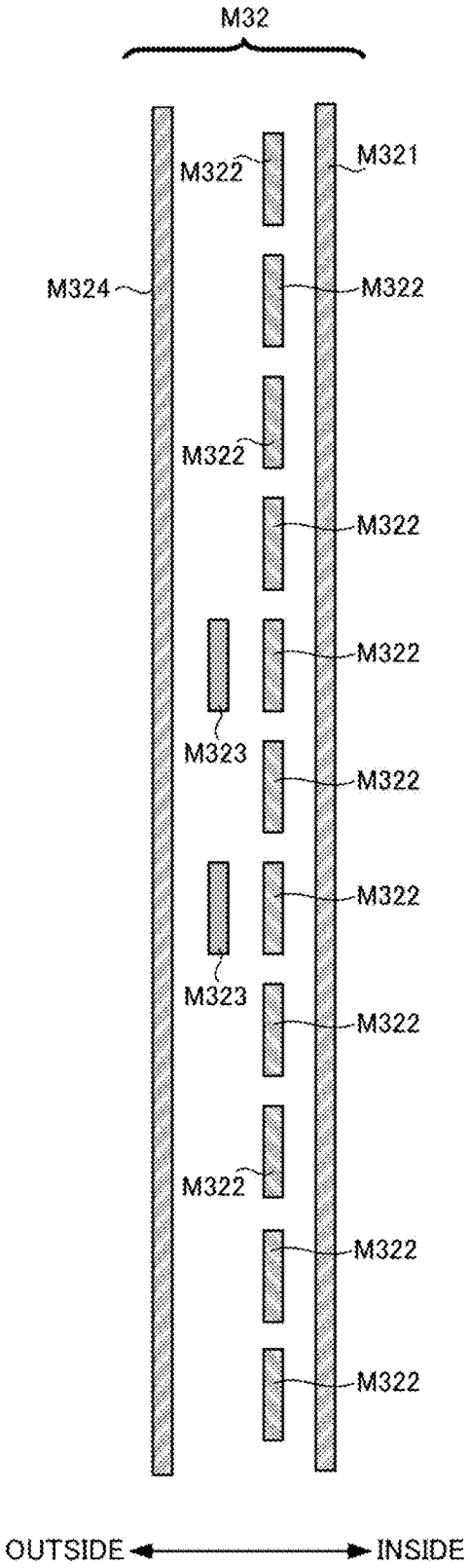
FIG. 11 is a sectional view showing the reel band in an exploded manner.

A reel band 32, as shown in FIG. 10 and FIG. 11, is a reel band in which a plurality of symbol sheets M322, a plurality of symbol sheets M323, and a half mirror layer M324 are laminated on a base layer M321 in sequential order. This reel band M32 may further include a smoke layer for making a specific symbol conspicuous in comparison with another symbol or a protection layer on an outer surface. The symbol sheets M322 and M323 print symbols on sheets of one or more predetermined colors.

The plurality of symbol sheets M322 include BONUS symbols (M326 and M327), a ONE-BAR symbol 328, and a TWO-BAR symbol M329.

The BONUS symbol M326 shown in FIG. 10 forms a transparent numeric portion "10" on a base M3261. Although in the embodiment, the numeric portion "10" (the numeric portion TE) was transparently formed, this numeric portion may be a portion having a slightly opaque transparency. The base M3261 is formed in a green color and a blue color having transparency. Specifically, in the base M3261, a wired portion of a pattern at the periphery of the numeric portion "10" (the numeric portion TE) is formed in a blue color. Of course, another region in a frame portion M3262 may be formed in a blue color. Also, another region of the base M3261, that is, the vicinity of the frame portion M3262 or a background portion of a pattern at the periphery of the numeric portion "10" (the numeric portion TE) is formed in a green color. The region at the periphery of the numeric region "10" (the numeric portion TE) corresponds to a region in which a numeric portion "2" (the numeric portion TW) of a BONUS symbol M330 is formed when a symbol sheet M322 is overlapped on a symbol sheet M323 to be described later. In such a symbol sheet M322, when red light is emitted by a backlight device M7 to be described later (refer to FIG. 8), the numeric portion "10" (the numeric portion TE) is displayed in a red color. Also, another BONUS symbol M327 is configured in a same manner as that in the BONUS symbol M326.

On the other hand, a plurality of symbol sheets M323 (two in the embodiment) include BONUS symbols (M330 and M331), and are respectively arranged to be overlapped on the BONUS symbols (M326 and M327), as shown in FIG. 11.

Figure 12A:
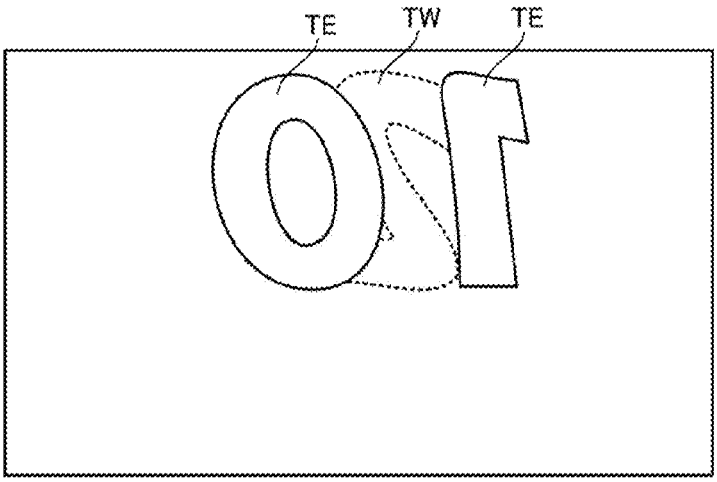
FIGS. 12A, 12B and 12C are views showing a state in which symbol sheets are overlapped on each other.
Figure 12B:
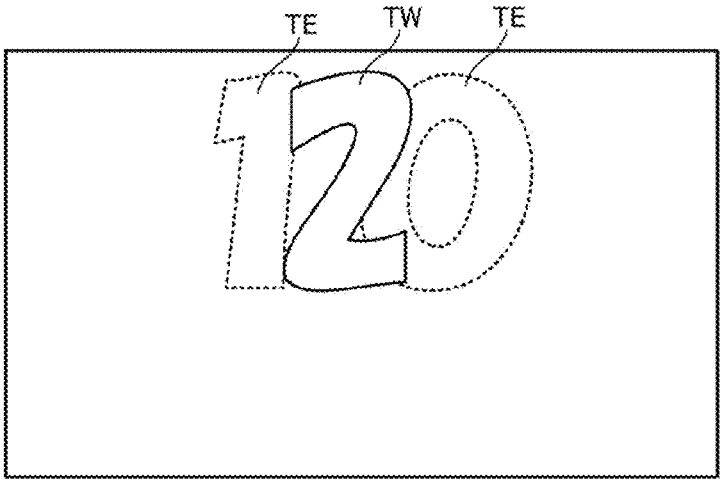
Figure 12C:
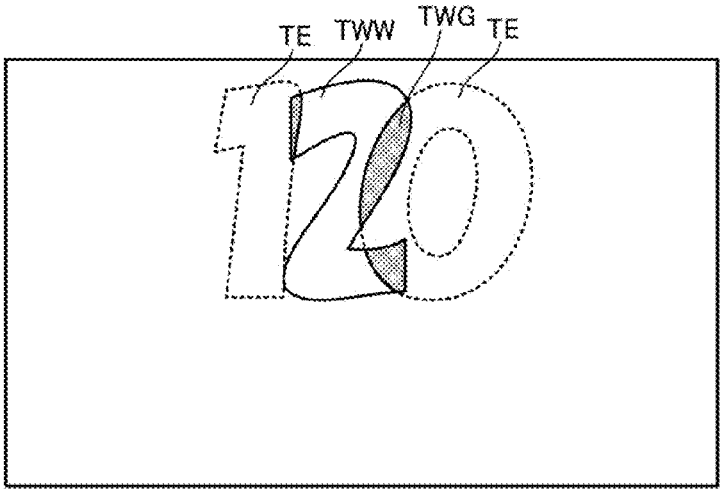

FIGS. 12A, 12B and 12C show states in which a BONUS symbol M330 is overlapped on a BONUS symbol M326. As shown in FIG. 12A, in a state in which a symbol sheet M323 is overlapped on a symbol sheet M322, when seen from a rear side (a reel inside), a numeric portion "10" (the numeric portion TE) of the BONUS symbol M326 that is arranged inside can be clearly visually recognized, and a numeric portion "2" (the numeric portion TW) of a BONUS symbol M330 that is arranged outside cannot be visually recognized or can hardly be visually recognized.

On the other hand, as shown in FIG. 12B, when seen from a front side (a player's side), the numeric portion "2" (the numeric portion TW) of the BONUS symbol M330 that is arranged on a front side can be clearly visually recognized, and the numeric portion "10" (the numeric portion TE) of the BONUS symbol M326 that is arranged on a rear side cannot be visually recognized or can be hardly visually recognized.

As shown in FIG. 12C, with respect to the BONUS symbol M330 of the symbol sheet M323, for example, a base M3231 other than the numeric portion "2" (the numeric portion TW) is formed in a red color and a blue color, each of which has transparency. Specifically, in the base M3231, a wired portion of a pattern at the periphery of the numeric portion "2" is formed in a blue color. Of course, another region in a frame portion M3232 may be formed in a blue color. Also, another region of the base M3231, that is, the vicinity of the frame portion M3232 or a background portion of the pattern at the periphery of the numeric portion "2" is formed in a red color. The region at the periphery of the numeric portion "2" corresponds to a region in which the numeric portion "10" of the BONUS symbol M326 is formed when the symbol sheet M323 is overlapped on the symbol sheet M322. A numeric portion TW includes a transparent portion TW having transparency and a green portion TWG having transparency whose color is the same as that of a base M3261 of the BONUS symbol M326. The green portion TWG is a portion that is indicated by way of cross hatching in FIG. 12C, and is equivalent to a portion at which the numeric portion "10" (the numeric portion TE) of the BONUS symbol M326 and the numeric portion "2" (the numeric portion TW) of the BONUS symbol M330 overlap on each other. Also, a BONUS symbol M331 is configured in a same manner as that in the BONUS symbol M330.

In the numeric portion "2" (the numeric portion TW) of the BONUS symbol M330, if its entirety is transparently formed, only a portion overlapping on the base M 3261 of the BONUS symbol M326 in the numeric portion TW is formed in a green color. By forming the green portion TWG of the BONUS symbol M330, when the symbol sheet M323 is overlapped on the symbol sheet M322, the entirety of the numeric portion "2" (the numeric portion TW) of the BONUS symbol M330 can be formed in a green color which is the same as that of the base M3261 of the BONUS symbol M326. In such a BONUS symbol M326, when green light is emitted by a backlight device M7 to be described later (refer to FIG. 8), the numeric portion "2" (the numeric portion TW of the BONUS symbol M330) is displayed in a green color.

Figure 13A:
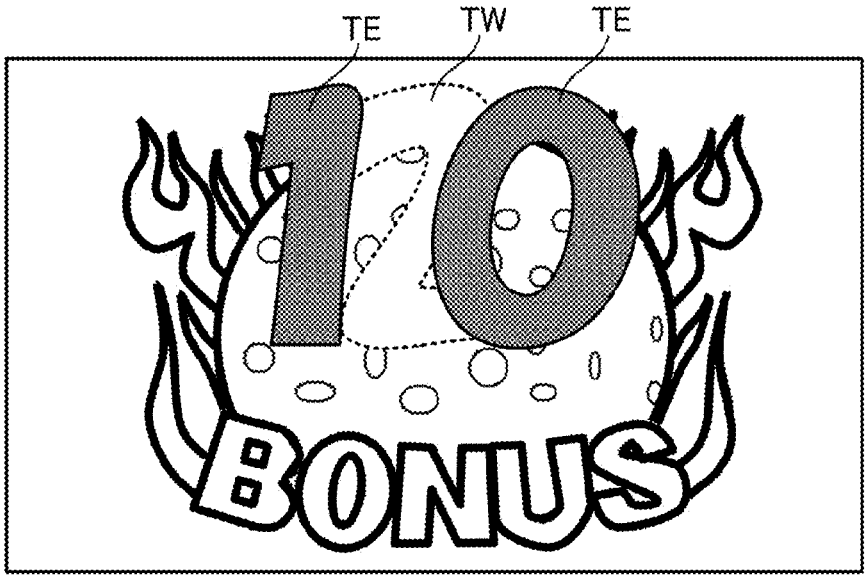
FIGS. 13A and 13B are views showing a state in which the overlapped symbol sheets are displayed.
Figure 13B:
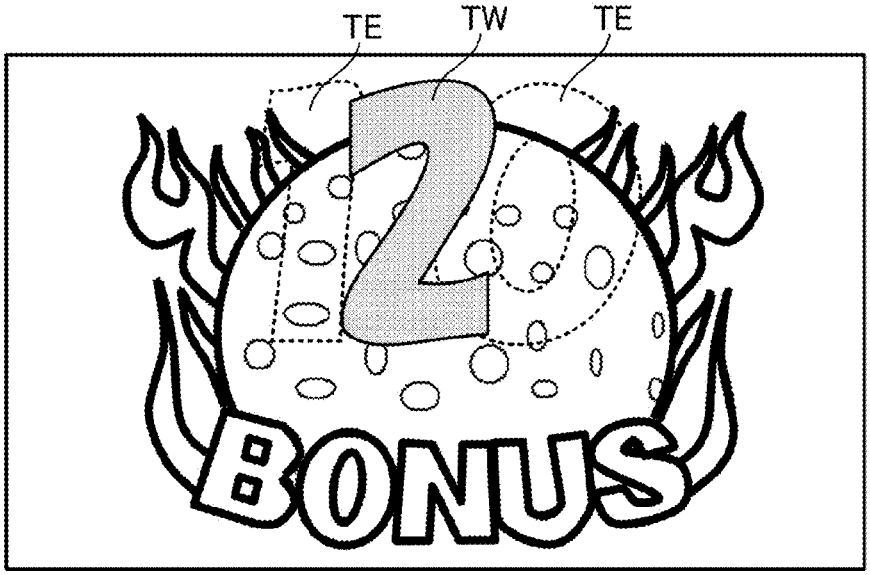

With the configuration as mentioned above, with respect to the reel band M32, as shown in FIG. 13A and FIG. 13B, the main CPU 222 controls the backlight device M7 (refer to FIG. 8) and then selects the light emitted by the backlight device M7 from green or red, whereby either of the numeric portion "2" (the numeric portion TW of the BONUS symbol M330 and the numeric portion "10" (the numeric portion TW of the BONUS symbol M326) can be selectively displayed.

FIG. 13A shows a state in which the numeric portion "10" (the numeric portion TE) of the BONUS symbol M326 is displayed in a red color by emitting red light; and FIG. 13B shows a state in which the numeric portion "2" (the numeric portion TW) of the BONUS symbol M330 is displayed in a green color by emitting green light. Switching of these displays is employed to express whether a value of a corresponding BONUS symbol is large or small in a normal game to be described later and in a free game.

In the embodiment, color arrangement and an overlapped structure of the symbol sheet M322 and symbol sheet M323 as described above is employed, and thus, in a case where red light is emitted from the inside of the reel band M32 in order to display the numeric portion "10" (the numeric portion TE) of the BONUS symbol M326, an overlap portion (green portion TWG of the BONUS symbol M330) is formed of green. Thus, although there is a possibility that the numeric portion "10" (the numeric portion TE) of the BONUS symbol M326 cannot be identified as a numeral, this numeric portion can be actually identified as shown in FIG. 13A, and a state in which the numeric portion mentioned above cannot be visually recognized is not established.

There comes into consideration the fact that one factor for this is due to adjustment of intensity of the light quantity of red light that is emitted from a backlight or a configuration of a contour portion of the numeric portion "10" (the numeric portion TE) of the BONUS symbol M326.

Therefore, with the configuration according to the embodiment, with respect to symbols that are actually visually recognized by a player, there does not occur any discoloring in the overlap portion (the green portion TWG of the BONUS symbol M330) or a state in which the numeric portion "10" (the numeric portion TE) of the BONUS symbol M326 cannot be visually recognized, and the numeric portion mentioned above can be identified as shown in FIG. 13A.

The half mirror layer M324 reflects the light emitted by the light emitting device R1 (refer to FIG. 5 to FIG. 7), and by the reflected light, images can be displayed on the reels M3*a* to M3*e*. This half mirror M324 is configured to transmit the light from the backlight device M7 and to reflect the light from the light emitting device R1 (refer to FIG. 5 to FIG. 7).

The reel band M3 may be a configuration in which a transparent restriction layer or a scattering layer is provided on a top face or a back face of a base layer M321 without being limited to the configurations shown in FIG. 10 and FIG. 11.

The transparent restriction layer is adapted to restrict an excessive transmission of light. This transparent restriction layer is formed of a white sheet having a slight transparency, for example, and in a case where the scattering layer is provided, the transparent restriction layer mentioned above is arranged between the half mirror layer M324 and the scattering layer.

The scattering layer is a sheet to scatter the light formed for a symbol, and is formed of a soft polyvinyl chloride, for example. This scattering layer may be formed of one layer or a plurality of layers.

In the reel band M3. a configuration to respectively overlap the BONUS symbols (M326 and M327) and the BONUS symbols (M330 and M331) is not limited to the configurations shown in FIG. 10 and FIG. 11, and other various configurations by which a similar advantageous effect is attained can be employed.

(Reel Assembly M11: Backlight Device M7)

Figure 6:
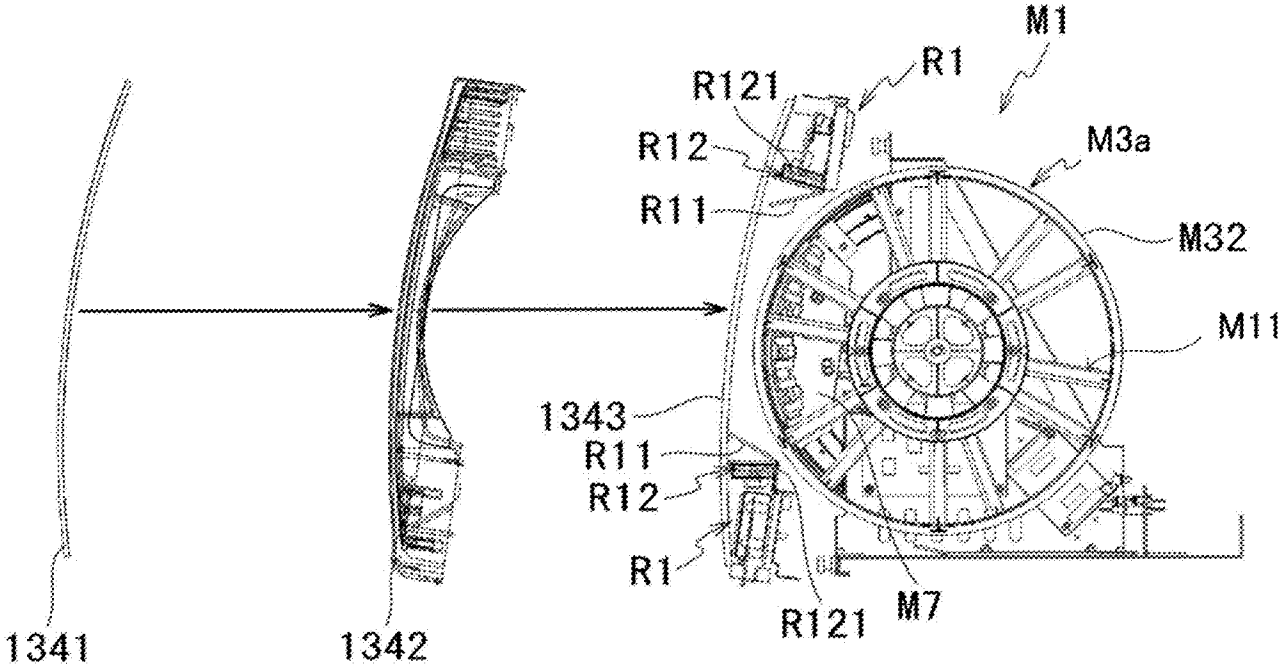
FIG. 6 is an exploded structural view of a reel unit and a reel cover.

As shown in FIG. 6, the backlight device M7 is arranged on an inner circumferential side of a respective one of the reels M3*a* to M3*e* configured as described above. The backlight device M7 is arranged to emit irradiation light from a respective one of the reels M3*a* to M3*e* in a direction of the reel band M32 so that the irradiation light having transmitted the reel band M32 can be visually recognized from the outside of the gaming machine 10. In this manner, a player can visually feel symbols as if they were displayed on the reel band M32.

Figure 8:
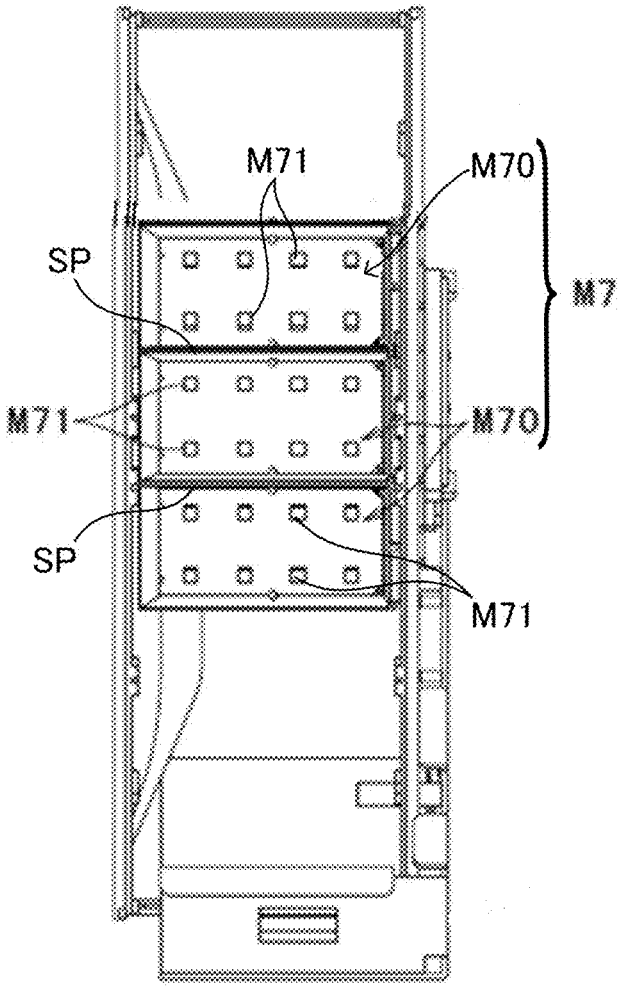
FIG. 8 is a front view showing a part of a backlight device.

The backlight device M7, although not clearly shown on the drawings, is individually provided in a respective one of the reels M3*a* to M3*e* so as to be associated with a respective one of five reels M3*a* to M3*e*. As shown in FIG. 8, the backlight device M7 is formed by unitizing a plurality of modules M70 (three in the embodiment) in which a plurality of light source devices M71 are arranged in a matrix manner. A respective one of the plurality of light source devices M71 is a full-color LED that has packed a blue LED element that is capable of emitting blue light and a green LED element that is capable of emitting green light. In a respective one of the light source devices M71, turning ON and OFF of light emissions of the red LED element, the blue LED element, and the green LED element, or alternatively, the amount of light emission at the time of turning ON is individually controlled for a respective one of the LED elements by the main CPU 222. That is, the light sources M71 can form visible light of an arbitrary color by regulating the amount of light from a respective one of the LED elements.

For example, the numeric portion "10" (the numeric portion TE) of the BONUS symbol M326 id displayed in a red color by irradiation with red light, and the numeric portion "2" (the numeric portion TW) of the BONUS symbol M330 is displayed in a green color by emission of green light; and therefore, in a respective one of the light source devices M71, a light emitting state is controlled so that in a case where TE of the BONUS symbol M326 is displayed, the red LED element is turned ON, whereas other LED elements are turned OFF, or alternatively, in a case where TW of the BONUS symbol M330 is displayed, the green LED element is turned ON, whereas the other LED elements are turned OFF.

<Light Emitting Device R1>

Figure 5:
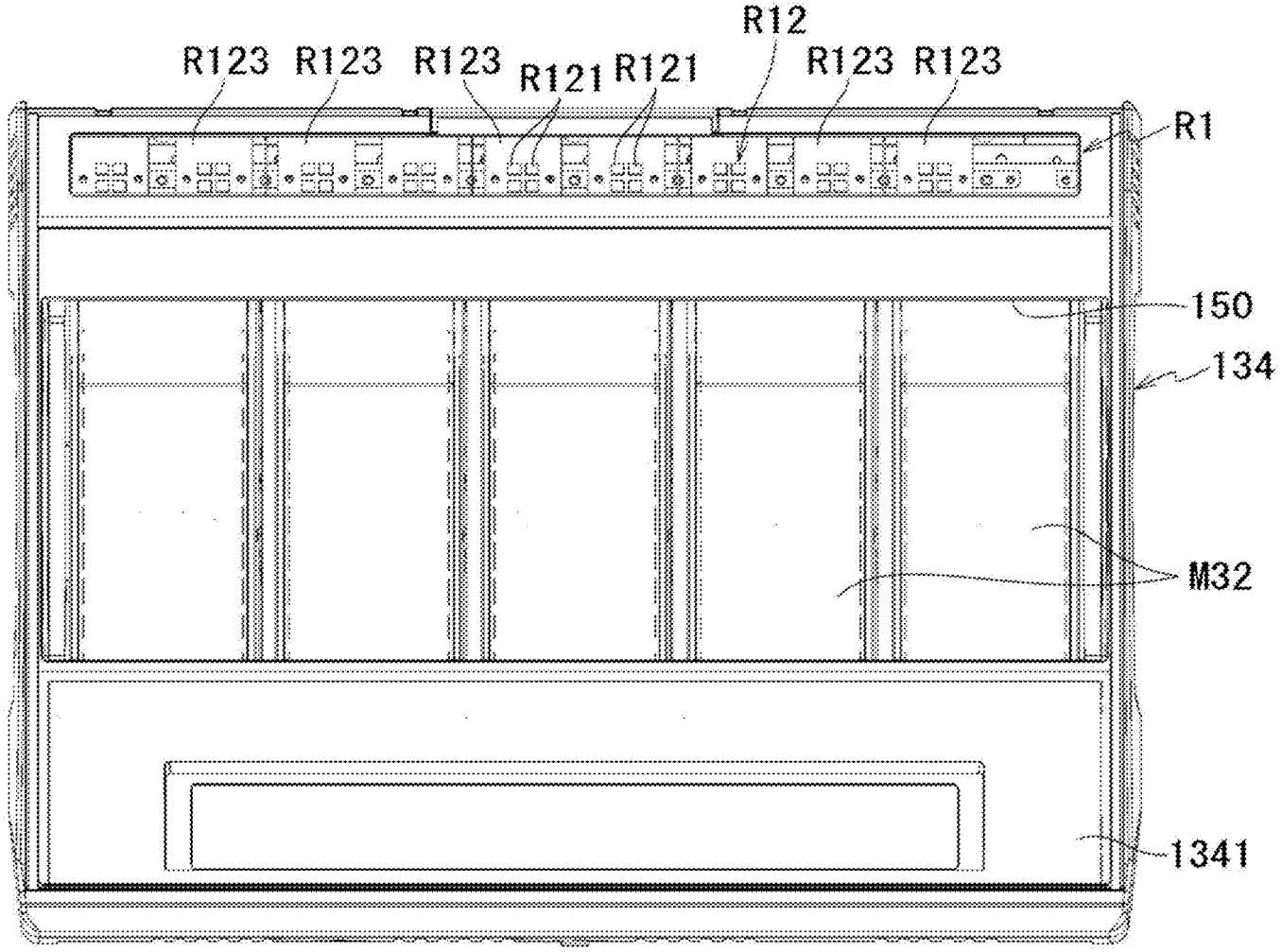
FIG. 5 is a front view of a reel cover.
Figure 7:
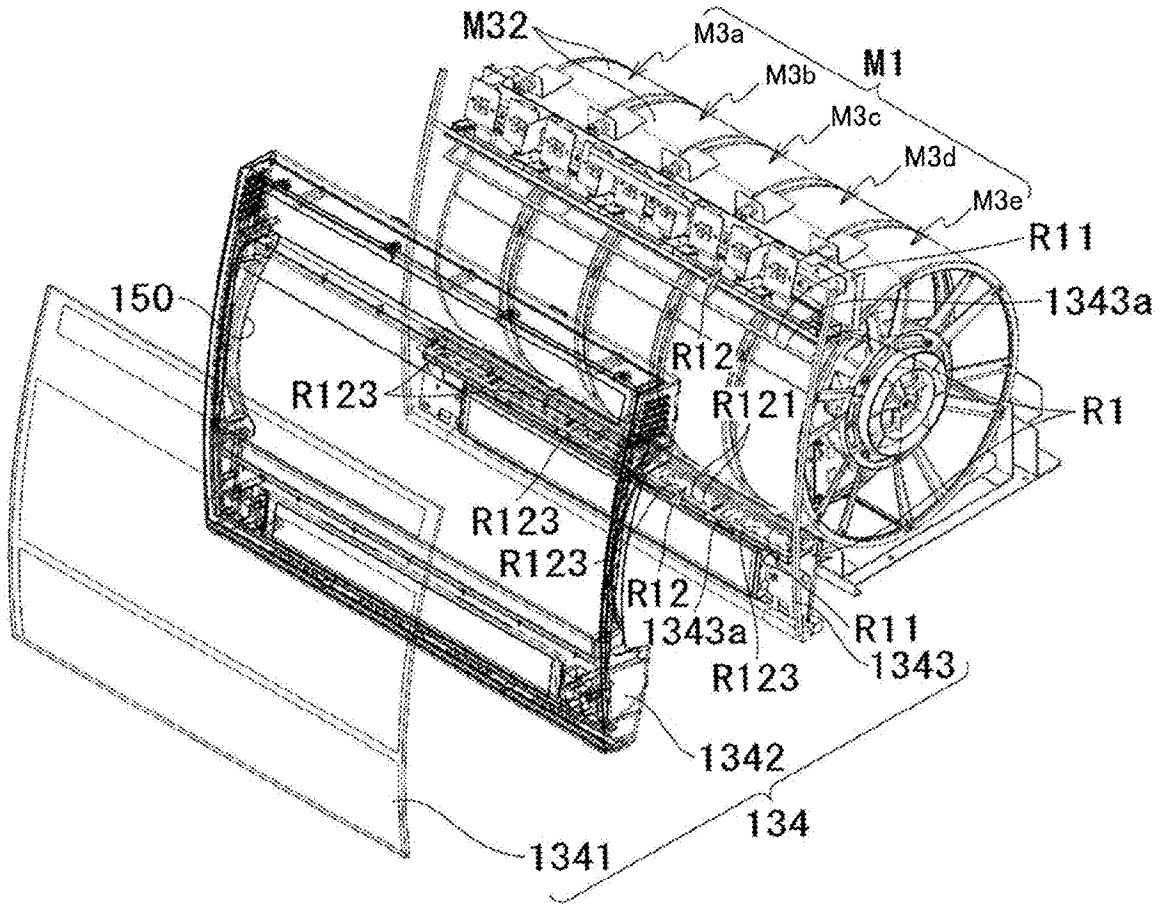
FIG. 7 is an exploded perspective view of a reel unit and a reel cover.

As shown in FIG. 5 to FIG. 7, on an outer circumferential side of the reel unit M1, the light emitting device R1 adapted to emit visible information 902 to a respective one of the reels M3*a* to M3*e* of the reel unit M1 is arranged. The light emitting device R1 is arranged at a respective one of an upper position and a lower position of the reel unit M1 including the plurality of reels M3*a* to M3*e*. In this manner, the light emitting device R1 is established in a state in which the device is arranged at a position deviating from a viewing region that is capable of visually checking the reels M3*a* to M3*e* from the outside of the cabinet 11 via the display window 150. The light emitting device R1 is capable of conducting effects in the display window 150 by reflection light of the visible light 901 that is emitted to a respective one of the reels M3*a* to M3*e* in a same manner as that in a case in which effects is conducted in the display window 150 by a transparent liquid crystal panel or a half mirror that is arranged at a front position of a respective one of the reels M3*a* to M3*e*. In this manner, the light emitting device R1 is capable of conducting effects in the display window 150 even if a space for layout of the transparent liquid crystal panel or the like is allocated in front of a respective one of the reels M3*a* to M3*e*.

The light emitting device R1 may be arranged in at least one of the upper position and the lower position of the reel unit M1. Specifically, the light emitting device R1 is arranged in an outer region of at least one of the upper position and the lower position relative to the display window 150, and may be configured so as to emit the visible light 901 that is larger than a width of all of the reels M3*a* to M3*e* supported by the reel unit M1.

Also, the light emitting device R1 is provided in a reel cover 134 serving as a front wall on the side of the display window 150. The light emitting device R1 and the reel cover 134 are unitized. In this manner, the light emitting device R1 can be mounted at the same time when the reel cover 134 is mounted to the cabinet 11.

The light emitting device R1 is set so as to emit the visible light 901 to a surface of the reel unit M1. In other words, this device is set so as to emit the visible light 901 to a region on the side of an ineffective range other than a symbol effective range.

Specifically, the light emitting device R1 has: a light transmission panel R11 (a light transmissible member) provided in the opening portion 1343*a* of the panel supporting body 1343; and a light source device R12 configured to emit the visible light 901. The light transmission panel R11 is colored so as to form the visible information 902 of a predetermined color by transmission of the visible light 901. The light transmission panel R11 has a widthwise dimension that is substantially equal to a width of the reel unit M1. Also, the light source device R12 is formed so as to emit the visible light 901 in a full width of the light transmission panel R11.

The light source device R12 has a plurality of full-color LEDs R121 whose configuration is the same as that of the light source device M71 of the backlight device M7. The full-color LEDs R121 are provided as one light source employing chips of red, green, and blue light emitting diodes adapted to emit the light beams corresponding to three primary colors of light, and the visible light 901 of an arbitrary color can be formed by regulating the amount of light from the LED of each color. These full color LEDs R121 are arranged in a matrix shape between a widthwise direction and a depth direction. Specifically, as shown in FIG. 7, the light source device R12 has LED units R123 in which a total of four full-color LEDs R121 to be arranged in two lines and two columns are arranged in two sets in a widthwise direction of the reel band M32, and are configured so that a respective one of these LED unit R123 is arranged to be associated with a respective one of the reels M3*a* to M3*e*. In this manner, a position of light emission to the reel unit M1 can be adjusted by controlling a position at which the full-color LED is turned ON.

The light source device R12 emits visible light 901 that serves as a complimentary color relative to coloring of the light transmission panel R11 and the visible light 901 other than the complimentary light in a switchable manner. Specifically, if the light transmission panel R11 is displayed in a red color, the visible light 901 of a green color that is a complimentary color of the red color and the visible light 901 of a red color other than the green color are emitted in a switchable manner. In this manner, the light emitting device R1 enables the visible information 902 to be actively displayed or inactively displayed on the reels M3*a* to M3*e* by switching the visible light 901 of the complimentary color and the visible light 901 of the color other than the complimentary color.

Although the light source device R12 in the embodiment is capable of easily forming the visible light 901 of a complimentary color and the visible light 901 other than the complimentary color with the use of one full-color LED, this device is not limited to such a full-color LED, and may be formed of a single-color LED adapted to output the visible light 901 of a complimentary color and a single-color LED adapted to output the visible light 901 of a color other than the complimentary color.

[Electrical Configuration of Slot Machine]

Figure 14:
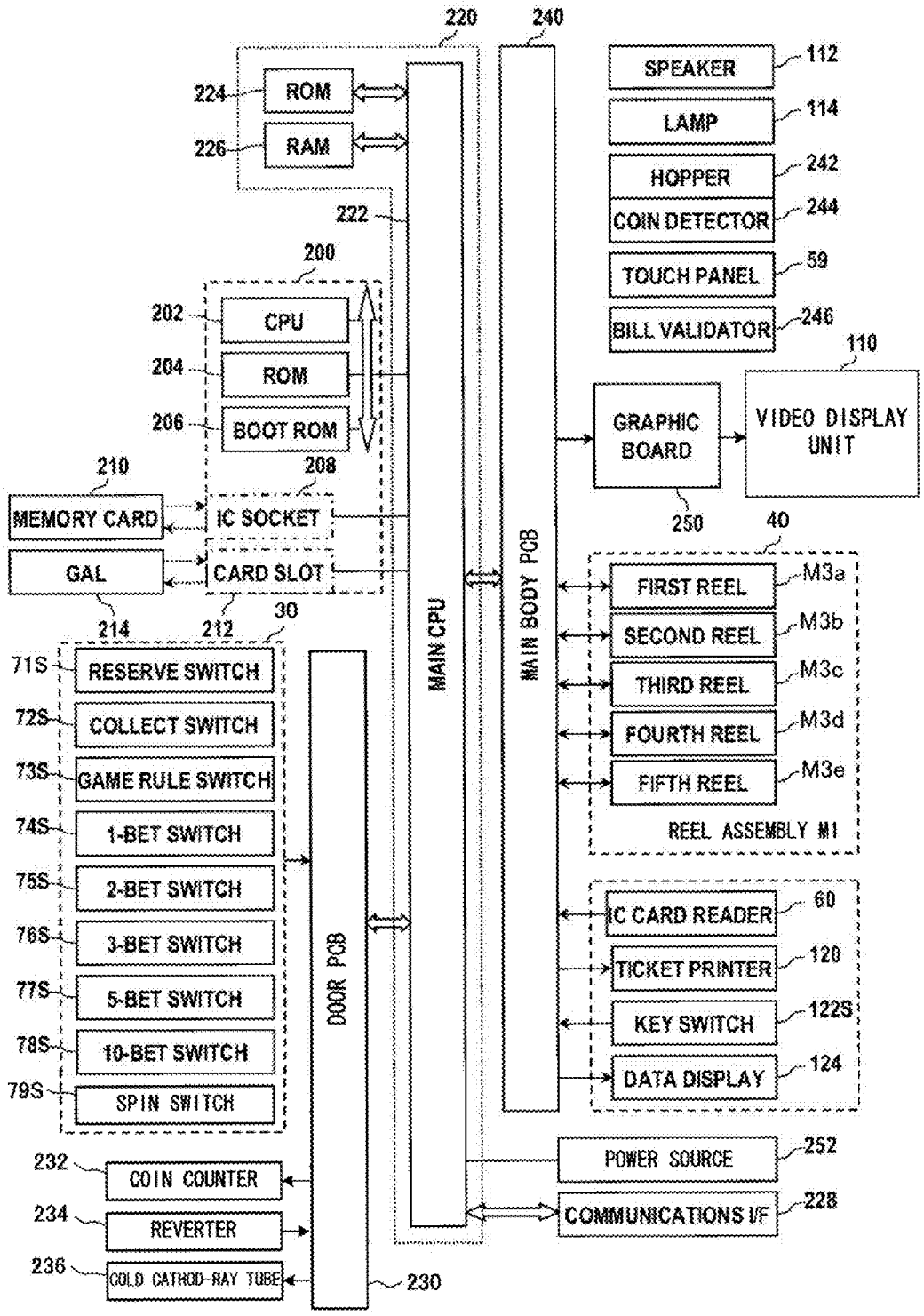
FIG. 14 is an electrical block diagram of a gaming machine.

FIG. 14 is an electrical block diagram of the gaming machine 10 shown in FIG. 3. The gaming machine 10 includes a game board 200, a motherboard 220, a door PCB 230, and a main body PCB 240.

The game board 200 includes: a CPU 202; a ROM 204 that can be accessed from the CPU 202 via an internal bus; and a boot ROM 206 that can be accessed from the CPU 202 via the internal bus. The game board 200 includes: an IC socket 208 that is capable of housing a memory card 210 and communicating with the memory card 210; and a card slot 212 that is provided in correspondence with a general-purpose array logic (GAL) 214.

The memory card 210 includes a nonvolatile memory, and stores a game program and game system program.

The IC socket 208 is configured so that the memory card 210 can be removably mounted. The IC socket 208 is connected to the motherboard 220 by an IDE bus. A game executed by the gaming machine 10 can be changed by replacing the memory card 210 with another card. Also, the game executed by the gaming machine 10 can be changed by pulling out the memory card 210 from the IC socket 208, writing another program into the memory card 210, and reinserting the memory card 210 into the IC socket 208.

The GAL 214 is a kind of programmable logic device (PLD) having an OR-fixed arrayed structure, and has a plurality of input ports and output ports. The GAL 214 outputs data corresponding to input data via an output port upon receipt of predetermined data via an input port.

The card slot 212 is configured so that the GAL 214 can be inserted into the card slot 212 or can be removed from the card slot 212, and is connected to the motherboard 220 by a PCI bus.

The CPU 202, the ROM 204, and the boot ROM 206 that are interconnected by an internal bus are connected to the motherboard 220 by the PCI bus. The PCI bus enables transmission of a signal between the motherboard 220 and the game board 200, and can supply power from the motherboard 220 to the game board 200.

The ROM 204 stores one or more programs. The boot ROM 206 stores a preliminary authentication program and boot codes or the like, all of which are employed by the CPU 202, for starting up the preliminary authentication program. The authentication program is a tempering check program for authenticating that the game program and the game system program each are authentic. The preliminary authentication program is a program for authenticating that the authentication program is authentic. The authentication program and the preliminary authentication program are written in such a processing operation relevant to certificate that a targeted program is not tempered.

As the motherboard 220, a generally available mainboard is employed, and the motherboard 220 executes the game program and the game system program. The motherboard 220 includes a main CPU 222, a ROM 224, a RAM 226, and a communication interface 228.

The ROM 224 is a memory device for storing programs that are executed by the main CPU 222, and as in a BIOS, the program is permanently held together with another item of data. The ROM 224 may be a flash memory. The BIOS program initializes peripheral devices when the program is executed by the main CPU 222. Also, the BIOS program loads the game program and the game system program that are stored in the memory card 210, via the game board 200. The ROM 224 may be rewritable. Alternatively, a write-protected storage medium may be used as the ROM 224.

The RAM 226 stores data or programs used during operation of the main CPU 222. For example, when the game program, the game system program, or the authentication program is loaded, such a program can be stored in the RAM 226. The RAM 226 has a workspace for executing programs. For example, in the workspace, the number of bets, the amount of payout, or the amount of credits or the like is stored, and is held while a game is executed. Symbols, symbol codes, winning combinations, and a plurality of tables defining probabilities thereof are also held while the game is executed. Further, the RAM 226 stores a symbol determination table, a BONUS symbol value determination table, a payout table and a roulette payout table, or the like. The symbol determination table stores mapping information between symbol codes and random numbers employed to determine symbols based on the random numbers. In particular, the RAM 226 holds a mode frag and a game counter. The mode flag is a flag indicating a game mode. The game counter counts a value indicating the number of unit games that has been already executed or the remaining number of unit games.

Also, the RAM 226 stores the count values of a plurality of counters. The plurality of counters are inclusive of a bet counter, a number-of-payouts counter 321, a number-of-credits counter 320, a number-of-free-games counter 324, and the number of BETs counter 325. In addition, some of the count values may be held in an internal register of the main CPU 222.

The main CPU 222 communicates with an external controller via the communication interface 228. For example, the external controller includes a server (an external control device 190) or the like connected via a communication path, as shown in FIG. 2.

The motherboard 220 is connected to the door PCB 230 and the main body PCB 240. The motherboard 220 can communicate with the door PCB 230 and the main body PCB 240 via a USB. The motherboard 220 is connected to a power source 252. The main CPU 222 of the motherboard 220 is started up and executed by employing the power supplied from the power source 252. The motherboard 220 routes a part of the power to the game board 200 via the PCI bus in order to start up the CPU 202. The door PCB 230 and the main body PCB 240 are connected to input devices. The input devices are inclusive of switches or sensors or peripheral devices or the like, operations of which are controlled by the main CPU 222. The door PCB 230 is connected to a control panel 30, a coin counter 232, a reverter 234, and a cold cathode-ray tube 236.

The control panel 30 has a RESERVE switch 71S, a COLLECT switch 72S, a GAME RULES switch 73S, a 1-BET switch 74S, a 2-BET switch 75S, a 3-BET switch 76S, a 5-BET switch 77S, a 10-BET switch 78S, a spin button (START switch) 79S that are provided in correspondence with a respective one of a variety of buttons 71 to 79. A respective one of the switches 71S to 79S detects that it is pressed by a player, and outputs a signal to the main CPU 222.

The coin counter 232 and the reverter 234 are provided in a coin entry device 80. The coin counter 232 determines whether or not a coin entered into the coin entry device 80 is authentic, based on features such as a material for or a shape of the coin. In a case where an authentic coin is detected, the coin counter 232 outputs a signal to the main CPU 222. A coin which is not determined to be authentic is ejected to the coin tray 92. The reverter 234 operates based on a control signal from the main CPU 222. The reverter 234 supplies the coin that is determined to be authentic by the coin counter 232 to either a hopper 242 or a cashbox (not shown). In a case where the hopper 242 is not filled with coins, such coins are guided to the hopper 242. On the other hand, in a case where the hopper 242 is filled with coins, such coins are guided to the cashbox.

The cold cathode-ray tube 236 is provided on a rear face of the video display unit 110 (the upper image display panel 131). The cold cathode-ray tube 236 functions as a backlight, or alternatively, illuminates based on a control signal from the main CPU 222.

The main body PCB 240 is connected to a speaker 112, a lamp 114, a hopper 242, coin detector 244, a touch panel 59, a bill validator 246, a reel assembly M11, an IC card reader 60, a graphic board 250, a ticket printer 120, a key switch 122S, or a data display 124.

The lamp 114 turns ON or OFF based on a control signal from the main CPU 222. The speaker 112 outputs a sound such as background music (BGM) based on a control signal from the main CPU 222.

The hopper 242 operates based on a control signal from the main CPU 222, and pays out coins in the specified amount of payouts to the coin tray 92 via a payout exit (not shown) of coins formed between a lower glass 90 and the coin tray 92. The coin detector 244 detects the coins that are paid out from the hopper 242, and outputs a detection signal to the main CPU 222.

The touch panel 59 detects a position touched by a player, and supplies a position detection signal according to the detected position to the main CPU 222. The bill validator 246 provided in a bill entry device 82 supplies a bill detection signal corresponding to the amount of bill to the main CPU 222 when an authentic bill is detected.

The graphic board 250 controls a video display unit 110 and a display panel 58 of a symbol display unit 40 in accordance with a control signal from the main CPU 222. The graphic board 250 includes: a video display processor (VDP) adapted to generate video data; and a video RAM adapted to temporality store video data. The video data is generated from the game program that is stored in the RAM 226.

The IC card reader 60 reads out data that is stored in an IC card inserted into the IC socket 208, and supplies the readout data to the main CPU 222. The IC card reader 60 writes data supplied to the main CPU 222 into an ID card.

In order to output a barcode ticket, the ticket printer 120 prints, in the ticket, a barcode including the contents of the number-of-credits counter 320 that is stored in the RAM 226, date or time, and the identification number of the gaming machine 10, in accordance with a control signal from the main CPU 222.

The key switch 122S is provided on a back side of the keypad 122, and when the keypad 122 is pressed by a player, a key detection signal is output to the main CPU 222.

The data display 124 displays information relevant to information input via the keypad 122, in accordance with a control signal from the main CPU 222.

The main body PCB 240 is electrically connected to the reel assembly M11. The reel assembly M11 includes the first to fifth reels M3*a* to M3*e* as described above.

Figure 15:
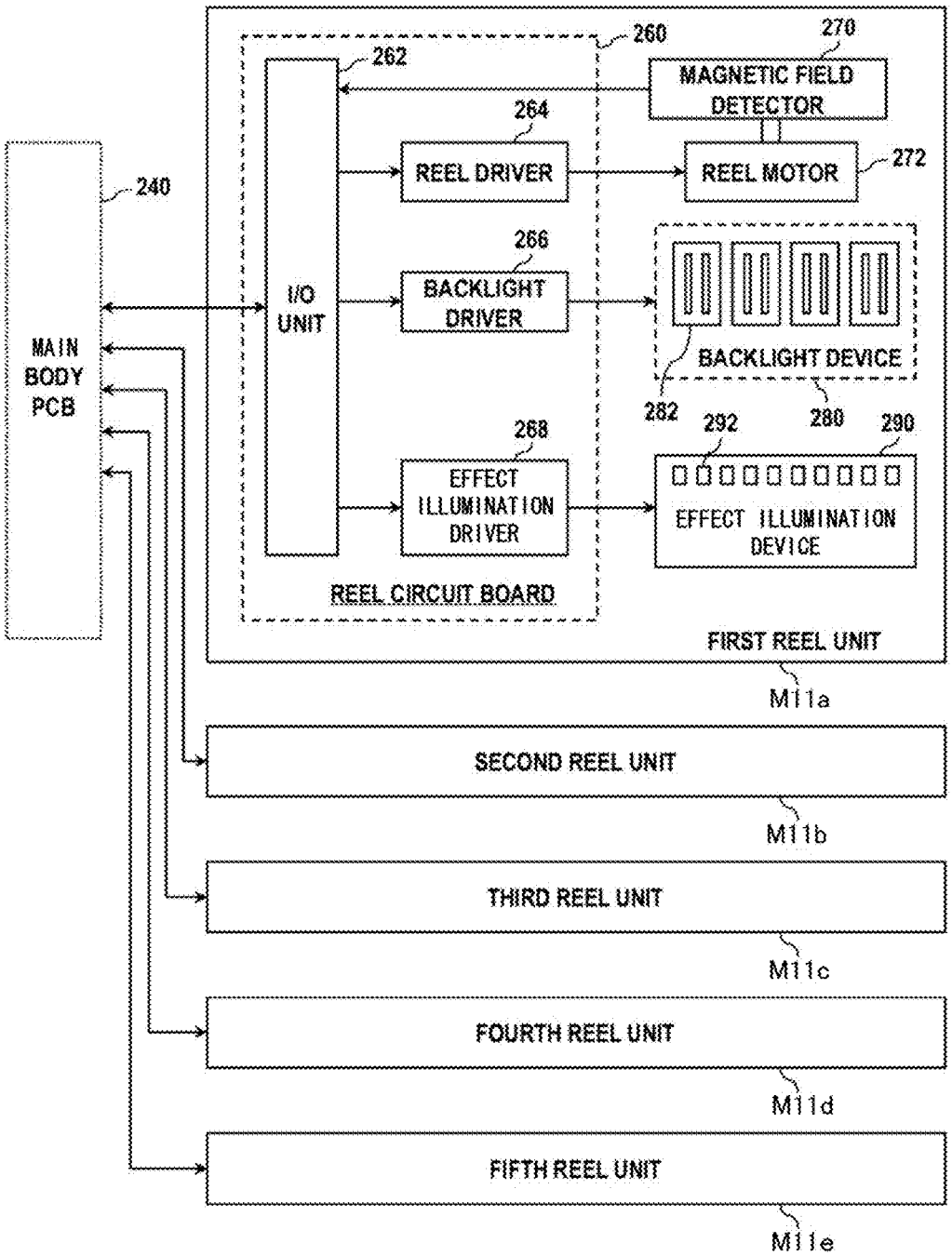
FIG. 15 is a block diagram showing an electric circuit of a reel assembly.

FIG. 15 is a block diagram of an electric circuit of the reel assembly M11. A respective one of the reels M3*a* to M3*e* is provided on a reel spinning board substrate 260. The reel spinning board substrate 260 includes: an input/output (I/O) unit 262 that can communicate with the main body PCB 240; a reel diver 264 that is connected to the I/O unit 262; a backlight driver 266; and an effect illumination driver 268.

The I/O unit 262 is connected to a magnetic field detector 270. The magnetic field detector 270 includes: a magnetic sensor adapted to detect an intensity of a magnetic field and then output a magnetic detection signal that is proportional to the intensity of the magnetic field; and a sensor fixing portion for fixing the magnetic sensor at a predetermined position. The magnetic sensor detects the intensity of the magnetic field that is generated by a magnet. The magnet is provided on a rotary shaft of a reel motor 272, and rotates with a reel 52A.

The reel driver 264 supplies power to the reel motor 272. The backlight driver 266 individually supplies power to a respective one of light sources 282 of the backlight device M7. The effect illumination driver 268 individually supplies power to a respective one of light sources 292 of an effect illumination device 290.

The second to fifth reels M3*b* to M3*e* have a same configuration as that of the first reel M3*a*, and a detailed description thereof is omitted.

[Functions of Game Program]

Figure 16:
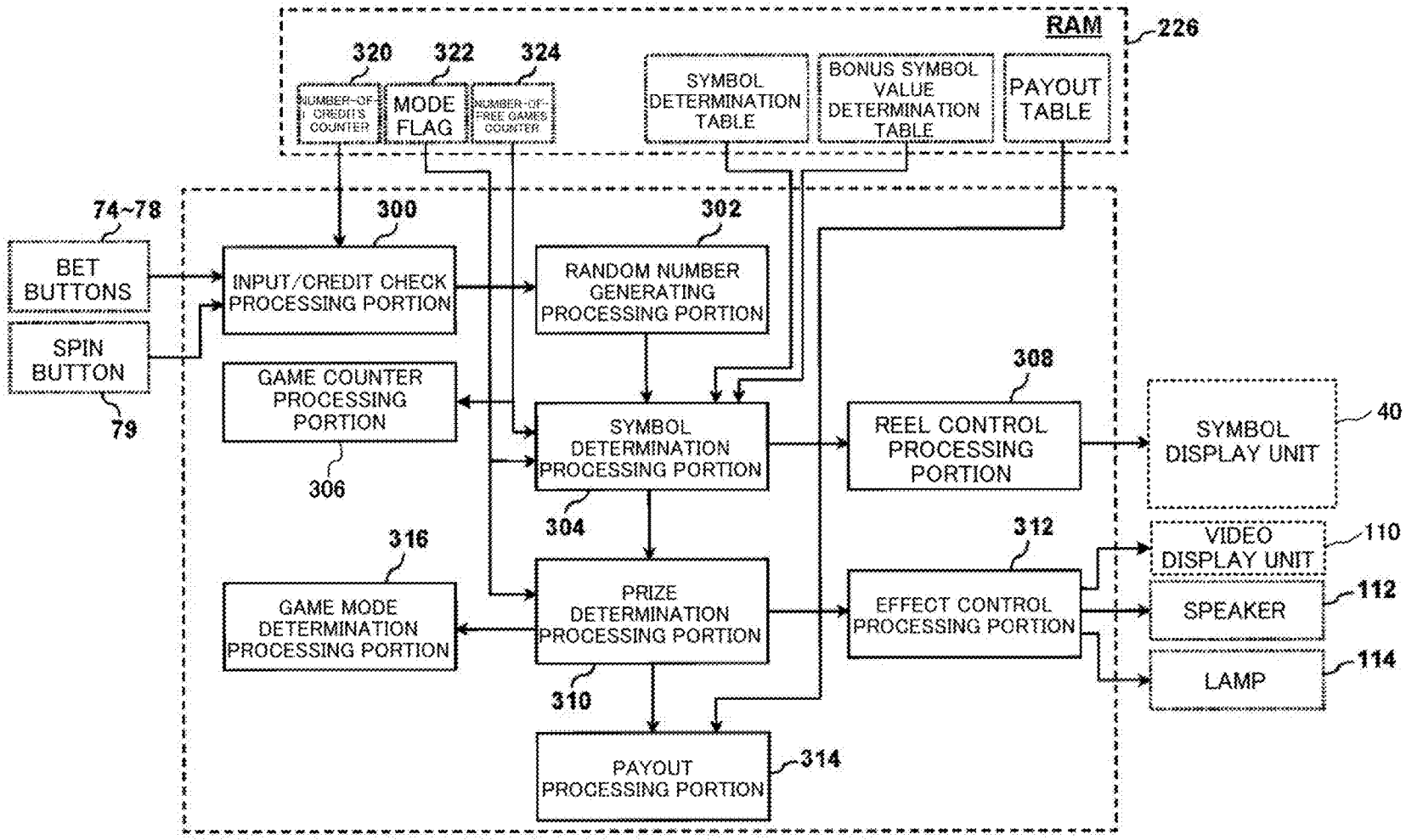
FIG. 16 is a block diagram showing a processing operation of a game program to be executed by a main CPU on a motherboard.

FIG. 16 is a functional block diagram showing functions of the game programs executed in the main CPU 222 of the motherboard 220. When power is supplied to the gaming machine 10, the main CPU 222 reads the authenticated game program and game system program from the memory card 210 via the game board 200, and writes these programs into the RAM 226. The game program is executed in a state in which the program is thus loaded in the RAM 226.

According to the preferable embodiment, the game program includes: an input/credit check processing portion 300; a random number production processing portion 302; a symbol determination processing portion 304; a game counter processing portion 306; a reel control processing portion 308; a prize determination processing portion 310; an effect control processing portion 312; a payout processing portion 314; and a game mode determination processing portion 316.

The input/credit check processing portion 300 continuously checks whether either any one of the BET switches 74 to 78 or the SPIN button 79 is pressed in an idle state in which spinning of the reels M3*a* to M3*e* stops. In a case where either any one of the BET switches 74 to 78 or the SPIN button 79 are pressed, the input/credit check processing portion 300 checks whether or not any credit of a player remains based on the number-of-credits counter 320 that is stored in the RAM 226. In a case where at least one credit of the player remains, the input/credit check processing 300 invokes the random number production processing portion 302.

Afterwards, the random number production processing portion 302 generates random numbers, and the symbol determination processing portion 304 uses these random numbers. In the embodiment, the random number production processing portion 302 generates five random numbers. A respective one of the five random numbers is employed in a respective one of the first to fifth reels M3*a* to M3*e*. Also, random numbers for determining values of BONUS symbols are also generated.

After all of the five random numbers have been extracted the symbol determination processing portion 304 determines to-be-stopped symbols in a respective one of the reels M3*a* to M3*e* by referring to the symbol determination table stored in the RAM 226. The symbol determination processing portion 304 determines five to-be-stopped symbols on a plurality of scroll lines (such as the five reels M3*a* to M3*e*, for example) by employing the five random numbers, and generates symbols associated with a respective one of the plurality of scroll lines (such as the five reels M3*a* to M3*e*, for example) in the display window 150 of the symbol display unit 40. Also, after random numbers for determining the values of BONUS symbols have been extracted, the symbol determination processing portion 304 determines the values of the BONUS symbols by referring to the BONUS symbol value determination table that is stored in the RAM 226. Further, after random numbers for determining the values of the roulette have been extracted, a winning roulette display region is determined by referring to the roulette payout table that is stored in the RAM 226.

The reel control processing portion 308 controls a reel assembly M11 by supplying stop position information according to the determined symbols. By doing this, the reels M3*a* to M3*e* are spun, and subsequently, the spun reels are stopped at positions that are specified according to the stop position information. That is, symbols scroll with spinning of the reels M3*a* to M3*e*. Next, the reels M3*a* to M3*e* are stopped so that the determined symbols are rearranged at central positions in a vertical direction in the display window 150 of the symbol display unit 40. Also, by controlling the backlight device M7, predetermined numerals are displayed on the BONUS symbols.

The prize determination processing portion 310 determines whether or not a predetermined winning combination is established according to the rearranged symbols. In a case where the winning combination is established according to the rearranged symbols, the effect control processing portion 312 controls the symbol display unit 40 and other devices in accordance with the winning combination and a game mode. As other devices, a speaker 112, a lamp 114, and a video display unit 110 or the like are included. As an effect, an effect by video and audio or an effect by backlight change or illumination is included. Also, the payout processing portion 314 determines the amount of payout in accordance with the established winning combination, and the amount of payout is awarded to a player.

In addition, every time a unit game completes, the game mode determination processing portion 316 determines a game mode of a next unit game. In a case where a feature game trigger is established according to the rearranged symbols, the game mode determination processing portion 316 changes a normal mode to the feature game mode, and in a case where a player further select a game, the current mode is changed to a free game mode or a roulette game mode according to the selection. In a case where a condition for completing a free game has been met, the game mode determination processing portion 316 changes the free game mode to the normal mode. In another case, the game mode determination processing portion 316 maintains an immediately preceding game mode. The game mode determination processing portion 316 may be run the prize determination processing portion 310.

The game counter processing portion 306 sets the number of free games in accordance with a winning combination in the prize determination processing portion 310, and manages the number-of-free-games counter 324 to subtract the count on a one by one basis every time a free game is executed. In a case where a predetermined winning combination is established in the free game mode, the number of times relevant to the winning combination is added to the number-of-free-games counter 324 in which the remaining number of free games is stored. The value of the number-of-free-games counter 324 is stored in the RAM 226. The game counter processing portion 306 may belong to the symbol determination processing portion 304.

(Payline)

FIG. 17 is a view showing an example of a payline definition table defining paylines employed in the gaming machine 10. In the gaming machine 10, 30 paylines are set for symbol matrixes. The payline definition table indicates that any of the first to third lines respectively constitute a payline with respect to the first to fifth reels M3*a* to M3*e*.

For example, this table indicates that a second line of the first reel M3*a* (a first column), a second line of the second reel M3*b* (a second column), a second line of the third reel M3*c* (a third column), a second line of the fourth reel M3*d* (a fourth column), and a second line of the fifth reel M3*e* (a fifth column) constitute one payline (a payline of (No.=1)).

A respective one of the paylines can be activated according to a player's selection. However, all of the 30 paylines can be activated regardless of whatsoever the amount of bets or the player's selection may be. A total number of paylines can be changed according to a symbol matrix size, and another payline can be appropriately set.

(Symbol Determination Table)

FIG. 18 is a view showing an example of a symbol determination table.

In this example, the symbol determination table is shown as a table defining the symbols in the first to fifth reels M3*a* to M3*e*, symbol arrangement, and probabilities that the respective symbols appear. The symbol determination table specifies probabilities that the symbols on a respective one of the reels appear on a predetermined line of the symbol matrixes (for example, a second line).

In this symbol determination table weights appearing on a predetermined line are associated with the respective symbols of a respective one of the reels, whereby the probabilities that the symbols appear are specified. For example, with respect to a BONUS symbol of code number=00 on the first reel M3*a*, the weight is set to"4", and the appearance probability is set to 4/81 (although the number 81 on the bottom line is a total weight, this bottom line is merely indicated for the sake of convenience, and does not need to be included in the symbol determination table).

(Payout Table)

FIG. 19 is a view showing an example of a payout table.

The payout table briefly shows a relationship between winning combinations and the respective payments. This table shows how much a corresponding payment is in a case where any combination of symbols is displayed on the first to fifth reels M3*a* to M3*e* in a defined payline. In a case where a part of a symbol combination may be any symbol, it is defined as (ANY). Although (ANY) symbols are set on the forth reel and the fifth reel for the sake of convenience, in the embodiment in a case where the (ANY) symbols are respectively displayed on the fourth reel and the fifth reel, the fact denotes that any two may be arbitrary symbols among the first to fifth reels M3*a* to M3*e*, and in a case where an (ANY) symbol is displayed on only the fifth reel, the fact denotes that any one of the first to fifth reels may be an arbitrary symbol.

Also, when a "RED7/BLUE7" symbol or a "1BAR/3BAR" symbol is displayed, the fact indicates that a condition is met in a case where either one of these symbols is displayed. Further, in the embodiment, although BONUS symbols can be displayed on the first to fifth reels M3*a* to M3*e*, the winning combinations and payments that are associated with these symbols will be described later, since their related determination method is different from that for the winning combinations mentioned above.

In a case where a WILD symbol is displayed, the thus displayed symbol is evaluated as a substitute symbol other than BONUS symbols (a so called WILD card). For example, in a case where four RED7 symbols and one WILD symbol are displayed on a payline across the first to fifth reels M3*a* to M3*e*, it is determined that a player has won a winning combination "RED7" of a payment=1000.

In the gaming machine 10, the prize determination processing portion 310 refers to the payout table every time a unit game is executed, and determine whether or not a winning combination is established on a payline. In a case where a winning combination defined in the payout table is included in one of the paylines, the prize determination processing portion 310 detects the winning combination, and checks a payment by referring to the payout table. Also, the prize determination processing portion 310 determines whether or not a player has won a predetermined winning combination with respect to BONUS symbols as well, as described later.

The payout processing portion 314 pays out the determined amount of payout. On the other hand, in a case where it is determined that a winning combination is not established by the symbols that have appeared on a payline, the prize determination processing portion 310 determines the fact as a so called "losing". The profit by payout is awarded to a player by paying coins to the coin tray 92, or alternatively, adding credits of the payout equivalent amount.

Although only one payout table is shown in FIG. 19, a payout table may be individually provided with respect to the normal game, the feature game, or the free game or the like.

<Game State Transition>

Figure 20:
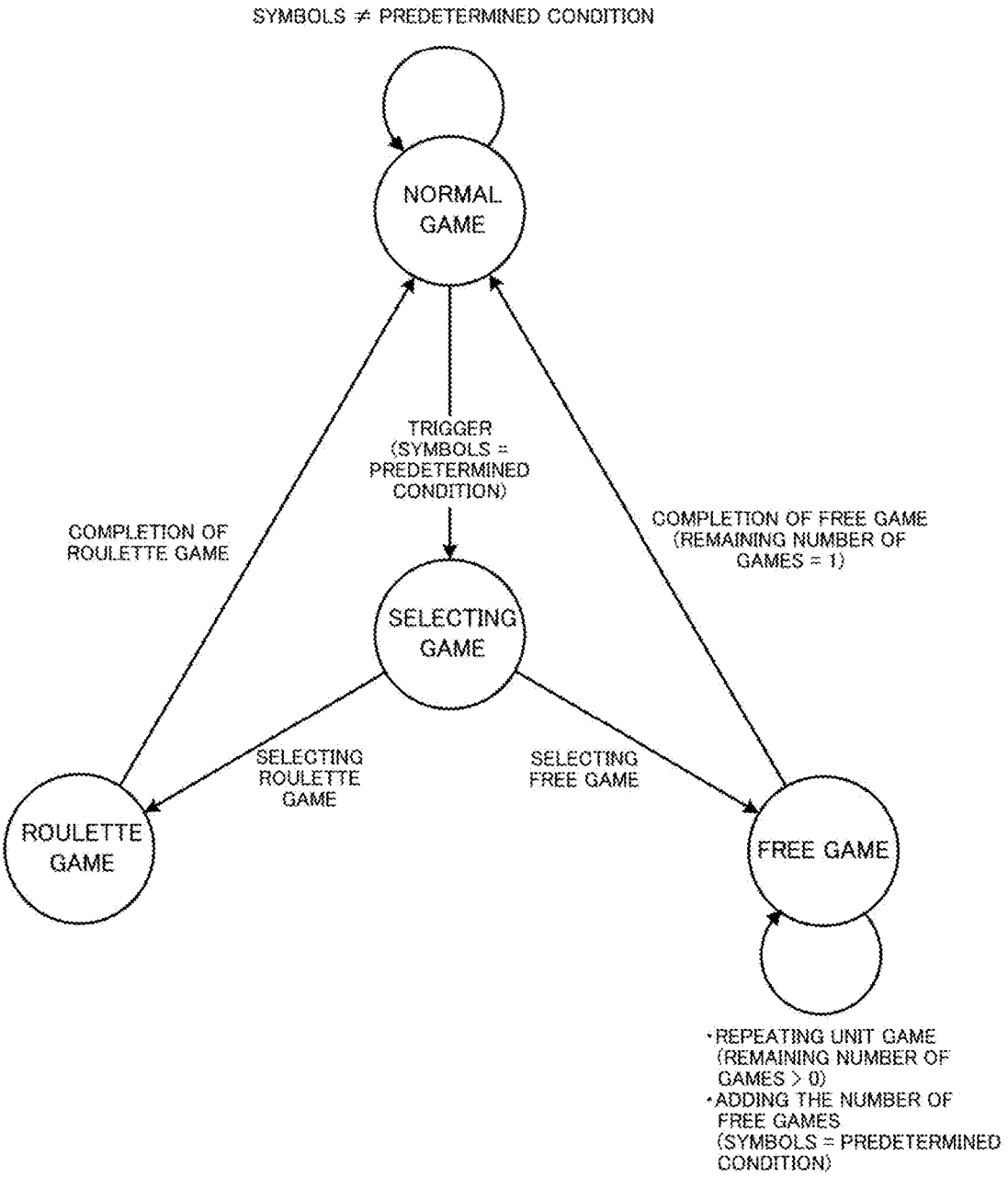
FIG. 20 is a view showing a state transition in a gaming machine.

FIG. 20 is a vie showing a pattern of state transition in the gaming machine 10.

The gaming machine 10 executes a normal game and two kinds of games including a feature game. The feature games are inclusive of a free game and a roulette game, and a player can select one of these two games. In the gaming machine 10, the normal game is mainly executed, and when a trigger (an event) is established in the normal game, the routine transfers to the feature game.

In the embodiment, a trigger is set on condition that BONUS symbols are rearranged in a predetermined positional relationship in the display window 150 of the symbol display unit 40. Of course, the trigger may be set in another condition.

As can be understood from FIG. 20, in the normal game, a unit game is repeated until the BONUS symbols have been rearranged in the predetermined positional relationship in the display window 150 of the symbol display unit 40. In this normal game, if a combination of the symbols rearranged on a payline coincides with a winning combination shown in the payout table, the number of payouts according to the payment of that combination is paid out.

If a trigger occurs in the normal game, a selection screen is displayed on the video display unit 110. The selection screen is adapted to select either the free game or the roulette game. When a player select either one game by operating any one of the BET switch 74 to 78 and the spin button 79 or the like, the selected game is started.

Although the free game is a game in which a unit game similar to the normal game is repeatedly played without consuming gaming mediums such as medals, the number of free games is increased by displaying a specific symbol, and if the remaining number of free games is obtained as "0" (that is, the number-of-free-games counter 324=0), the game completes, and the routine reverts to the normal game.

The number of free games at the time of start of free game is determined according to a display mode when the BONUS symbols are rearranged in the predetermined positional relationship in the symbol display unit 40 in the normal game. In addition, in the free game, if the BONUS symbols are rearranged in the predetermined positional relationship in the symbol display unit 40, the number of free games is further determined according to the display mode, and the determined number is added to the number of free games remaining at that time point. Thus, the free games are configured according to a different number of games every time, diversified variations are imparted to bonus games, enabling a player to feel a sense of expectation or interest every time a free game is played.

The roulette game is a kind of game in which: a roulette board is displayed on the video display unit 110 in such a manner that a plurality of display regions are arranged in a circumferential manner; the payment corresponding to a respective one of the display regions is determined based on the number of free games obtained above and then a winning display region by a lottery is determined; and the number of payouts is paid out based on the payment according to the display region. If one lottery is conducted and then payout completes, the game completes, and the routine reverts to the normal game.

As described above, in the gaming machine according to the present invention, a player can select whether to play a free game or to play a roulette game as a bonus game. In a general case, the roulette game is shorter than the free game in terms of game playing time, and thus, in a case where the player wants to return to the normal game earlier or in a game where the player does not have enough time to play a game, etc., the player can complete the bonus game earlier by selecting the roulette game. The expectation values relevant to the number of payouts in both of the games are equally set as described later, and thus, even if the player selects either one of the games, the player does not suffer from any disadvantage relevant to the number of payouts.

[Contents of Programs]

Next, with reference to FIG. 21 to FIG. 25, programs executed by the gaming machine 10 will be described.

(Main Control Processing)

First, with reference to FIG. 21, main control processing will be described.

Figure 21:
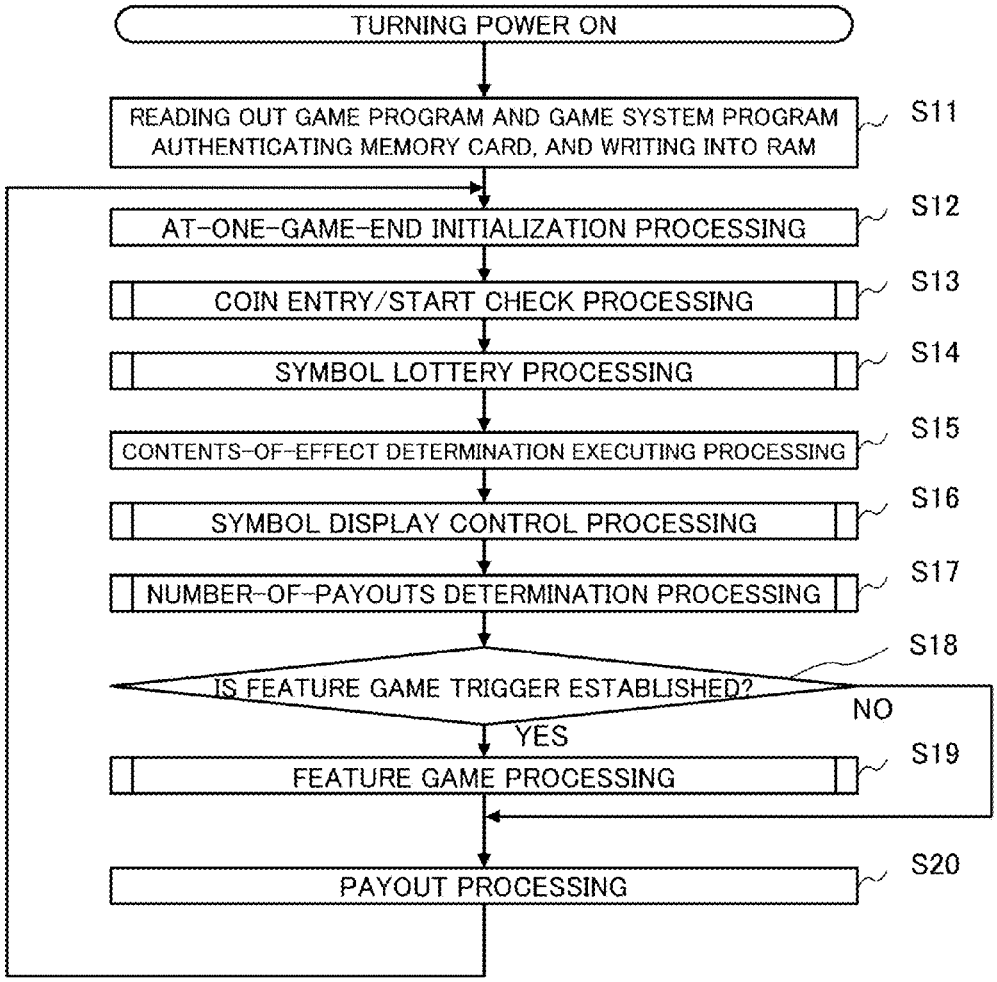
FIG. 21 is a flowchart of main control processing in a gaming machine.

FIG. 21 is a flowchart of the main control processing in the gaming machine 10 according to an embodiment of the present invention.

First, when power is supplied to the gaming machine 10, the main CPU 222 reads out the game program and game system program authenticated from the memory card 210 via the game board 200, and writes the readout programs into the RAM 226 (step S11).

Next, the main CPU 222 conducts at-one-game-end initialization processing (step S12). For example, unnecessary data is cleared every time one game is played in a working area of the RAM 226 such as the number of BETs or the symbols determined by a lottery.

Figure 22:
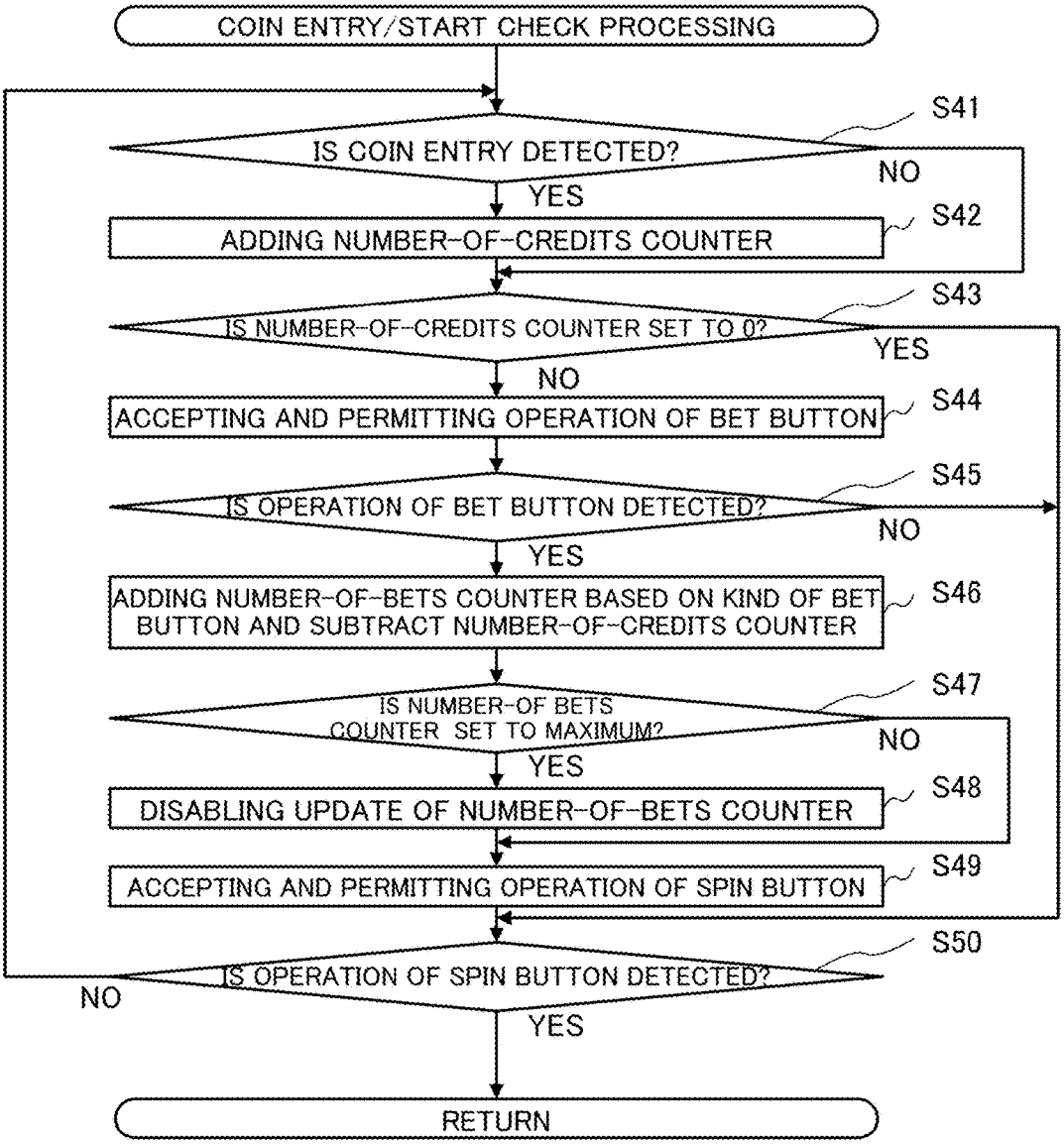
FIG. 22 is a flowchart of coin entry/start check processing in a gaming machine.

Next, the main CPU 222 conducts coin entry/start check processing to be described later with reference to FIG. 22 (step S13). In this processing, input check of the BET button and spin button or the like is conducted.

Figure 23:
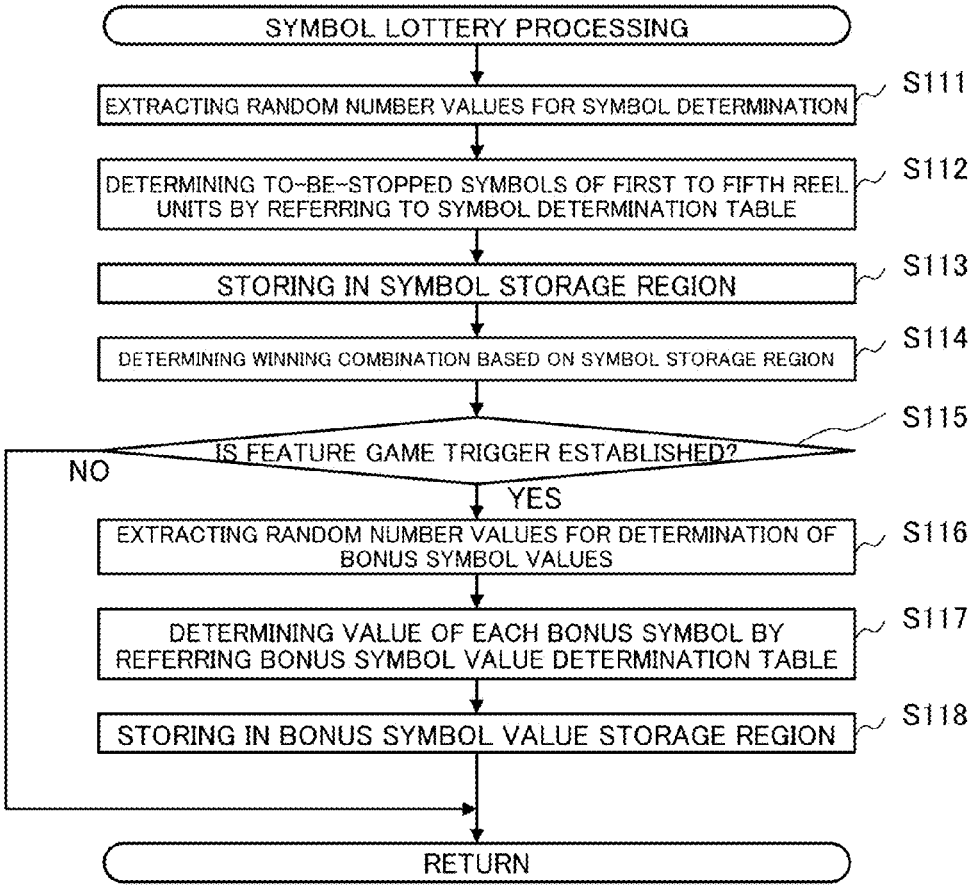
FIG. 23 is a flowchart of symbol lottery processing in a gaming machine.

Next, the main CPU 222 conducts symbol lottery processing to be described later with reference to FIG. 23 (step S14). In this processing, determination of to-be-stopped symbols based on random number values for determination of symbols is conducted, and in a case where a feature game trigger is established, the values of BONUS symbols are determined Next, the effect control processing portion 312 operatively executed by the main CPU 222 conducts contents-of-effect determination executing processing (step S15). The main CPU 222 extracts random number values for effects, determines any of a plurality of predetermined contents of effects, and executes the contents of effects with a timing of the determined content of effect. For example, the main CPU 222 conducts control in such a manner that a video image for effects is displayed on the video display unit 110, a voice is output by the speaker 112, the lamp 114 is lit, and effect processing is applied to these contents, etc. In a case where a feature game trigger is established and in a case where a player selects a free game after the trigger has been established, etc., although further effect processing such as video image display on the video display unit 110 is conducted, a detailed description thereof will be given later.

Next, the main CPU 222 conducts symbol display control processing to be described later with reference to FIG. 24 (step S16). In this processing, scrolling of symbol arrays of a respective one of the reels is started, to-be-stopped symbols determined in the symbol lottery processing of step S14 are stopped at their predetermined positions. Also, light emission control of a respective one of the reels is conducted based on the values of the BONUS symbols that are determined in the symbol lottery processing of step S14.

Figure 25:
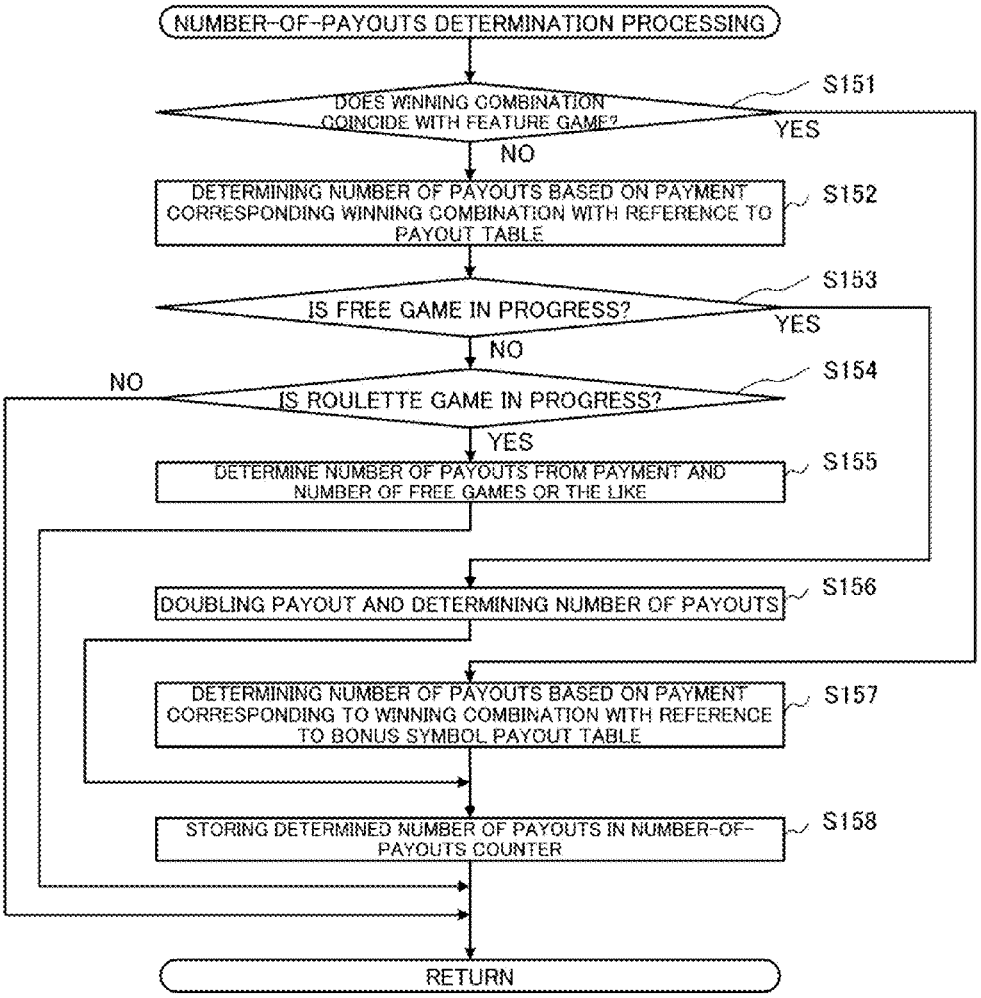
FIG. 25 is a flowchart of number-of-payouts determination processing in a gaming machine.

Next, the main CPU 222 conducts number-of-payouts determination processing to be described later with reference to FIG. 25 (step S17). In this processing, in a normal game, determination of the number of payouts based on the payout table (FIG. 19) is conducted according to a combination of symbols that are displayed on a payline, and the determined number of payouts is stored in the number-of-payouts storage region that are provided in the RAM 226 (the number-of-payout counter 321). Also, in a case where a feature game trigger is established, determination of the number of payouts is conducted in accordance with rules that are different from those in the normal game, according to a combination of the BONUS symbols.

Next, the main CPU 222 determines whether or not a feature game trigger is established (step S18). When the main CPU 222 determines that the feature game trigger is established (for example, the main CPU 222 determines that the feature game trigger is established in a case where a game mode is a feature mode), the main CPU 222 conducts feature game processing to be described later with reference to FIG. 26 (step S19).

Next, when the main CPU 222 determines that the feature game trigger is not established after the processing of step S19 or in the step S18, the main CPU 222 conducts payout processing (step S20). The main CPU 222 adds a value stored in the number-of-payouts storage region (the number-of-payouts counter 321) to a value stored in the number-of-credits storage region provided in the RAM 226 (the number-of-credits counter 320). One or more coins according to the number-of-payouts counter 321 may be ejected from the coin payout opening by controlling the driving of the hopper 242. Also, a barcode-attached ticket in which the number-of-payouts counter 321 is recorded may be issued by controlling the driving of the ticket printer 120. After this processing has been conducted, a mode flag and a symbol value storage region or the like are cleared, and the routine reverts to step S12.

(Coin Entry/Start Check Processing)

Next, with reference to FIG. 22, coin entry/start check processing will be described. FIG. 22 is a flowchart of the coin entry/start check processing in the gaming machine 10 according to an embodiment of the present invention.

First, with the use of the input/credit check processing portion 300 operatively executed by the main CPU 222, the main CPU 222 determines whether or not coin entry is determined by the coin counter 232 (step S41). When the main CPU 222 determines that the coin entry is determined, the main CPU 222 adds a value of the entered coin to a value stored in the number-of-credits storage region (the number-of-credits counter 320) (step S42). In addition to coin entry, it is determined whether or not bill entry is determined by the bill validator 246, and when it is determined that the bill entry is detected, a value according to the bill may be added to the number-of-credits counter 320.

When the main CPU 222 determines that the coin entry is not detected subsequent to step S42 or in step S41, the main CPU determines whether or not the number-of-credits counter 320 is set to 0 (step S43). When the main CPU 222 determines that the number-of-credits counter 320 is not set to 0, the main CPU 222 permits acceptance of operation of the BET button (step S44).

Next, the main CPU 222 determines whether or not the operation of the BET button is detected (step S45). When the main CPU 222 detects that the BET button is pressed by a player with use of the BET switch, the main CPU 222 adds a value stored in the number-of-BETs storage region that is provided in the RAM 226 (the number-of-BETs counter 325), based on a kind of the BET button, and subtracts the number-of-credits counter 320 (step S46).

Next, the main CPU 222 determines whether or not the number-of-BETs counter 325 is a maximum (step S47). When the main CPU 222 determines that the number-of-BETs counter 325 is the maximum, the main CPU 222 disables updating of the number-of-BETs counter 325 (step S48). When the main CPU 222 determines that the number-of-BETs counter 325 is not the maximum subsequent to step S48 or in step S47, the main CPU 222 permits acceptance of operation of the spin button (step S49).

When the main CPU 222 determines that the operation of the BET button is not detected subsequent to step S49 or in step S45, or alternatively, when the main CPU 222 determines the number-of-credits counter 320 is set to 0 in step S43, the main CPU 222 determines whether or not operation of the spin button is detected (step S50). When the main CPU 222 determines that the operation of the spin button is detected, the routine reverts to step S41.

When the main CPU 222 determines that the operation of the spin button is detected, the main CPU 222 completes coin entry/start check processing.

<Symbol Lottery Processing>

Next, with reference to FIG. 23, FIGS. 28A to 28D, and FIG. 29, symbol lottery processing will be described. FIG. 23 is a flowchart of the symbol lottery processing in the gaming machine 10 according to an embodiment of the present invention.

First, the number-of-random generating processing portion 302 operatively executed by the main CPU 222 extracts random number values for determination of symbols (step S111). Next, the symbol determination processing portion 304 operatively executed by the main CPU 222 determines the to-be-stopped symbols of a respective one of the reels by a lottery (step S112). The main CPU 222 conducts the lottery according to a respective one of the reels (the first to fifth reels M3*a* to M3*e*), and determines any of 22 symbols (code numbers 00 to 21) as the to-be-stopped symbols, based on the symbol determination table (FIG. 18). At this time, the probabilities that the 22 symbols (code numbers 00 to 21) appear are determined according to the weights in the symbol determination table.

Next, the main CPU 222 stores the determined at-stopped symbols of a respective one of the reels in the symbol storage region that is provided in the RAM 226 (step S113). Next, the prize determination processing portion 310 operatively executed by the main CPU 222 determines a winning combination based on a combination of the symbols that are stored in the symbol storage region by referring to the payout table (FIG. 19) (step S114). The main CPU 222 determines a combination of the symbols displayed on a payline by a respective one of the reels coincides with a combination of the symbols specified in the payout table, and determines a winning combination.

Next, the prize determination processing portion 310 operatively executed by the main CPU 222 determines whether or not the combination of the symbols stored in the symbol storage region coincides with a feature game trigger (step S115). More specifically, in the display window 150, if a BONUS symbol is displayed at least in a respective one of the first reel M3*a*, the second reel M3*b*, and the third reel M3*c*, the feature game trigger is established. It is sufficient if at least one BONUS symbol be displayed in any one of the first line to the third line regardless of on which line any BONUS symbol is displayed or how many BONUS symbols are displayed. Then, the game mode determination processing portion 316 operatively executed by the main CPU 222 sets a game mode to a feature game. It is to be noted that such a condition for feature game trigger is merely provided as an example, and a variety of other conditions can be set. For example, it may be determined whether or not the feature game trigger is established according to how symbols other than the BONUS symbols are displayed in the display window 150, for example.

Now, with reference to FIGS. 28A to 28D, a specific determination of whether or not the feature game trigger is established will be described. FIGS. 28A to 28D are views showing rearranged patterns of BONUS symbols. FIGS. 28A to 28D show the stopped symbols on the first to fifth reels M3*a* to M3*e* that are displayed in the display window 150 of the symbol display unit 40. Whether or not the stopped symbols coincide with the feature game trigger is associated with only whether or not the BONUS symbols are displayed, and thus, other symbols are not shown.

Figure 28A:
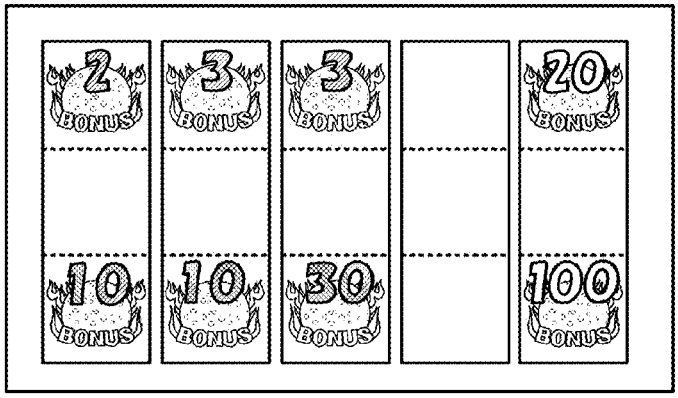
FIGS. 28A, 28B, 28C and 28D are views showing a pattern in which BONUS symbols are rearranged.

In an example of FIG. 28A, two BONUS symbols (the first line and the third line) are displayed in a respective one of the first reel M3*a*, the second reel M3*b*, and the third reel M3*c*, and thus, it is determined that the BONUS symbols coincide with the feature game trigger. On the other hand, in an example of FIG. 28B, no BONUS symbol is displayed in the third reel M3*c*, and thus, no symbol coincides with the feature game trigger. Although four BONUS symbols are displayed in the first reel M3*a* and the second reel M3*b*, arrangement of such BONUS symbols does not come under the feature game trigger as defined in the determination criterion mentioned above.

Figure 28B:
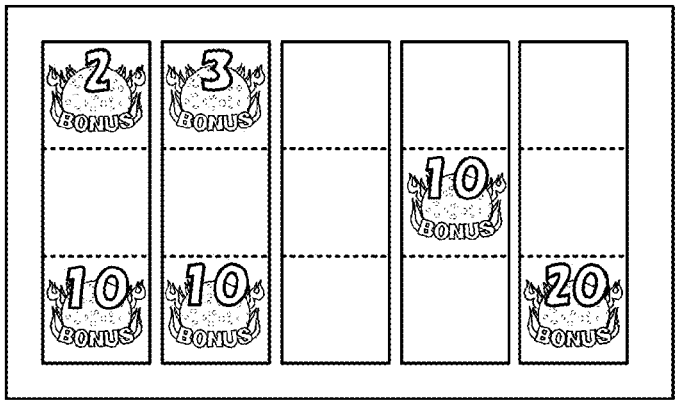
Figure 28C:
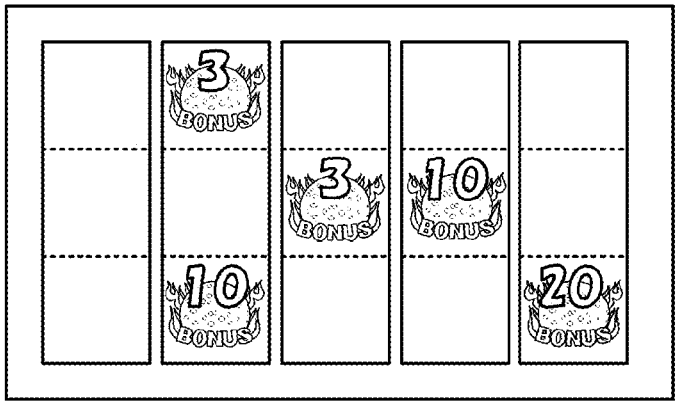

In an example of FIG. 28C also, no BONUS symbol is displayed in the first reel M3*a*, and thus, no symbol coincides with the feature game trigger. The BONUS symbols must be displayed all over the three continuous reels from the first reel M3*a*. In an example of FIG. 28D, one BONUS symbol is displayed in a respective one of the first reel M3*a*, the second reel M3*b*, and the third reel M3*c*, and thus, this combination coincides with the feature game trigger. In the embodiment, as described above, although in the display window 150, the feature game trigger is established on condition that at least one BONUS symbol is displayed in a respective one of the first reel M3*a*, the second reel M3*b*, and the third reel M3*c*, of course, a variety of other criterion can be employed with respect to such a determination.

Next, the random number generating processing portion 302 run mean of the main CPU 222 extracts random number values for determination of BONUS symbol values (step S116). Next, the main CPU 222 determines the values of the respective BONUS symbols by a lottery (step S117). The symbol determination processing portion 304 operatively executed by the main CPU 222 conducts the lottery according to the respective BONUS symbols, and determines the values of the respective BONUS symbols based on the BONUS symbol value determination table shown in FIG. 29. At this time, the values of the BONUS symbols are determined as Low values or High values, and the related probabilities are determined according to the weights in the BONUS symbol value determination table.

Symbol IDs in the BONUS symbol value determination table of FIG. 29 correspond to specific BONUS symbols. For example, a value of a BONUS symbol of symbol ID=A corresponds to a BONUS symbol of code number=00 in the first reel shown in the symbol determination table (FIG. 18), and a value of a BONUS symbol of symbol ID=B corresponds to a BONUS symbol of code number=02 in the first reel shown in the symbol determination table. Therefore, the BONUS symbol of code number=00 in the first reel and the BONUS symbol of code number=02 in the first reel are symbols in which "2" or "10" can be taken as the value of the BONUS symbol. Thus, the reel band M32 is configured so that either numeral "2" or "10" can be displayed according to the lottery processing mentioned above.

A configuration in which the two BONUS symbols shown in FIG. 10 to FIG. 13B respectively enables two different display modes, that is, a configuration in which display of the numeric portion "2" or the numeric portion "10" is switched to green or red with the use of the light emission by the backlight device M7, is a configuration that is employed so as to be corrected to the BONUS symbol of code number=00 in the first reel and the BONUS symbol of code number=02 in the first reel, for example.

In the embodiment, as in the BONUS symbol value determination table of FIG. 29, although the BONUS symbol values are two kinds of the Low value and High value, and green and red are associated with the two values under the control of light emission by the backlight device M7, a plurality of BONUS symbol values may be respectively associated with each other as the Low value or the High value.

In addition, display colors (three colors or more) relevant to numeric portions of the BONUS symbols can be set so as to correspond to three groups or more such as Low, Middle, and High groups, or alternatively, so as to correspond to the BONUS symbol values themselves. In this case, it is preferable that the numeric portions of the respective BONUS symbols be displayed in the corresponding display colors by employing video reels.

As described above, the reel band M32 corresponding to a respective one of the first to fifth reels M3*a* to M3*e* is configured so that the corresponding Low value and High value can be displayed to be switched in accordance with the values of the BONUS symbols in the BONUS symbol value determination table (FIG. 29).

Next, the main CPU 222 stores: the values of the respective BONUS symbols determined as described above; and the information for identifying whether the values mentioned above are Low or High, in the BONUS symbol value storage region (step S118). When this processing is conducted, the symbol lottery processing is completed.

<Symbol Display Control Processing>

Next, with reference to FIG. 24, symbol display control processing will be described. FIG. 24 is a view showing a flowchart of the symbol display control processing in the gaming machine 10 according to an embodiment of the present invention.

First, the reel control processing portion 308 operatively executed by the main CPU 222 transmits a spinning control signal to the reel assembly M11, and the reel driver 264 of the first to fifth reels M3*a* to M3*e* supplies power to the reel motor 272 and then spins the first to fifth reels M3*a* to M3*e*. The first to fifth reels M3*a* to M3*e* spin at predetermined speeds, and the symbol arrays assigned to the first to fifth reels M3*a* to M3*e* scroll in the display window 150 of the symbol display unit 40 (step S131).

Next, the reel control processing portion 308 operatively executed by the main CPU 222 determines that a feature game trigger is established (step S132). For example, in a case where a game mode is the feature game, it is determined that the feature game trigger is established.

In a case where it is determined that the feature game trigger is established in step S132, the reel control processing portion 308 operatively executed by the main CPU 222 controls the backlight device M7 to illuminate the respective BONUS symbols, based on information for identifying whether the values of the BONUS symbols that are stored in the BONUS symbol value storage region are set to High or Low (step S133). Thus, the main CPU 222 controls the backlight driver 266 to supply power to the light source device M71 of the backlight device M7, the effect illumination driver 268 to supply power to the light source 292 of the effect illumination device 290 and then execute effects from a back of a reel surface.

The backlight device M7 is controlled to emit green light to a corresponding BONUS symbol in a case where the value of the BONUS symbol is Low. On the other hand, this backlight device is controlled to emit red light to a corresponding BONUS symbol in a case where the value of the BONUS symbol is High.

For example, in the case of the BONUS symbols shown in FIG. 10 to FIG. 13B, if a value of a BONUS symbols is Low value (that is, "2"), green light is emitted by the backlight device M7, and the BONUS symbol whose numeric portion "2" are represented in a green color are displayed. On the other hand, if a value of a BONUS symbol is set to a High value (that is, "10"), red light is emitted by the backlight device M7, and the BONUS symbol whose numeric portion is "10" is represented in a red color is displayed. In addition, two BONUS symbols that are displayed in the first reel M3*a* shown in FIG. 28A also corresponds to this, and the BONUS symbol having the numeric portion "2" displayed in a green color and the BONUS symbol having the numeric portion "10" displayed in a red color are shown.

Emission of the green light or the red light by the backlight device M7 can be started with a predetermined timing at time intervals from start to stop of spinning of the first to fifth reels M3*a* to M3*e* in step S131. In this case, according to spinning of a respective one of the reels, the light source devices M71 of the backlight device M7 at a corresponding position can be sequentially controlled so that emission of the green light or the red light is conducted in conformance with the BONUS symbols moving from an upper side to a lower side of the display window 150 of the symbol display unit 40.

The positions of the BONUS symbols targeted to be emitted (the positions at which the symbols move from the first line to the third line in the display window 150) can be grasped by the magnetic field detector 270 connected to the I/O unit 262, for example.

Also, it is possible to control emission of the green light or the red light so as to be conducted at final stop positions of the BONUS symbols from a time point of start of light emission without conducting tracking light emission of the BONUS symbols by the backlight device M7.

Figure 30:
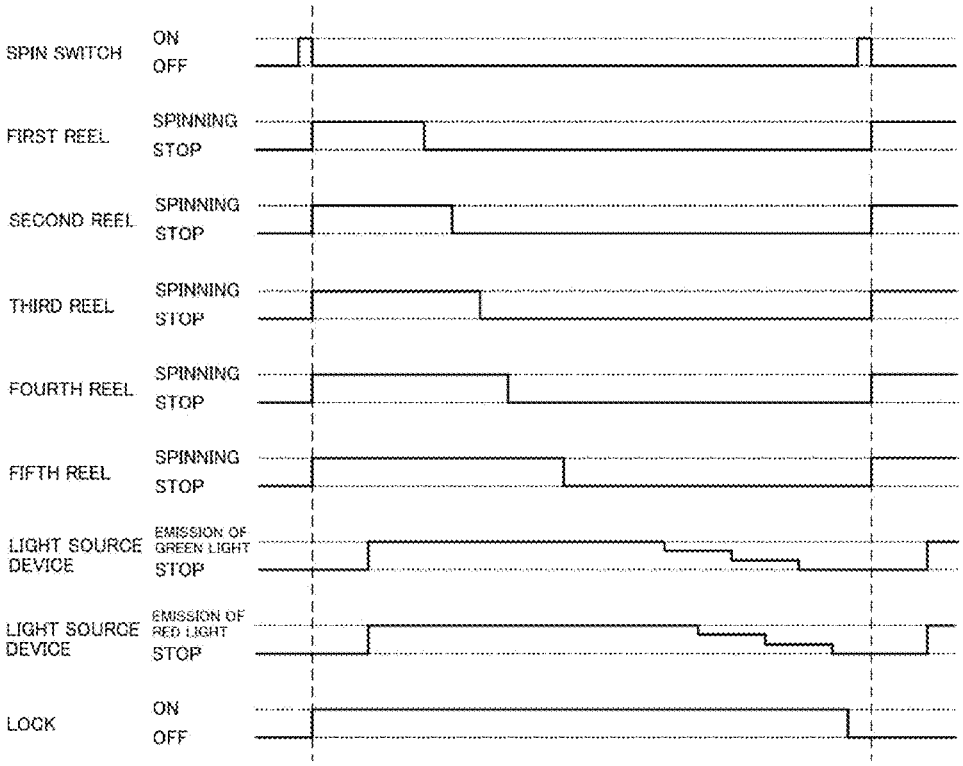
FIG. 30 is a schematic view showing a timing of light emission by a backlight device.

Now, a timing of light emission by the backlight device M7 will be specifically described with reference to a timing chart of FIG. 30. As shown in FIG. 30, a spin switch is turned ON/OFF according to the fact that the spin button is pressed, and spinning of the first to fifth reels M3*a* to M3*e* is started accordingly. Afterwards, the respective reels are sequentially stopped with the elapse of a predetermined period of time. After spinning of the first to fifth reels M3*a* to M3*e* has been started, the backlight device M7 starts emission of the green light and emission of the red light before the first reel M3*a* stops, and subsequently, after spinning of the first to fifth reels M3*a* to M3*e* has stopped, this backlight device subtracts light emissions to the BONUS symbols on a one by one basis according to the effects in the number-of-free-games display processing to be described later. In this example, a first emission of green light represents a light emission to three BONUS symbols, and a first emission of the red light represents light emissions to other three BONUS symbols, and further, these light emissions are alternatively stopped on a one by one basis (this situation is represented by the fact that green light emission and red light emission each reach an inactive state in three steps).

Light emission by the backlight device M7 is controlled so that while in reel spinning, the plurality of light source devices M71 sequentially emit light beams to follow the spinning, and after the reels have stopped, the light emission is continued by the corresponding light source devices M71 (Afterwards, the emissions are sequentially stopped by the effects in the number-of-free-games display processing). Also, as shown in FIG. 30, a lock can be applied so as to disable the spin button to be pressed until the effects in the number-of-free-games display processing has completed (for example, until light emission from of all the light source devices M71 has been stopped, or alternatively, until a predetermined period of time has elapsed after the light emission has been stopped).

In addition, it is possible to group the first to fifth reels M3*a* to M3*e* and then change a mode and a timing of the light emission by the backlight device M7 as described above on a group by group basis.

In a case where it is determined that the feature game trigger is not established in step S132, a winning combination other than the feature game is established or "Losing" is established, and the routine advances to step S134, and in this case, emission by the backlight device M7 in another mode may be conducted.

In the embodiment, if a BONUS symbol exists in the fourth reel M3*d*, a value of that BONUS symbol is added to the number of free games (the number-of-free-game counter 324), and the value is taken into an account in terms of computation of payment. Similarly, if BONUS symbols exist in the fourth and fifth reels M3*d* and M3*e*, values of these BONUS symbols are added to the number of games (the number-of-free-games counter 324), and the values are taken into an account in computation of payment. That is, if BONUS symbols continuously exist from the first reel M3*a* to its right reels, the related values are taken into an account in respect of the number of free games and payment.

Figure 28D:
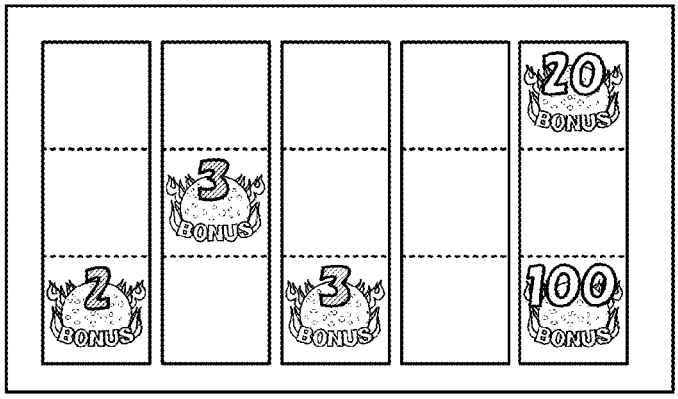

Therefore, as shown in FIG. 28A and FIG. 28D, even in a case where no BONUS symbol exists in the fourth reel M3*d*, although the feature game trigger is established, the BONUS symbol in the fifth reel M3*e* is not taken into an account with respect to the number of free games and payment. In this case, with respect to these BONUS symbols that are not taken into an account, the light emission by the backlight device M7 is controlled so as not to be conducted. In the case where the light emission by the backlight device M7 is not conducted, although there is a possibility that the numeric portions of the BONUS symbols such as "20" and "100" cannot be visually recognized, these numeric portions are merely shown for the sake of convenience of explanation.

In addition, as shown in FIG. 28B and FIG. 28C, with respect to the BONUS symbols by which the feature game trigger is not established, the light emission by the backlight device M7 is controlled so as not to be conducted for all of them.

With the use of such light emission by the backlight device M7, a player can approximately predict whether the number of free games is large or small, etc., by watching arrangements or intensities of green and red light beams relevant to a respective one of the reels while in reel spinning, and the player's sense of expectation or tense atmosphere can be enhanced more remarkably.

Next, the reel control processing portion 308 operatively executed by the main CPU 222 conducts reel stop control (step S134). It is to be noted that the reel stop control in step S134 can be conducted before or in parallel to the BONUS symbol emission control in step S133. A spin control signal includes information relevant to stop positions of the first to fifth reels M3*a* to M3*e* that are obtained from the to-be-stepped symbols in a respective one of the reels stored in the symbol storage region. The reel driver 264 of the first to fifth reels M3*a* to M3*e* controls the reel motor 272, and stops the first to fifth reels M3*a* to M3*e* at the positions that are indicated by the spin control signal. In this manner, the reel motor 272 made of a stepping motor is stopped at a desired position, and scrolling of the symbol arrays is stopped so that the to-be-stopped symbols are positioned on the second lines of the symbol matrix that is formed of the display window 150. In a case where spinning of the first to fifth reels M3*a* to M3*e* stops, the light emission by the light source device M71 conducted in conformance with the BONUS symbols stops a tracking activity at the stopped positions of the BONUS symbols, and the emission is continued thereat.

Lastly, the symbol display control processing completes, and the routine of the flow of execution reverts to main processing.

<Number-of-Payouts Determination Processing>

Next, with reference to FIG. 25, number-of-payouts determination processing will be described. FIG. 25 is a flowchart of the number-of-payments processing in the gaming machine 10 according to an embodiment of the present invention.

First, it is determined whether or not a winning combination is a feature game (step S151). For example, in a case where a game mode is the feature game, a feature game trigger is established, and it is determined that the winning combination is the feature game. When the winning combination is not the feature game, the payout processing portion 314 operatively executed by the main CPU 222 determines the number of payouts based on a payment corresponding to a normal winning combination with reference to the symbol storage region and the payout table (FIG.

19) (step S152). For example, in the payline across the first to fifth reels M3*a* to M3*e*, in a case where a RED7 symbol is displayed in all of the reels, the winning combination is established as "RED7", and based on the corresponding payment "1000" (refer to the payout table (FIG. 19), the number of payouts is determined at "1000". It is to be noted that when "Losing" is established, the number of payouts is determined at "0".

Next, the payout processing portion 314 operatively executed by the main CPU 222 checks a mode flag, and determines whether or not a free game is played (step S153). In a case where the free game is played, the payment obtained in step S152 is doubled to thereby compute the number of payouts (step S156).

The payout processing portion 314 operatively executed by the main CPU 222 checks a mode frag, and determines whether or not a roulette game is played (step S154). In a case where the roulette game is played, the number of payouts is determined based on the payment corresponding to the display region on the roulette board determined by roulette lottery processing and the number of free games or the like stored in the number-of-free-games counter (step S155). A detailed description of a method for determining the number of payments in the roulette game will be given later.

When it is determined that the winning combination is the feature game, the number of payouts is determined based on the payment corresponding to the winning combination of the feature game with reference to the BONUS symbol value storage region and the BONUS payout table shown in FIG. 31 (step S157). That is, in the BONUS symbol payout table, a BONUS point is set according to the number (Kind number) of BONUS symbols displayed in the display window 150, and the set BONUS point is set as a payment. Also, as long as BONUS symbols are continuously displayed on the third reel M3*c* to the fourth and fifth reels M3*d* and M3*e*, these BONUS symbols are taken into an account to obtain the payment. Therefore, in a case where no BONUS symbol exists in the fourth reel M3*d*, as shown in FIG. 28A and FIG. 28D, the BONUS symbol in the fifth reel M3*e* is not taken into an account.

In the feature game trigger, at least one BONUS symbol is displayed on a respective one of the first reel M3*a* to the third reel M3*c*, and thus, a minimum Kind number is set to 3, and in this case, the BONUS point is set to 1. On the other hand, two BONUS symbols can be respectively continuously displayed on the first reel to the fifth reel (refer to the symbol determination table (FIG. 18), a maximum Kind number is 10, and in this case, the BONUS point is 50.

Subsequent to step S155, step S156, and step S157, the payout processing portion 314 operatively executed by the main CPU 222 stores the determined number of payouts in the number-of-payouts counter 321 of the number-of-payouts storage region (step S158). If this processing is conducted, the number-of-payouts determination processing is completed.

<Feature Game Processing>

Figure 26:
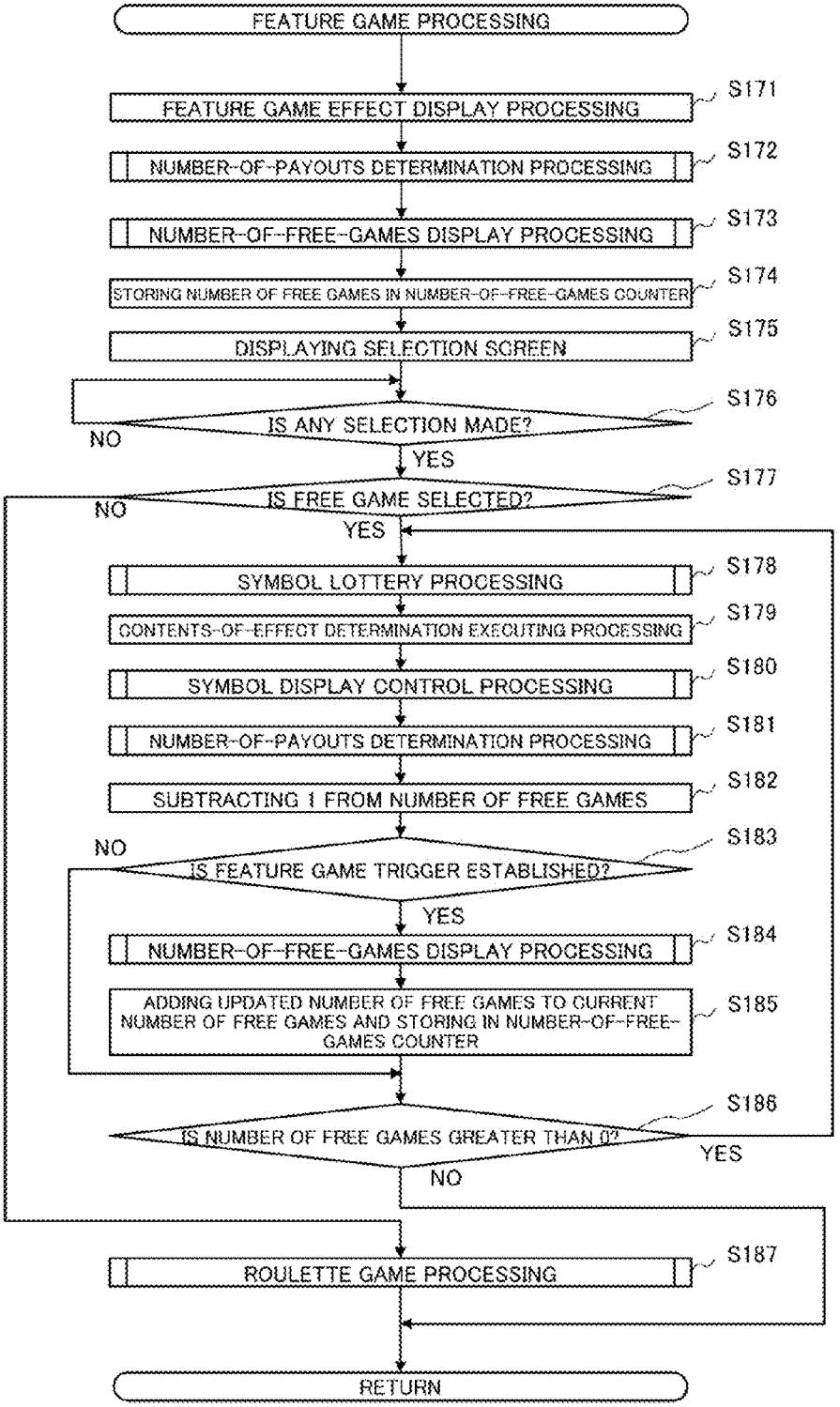
FIG. 26 is a view showing a flowchart of feature game processing in a gaming machine.

Next, feature game processing will be described with reference to FIG. 26 and FIGS. 32A to 32D. FIG. 26 is a flowchart of the feature game processing in the gaming machine 10 according to an embodiment of the present invention. FIGS. 32A, 32B, 32C and 32D are views showing a transition of display on the video display unit 110 and the display window 150 of the symbol display unit 40.

Figure 32A:
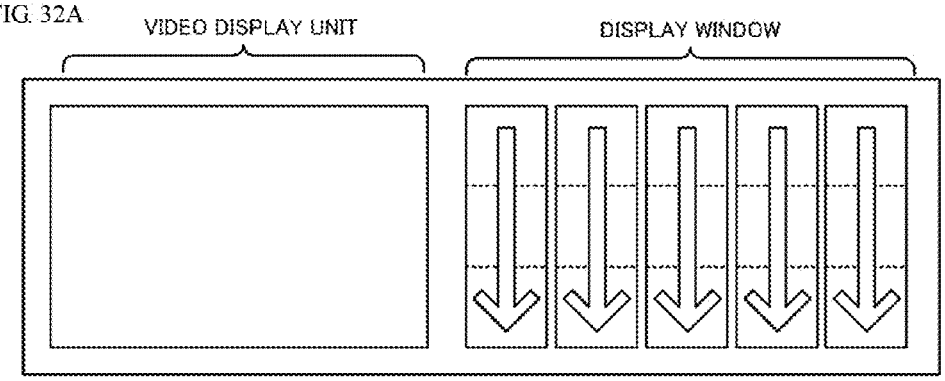
FIGS. 32A, 32B, 32C and 32D are views showing a pattern of display transition in a video display unit and a display window.
Figure 32B:
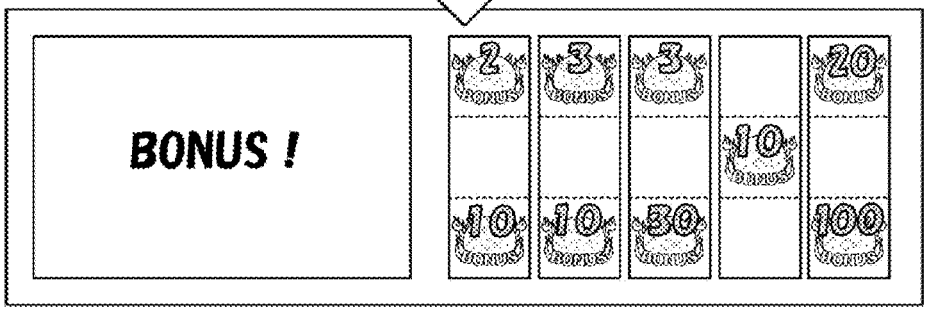

This processing is invoked in a case where it is determined that a feature game trigger is established in the main control processing shown in FIG. 21. First, the effect control processing portion 312 operatively executed by the main CPU 222 conducts control to display an effect video image on the video display unit 110 in order to conduct effects according to the start of a feature game (step S171). For example, as shown in FIG. 32A, in the display window 150, after the first to fifth reels M3*a* to M3*e* in spinning have been displayed, if the spinning is stopped and BONUS symbols are displayed at the arrangement as shown in FIG. 32B, this fact means that the feature game trigger is established, and thus, the effects according to the start of the feature game is conducted. In this example, a message "BONUS!" is displayed on the video display unit 110. Of course, in addition to such message display, effects can also be conducted in such a manner that a voice (such as background music BGM) is output by the speaker 112, the lamp 114 is lit, or alternatively, the light emission by the backlight device M7 is controlled to change a color of a BONUS symbol or the like.

Next, the payout control portion 314 operatively executed by the main CPU 222 conducts number-of-payouts determination processing in a case where the feature game trigger is established (step S172).

Figure 32C:
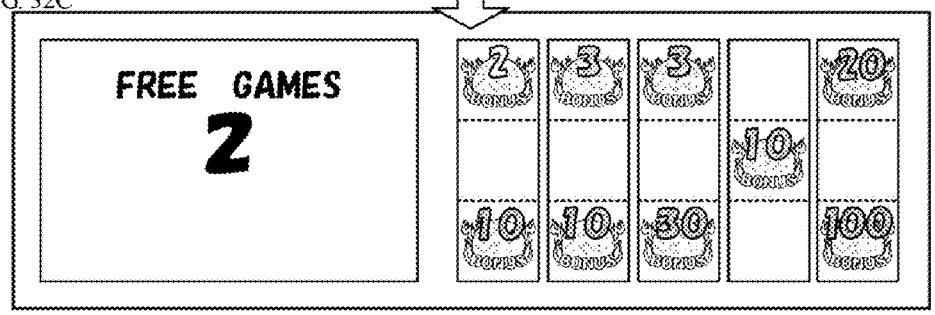

Next, the main CPU 222 conducts number-of-free-games display processing (step S173). This processing is adapted to determine the number of free games, based on the values of the respective BONUS symbols and to display the progress of computation of the number of free games and a final result as an effect on the video display unit 110. FIG. 32C shows that, as a first step of this effect, in the display window 150, the value of the BONUS symbol displayed on the first line of the first reel M3*a* is displayed as the number of free games on the video display unit 110. This processing will be described later in detail with reference to FIG. 27 and FIG. 33A to FIG. 35B.

Figure 32D:
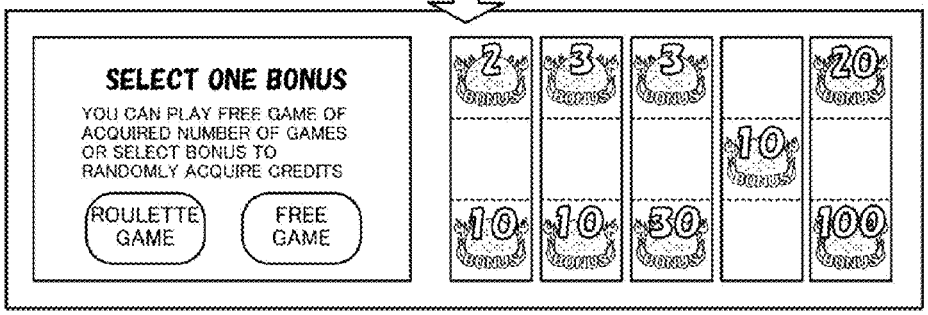

Next, the game counter processing portion 306 operatively executed by the main CPU 222 sets the number of free games determined in step S173 to the value stored in the number-of-free-games storage region (the number-of-free-games counter 324) (step S174). Afterwards, the effect control processing portion 312 operatively executed by the main CPU 222 displays a selection screen for a player to select either one of the free game and the roulette game (step S175). FIG. 32D shows the selection screen 110 displayed on the video display unit by this processing. The selection screen display a selection button for selection the free game and a selection button for selecting the roulette, and a player selects either one of these two selection buttons by operation of the BET button and then determines that selection by operation of the spin button. Next, the main CPU 222 determines whether or not the player makes the above selection from the selection (step S176), and this processing is repeated until the selection is made.

When the player makes the selection from the selection screen, the main CPU 222 determines that the selected game is the free game (step S177). In a case where the selected game is not the free game (that is, in a case where the roulette game is selected), the game mode determination processing portion 316 operatively executed by the main CPU 222 sets the game mode to the roulette game and then advances to the roulette game processing of step S187, and after the roulette game has been played, the feature game processing is completed. The roulette game processing will be described later in detail with reference to FIG. 39 or the like. On the other hand, in a case where the selected game is the free game, the game mode determination processing portion 316 operatively executed by the main CPU 222 sets the game mode to the free game, and as described later, a unit game that is similar to a normal game is repeatedly played according to the determined number of free games.

In a case where the selected game is the free game, the main CPU 222 first conducts symbol lottery processing that is similar to the main control processing of FIG. 21 (step S178). Next, the effect control processing portion 312 operatively executed by the main CPU 222 conducts contents-of-effect determination executing processing (step S179). The main CPU 222 extracts effect random number values, determines any of a plurality of the predetermined contents of effects by a lottery, and executes the contents of the effect with a timing of the determined contents of effect. For example, an effect video image is displayed on the video display unit 110, a voice (such as background music (BGM)) is output by the speaker 112, the lamp 114 is lit, and effect processing is applied to these elements, etc., whereby control of a display mode or the like is conducted.

Next, the main CPU 222 conducts symbol display control processing that is similar to the main control processing of FIG. 21 (step S180). It is to be noted that the symbol display control processing of step S180 can be conducted before or in parallel to execution of the contents of effects in step S179. Next, the main CPU 222 conducts number-of-payouts determination processing that is similar to the main control processing of FIG. 21 (step S181).

Afterwards, the game counter processing portion 306 operatively executed by the main CPU 222 subtracts "1" from the number-of-free-games counter 324 according to the fact that one free game completes (step S182). The main CPU 222 determines whether or not the feature game trigger is established as a result of the symbol lottery processing in step S178 (step S183), and if the feature game trigger is established (retrigger), the main CPU conducts processing that is similar to the number-of-free games display processing conducted in step S173 (step S184). Next, the game counter processing portion 306 operatively executed by the main CPU 222 adds the determined number of free games to the value stored in the number-of-free-games storage region (the number-of-free-games counter 324) (step S185).

Next, the main CPU 222 determines whether or not the number-of-free-games counter 324 is set to 0 in a case where no feature game is established or in a case where the processing of step S185 completes (step S186). In a case where the number-of-free-games counter 324 is not set to 0, the routine advances to step S178 in order to play a new free game. In a case where the number-of-free-games counter 324 is set to 0, the feature game processing is completed.

<Number-of-Free-Games Display Processing>

Figure 27:
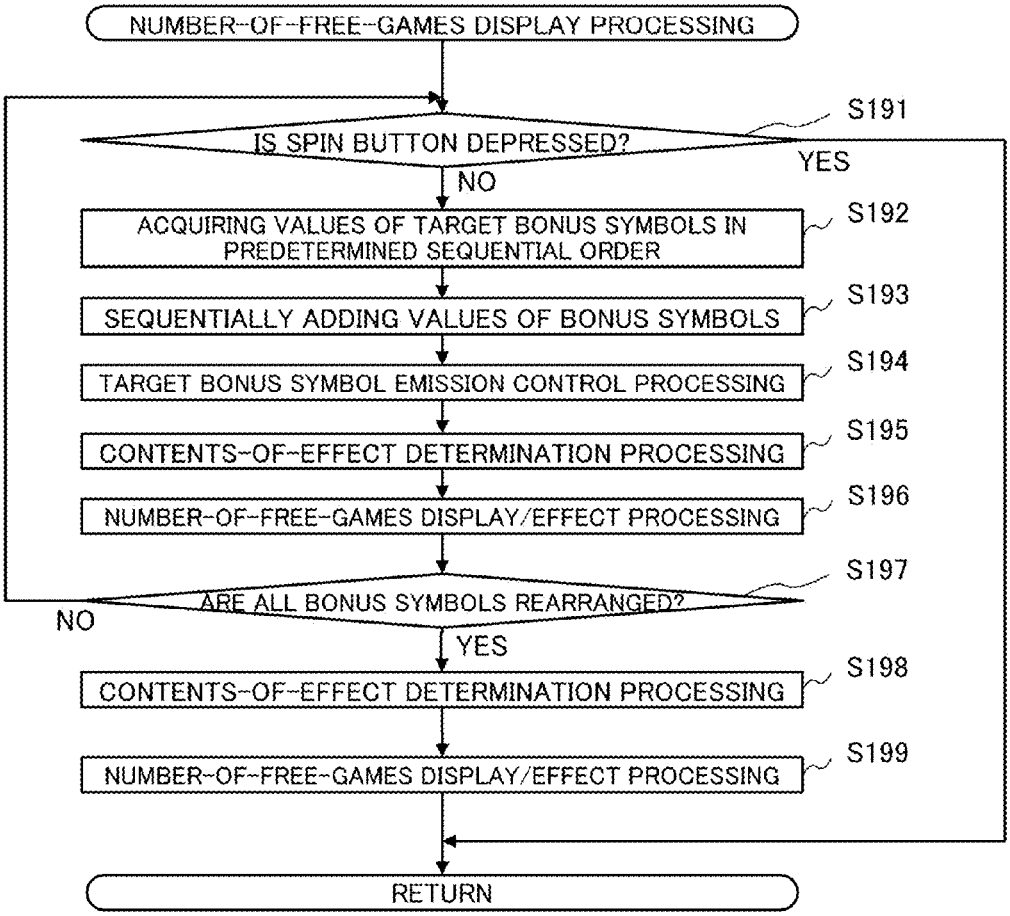
FIG. 27 is a flowchart of number-of-free-games display processing in a gaming machine.

Next, number-of-free-games display processing will be described with reference to FIG. 27 and FIG. 33A to FIG. 35B. FIG. 27 is a flowchart of the number-of-free-games display processing in the gaming machine 10 according to an embodiment of the present invention. FIG. 33A to FIG. 35B are views each showing a pattern of display transition on the video display unit 110 and the display window 150 of the symbol display unit 40.

The main CPU 222 determines whether or not the spin button is pressed (step S191). In a case where it is determined that the spin button is pressed, all of the processing operations that follow are skipped, and the number-of-free-games display processing is completed. In a case where the spin button is not pressed, the cumulative value of the values of the BONUS symbols is displayed as the number of free games on the video display unit 110 every time one BONUS symbol displayed is processed.

The main CPU 222 first acquires the values of the BONUS symbols with respect to the BONUS symbols displayed in the display window 150 of the symbol display unit 40 in a predetermined sequential order (step S192). The predetermined sequential order mentioned above is a sequential order of the first line to the third line of the first reel M3*a*, the first line to the third line of the second reel M3*b*, . . . , for example. Also, the values of the BONUS symbols are stored in the BONUS symbol value storage region in the symbol lottery processing of FIG. 21 (step S14) or the symbol lottery of FIG. 26 (step S178). In addition, as long as the BONUS symbols are continuously displayed on the third reel M3*c* to the fourth reel M3*d* and the fifth reel M3*e*, the values of these BONUS symbols are computed as the number of free games. Therefore, in a case where no BONUS symbol exists in the fourth reel M3*d* as shown in FIG. 28A and FIG. 28D, the BONUS symbol in the fifth reel M3*e* is not taken into an account.

Next, the game counter processing portion 306 operatively executed by the main CPU 222 sequentially adds the values of the BONUS symbols acquired in step S192 to the values of the BONUS symbols that have been obtained up to now (step S193). Next, the reel control processing portion 308 operatively executed by the main CPU 222 conducts emission control processing with respect to the target BONUS symbols (step S194). This processing conducts emission by the backlight device M7 or stop of the emission in association with the target BONUS symbols.

Next, the effect control processing portion 312 operatively executed by the main CPU 222 determines the contents of effect such as video image display on the video display unit 110 (step S195); conducts effect in accordance with the contents of effect determined in step S195, and displays the number of free games (step S196). It is to be noted that displaying of the number of free games and effect processing in step S196 can be conducted before or in parallel to the light emission control processing of the target BONUS symbols of step S194.

Next, the main CPU 222 determines whether or not processing competes with respect to all of the BONUS symbols displayed in the display window 150 (step S197). In a case where the processing does not complete with respect to all of the BONUS symbols that have been displayed, the routine advances to step S191, and processing of the next BONUS symbols is conducted.

Figure 33A:
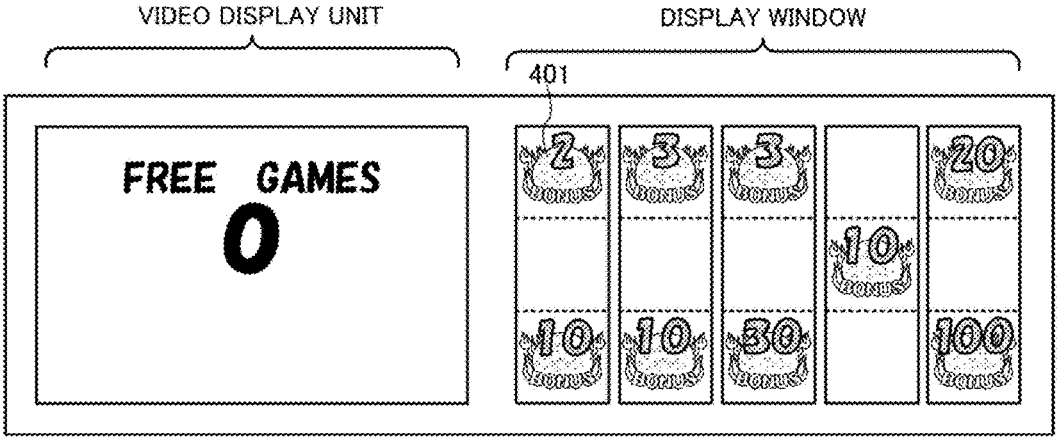
FIGS. 33A, 33B and 33C are views showing a pattern of display transition in a video display unit and a display window.

Now, a series of processing operations of step S192 to step S196 will be specifically described with reference to FIG. 33A to FIG. 34C. FIG. 33A shows a state in which the symbols are displayed to be stopped in the display window 150 by reel spinning control, and as a result, arrangement of the BONUS symbols meeting a condition for the feature game trigger is established. At this time, on the video display unit 110, the number of free games is displayed as "0" in an initial state of display of the number of free games.

Figure 33B:
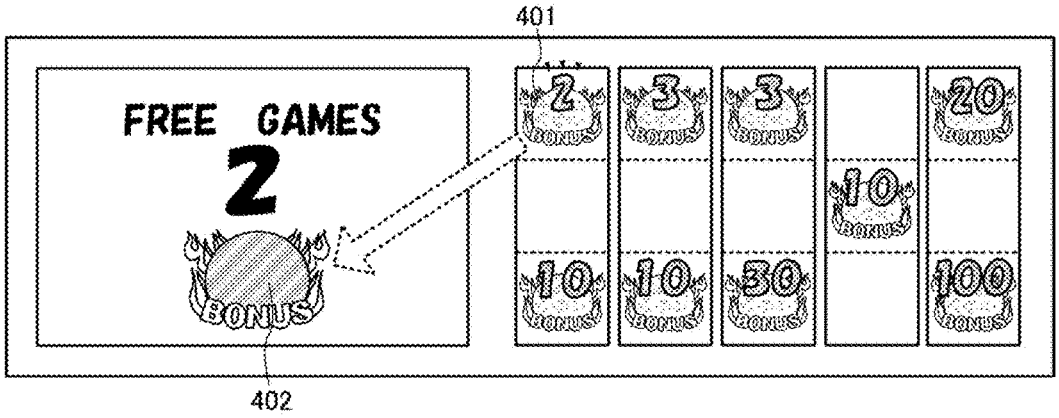

Next, processing of a first BONUS symbol 401 is conducted. The BONUS symbol value "2" relevant to The first BONUS symbol 401, that is, the BONUS symbol displayed on the first line of the first reel M3*a* in the display window 150 is acquired; the acquired value is added to the number of free games that has been obtained up to now, and as shown in FIG. 33B, the cumulative value "2" is displayed as the number of free games on the video display unit 110. In addition, at this time, the value of the BONUS symbol 401 is set to a Low value, and thus, the numeric portion "2" of the BONUS symbol 401 is displayed in a green color with the use of the light emission by the backlight device M7. Further, the cumulative value "2" as the number of free games is displayed on the video display unit 110, and a pattern 402 corresponding to this BONUS symbol is displayed. In this example, a part (a dashed part) of the pattern 402 is displayed in a green color which is the same as that displayed in accordance with emission control of the BONUS symbol 401. Of course, the numeric portion "2" or another position indicating the number of free games, which is displayed on the video display unit 110, can be displayed in a green color in accordance with a target to be processed.

In addition, when the display as shown in FIG. 33B is provided on the video display unit 110, the numeric portion "2" of the BONUS symbol 401 that is a current target to be displayed, the numeric portion being displayed in the display window 150, is controlled so that blinking of green color is conducted with the use of the light emission by the backlight device M7 and stop of the emission. Further, the displayed contents of the video display unit 110 and the contents of effect including output of voice (such as background music BGM), turning ON of the lamp, and these effects are changed according to at least one of the display positions of the BONUS symbols in the display window 150 and whether or not the values of the BONUS symbols are large or small (that is set to a Low value or a High value), whereby the display mode or the like can be controlled. For example, effect can be changed dependent on the BONUS symbols displayed on the first line of the first reel M3*a* in the display window 150 and on the first line of the second reel M3*b*. Furthermore, the contents of effect mentioned above can be switched according to a value to be added (the BONUS symbol value) or the number of free games after added.

Switching of the contents of effect can be achieved by switching: video data or timing information that is capable of reproducing a video image or the like to be displayed on the video display unit 110; voice data or timing information according to voice output; a file specifying a lamp ON target (color) and timing; and a file defining effect processing or the like. For example, in a case where a file A includes a storage location (such as a file name) of video data A1 according to an effect A and timing data A2 specifying a display timing thereof and in a case where a file B includes a storage location (such as a file name) of video data B1 relevant to an effect B and timing data B2 for specifying a display timing thereof, a specified file is changed from the file A to the file B, whereby the effect control processing portion 312 operatively executed by the main CPU 222 interprets the file B, and provides an access to the target data, making it possible to switch the contents of effect.

The above mentioned value to be added and the number of free games after added can be classified into several levels according to the values, and according to the classified levels, the contents of effect as described above can be switched.

Figure 33C:
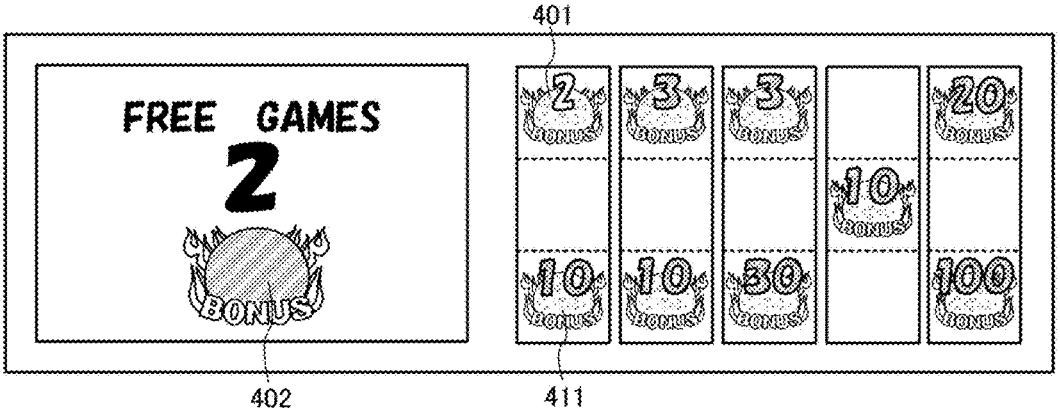

When processing of the first BONUS symbol 401 completes, as shown in FIG. 33C, the light emission by the backlight device M7 is stopped, blinking of green color for the numeric portion "2" of the BONUS symbol 401 is completed (turned OFF), and the numeric portion "2" is controlled so that it cannot be visually recognized or is made inconspicuous. Also, when the processing of the BONUS symbol 401 completes, the contents of effect including the displayed contents of the video display unit 110, output of voice (such as background music BGM), lamp turning ON, and these effects or the like are changed according to at least one of the display positions of the BONUS symbols in the display window 150 and whether or not the values of the BONUS symbols are large or small (that is set to a Low value or a High value), whereby the display mode or the like can be controlled.

The above mentioned value to be added and the number of free games after added can be classified into several levels according to the values, and according to the classified levels, the contents of effect as described above can be switched.

Figure 34A:
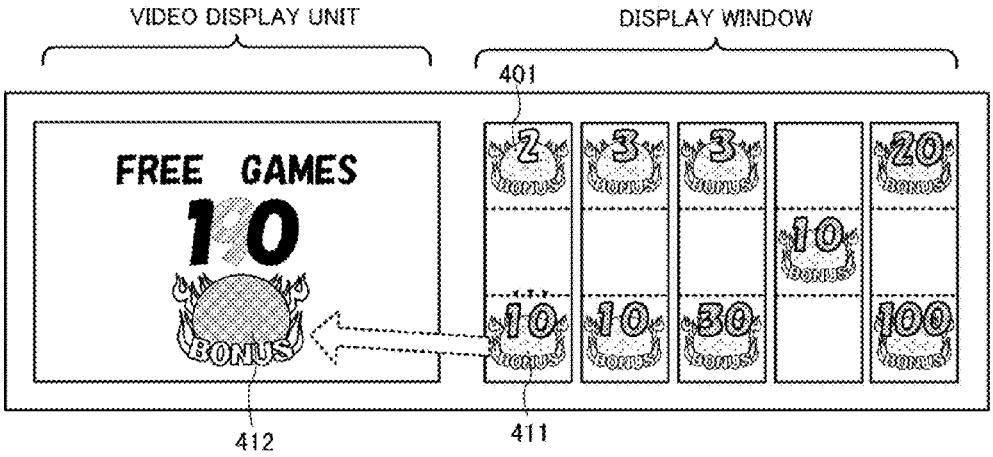
FIGS. 34A, 34B and 34C are views showing a pattern of display transition in a video display unit and a display window.

Next, the target to be processed reverts to a next BONUS symbol 411 in the predetermined sequential order mentioned above. The BONUS symbol value "10" of the BONUS symbol 411, that is, the bonus symbol that is displayed on the third line of the first reel M3*a* in the display window 150 is acquired, and the acquired value is added to the number of free games that has been obtained up to now (that is, a total of "12" added by the value "2" of the BONUS symbol 401). A progress indicating how the number of free games is added can be displayed on the video display unit 110 in one by one counting up mode (an increment display). FIG. 34A shows how a display switches from a numeral "9" to a numeral "10" partway of counting up to "12" that is a cumulative value of the number of free games. In this example, the numeral "9" that is displayed as the number of free games played immediately previously is controlled to fade out according to an appearance of the numeral "10".

Also, at this time, the value of the BONUS symbol 411 is set to a High value, and thus, the numeric portion "10" of the BONUS symbol 411 is displayed in a red color with the use of the light emission by the backlight device M7. Further, on the video display unit 110, a counting-up display is made for the cumulative value "12" of the number of free games, and the pattern 412 corresponding to this BONUS symbol is displayed. In this example, a part of the pattern 412 is displayed in a red color which is the same as that of the numeric portion "10" in accordance with emission control of the BONUS symbol 411.

In addition, when the display as shown in FIG. 34A is made on the video display unit 110, the numeric portion "10" of the BONUS symbol 411 that is a current target to be processed, the numeric portion being displayed in the display window 150, is controlled so that blinking of red color is conducted with the use of the light emission by the backlight device M7 and stoppage of the light emission. Further, the displayed contents of the video display unit 110 and the contents of effect including output of voice (such as background music BGM), turning ON of the lamp, and these effects are changed according to at least one of the display positions of the BONUS symbols in the display window 150 and whether or not the values of the BONUS symbols are large or small (that is set to a Low value or a High value), whereby the display mode or the like can be controlled. Furthermore, the contents of effect and the speed of the increment display mentioned above can be switched according to the value to be added (the BONUS symbol value) or the number of free games after added.

The above mentioned value to be added and the number of free games after added can be classified into several levels according to the values, and according to the classified levels, the contents of effects as described above can be switched.

Figure 34B:
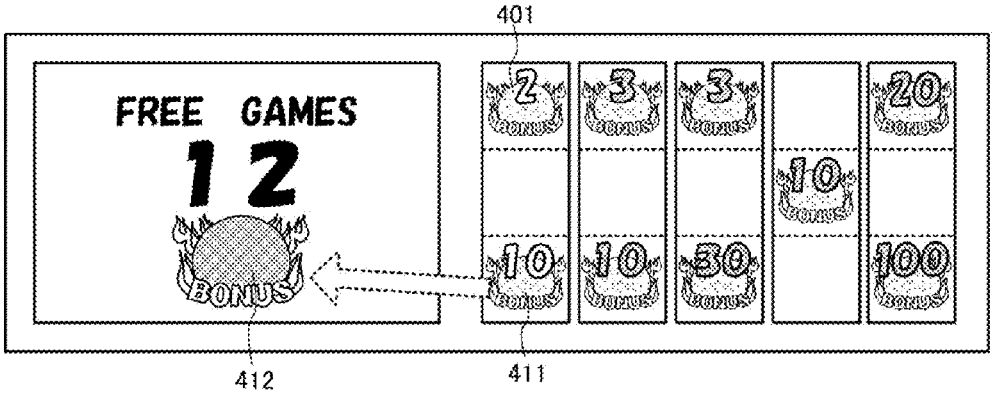

When processing of the BONUS symbol 411 completes, as shown in FIG. 34B, the light emission by the backlight device M7 is stopped, blinking of red color for the numeric portion "10" of the BONUS symbol 411 is completed, and the numeric portion "10" is controlled so that it cannot be visually recognized or is made inconspicuous. Also, when the processing of the BONUS symbol 411 completes, the contents of effect including the displayed contents of the video display unit 110, output of voice (such as background music BGM), lamp turning ON, and these effects or the like are changed according to at least one of the display positions of the BONUS symbols in the display window 150 and whether or not the values of the BONUS symbols are large or small (that is set to a Low value or a High value), whereby the display mode or the like can be controlled.

The above mentioned value to be added and the number of free games after added can be classified into several levels according to the values, and according to the classified levels, the contents of effect as described above can be switched.

Figure 34C:
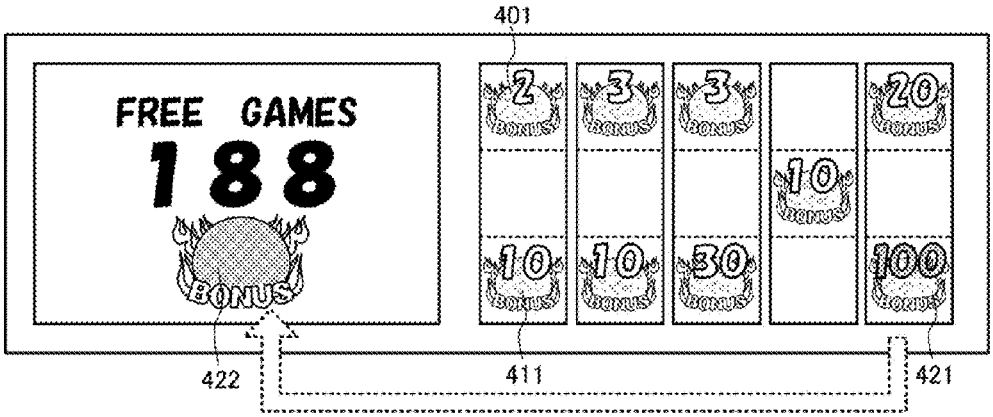

Hereinafter, similar processing is repeated for the remaining BONUS symbols, and when processing of a last BONUS symbol 421 is conducted in the predetermined sequential order, the number of free games is obtained as "188", as shown in FIG. 34C. In accordance with such a series of processing operations, from start to stop of symbol scrolling, a player can visually and intuitively predict the number of second games by the color that is displayed on the symbol or by color arrangement, enabling the player to enhance a sense of expectation or interest more remarkably. For example, in the embodiment, a High value is displayed in a red color, and if a plenty of symbols in the display window 150 are seemingly displayed in a red color, (in particular, right side symbols in the display window 150), a larger value can be expected as the number of free games.

In addition, the player can keep track of the progress of adding processing relevant to the number of free games, and by such an effect, the player can experience a sense of achievement or a sense of failure or the like stepwise. Adding processing is conducted in a predetermined sequential order according to the positions of the BONUS symbols (in the display window 150), or alternatively, the contents of effect change with a predetermined timing of the adding processing, and therefore, diversified variations are imparted to the play of a game, and a sense of reality is imparted to the player.

Again, turning to the number-of-free-games display processing of FIG. 27, the effect control processing portion 312 operatively executed by the main CPU 222 determines the contents of effect such as video image display on the video display unit 110 (step S198), in a case where processing of all of the BONUS symbols completes as a result of determination of whether or not the processing of all of the BONUS symbols displayed in the display window 150 completes in step S197, and conducts effect in accordance with the contents of effect determined in step S198, and then, displays the number of free games that is finally obtained (step S199).

Figure 35A:
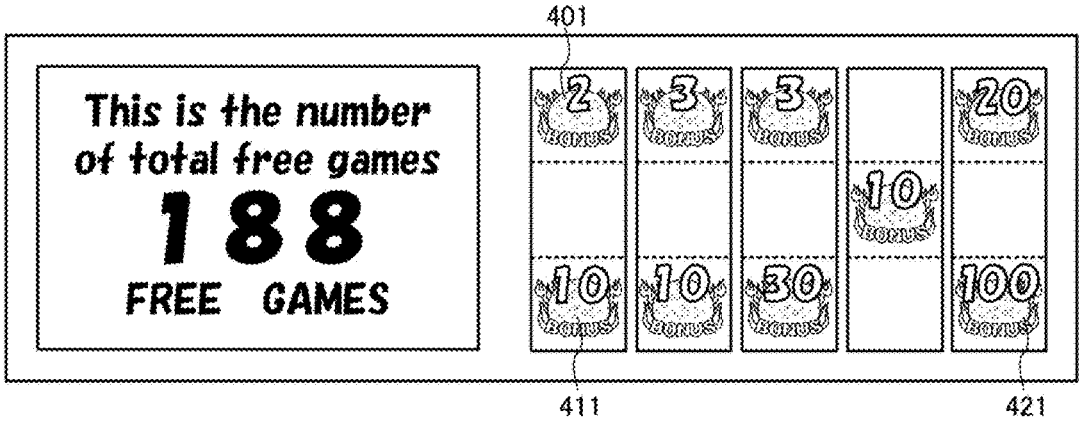
FIGS. 35A and 35B are views showing a pattern of display transition in a video display unit and a display window.

The main CPU 222 notifies to a player that the number-of-free-games display processing completes in accordance with the determined contents of effect. For example, as shown in FIG. 35A, information indicating the fact that a total number of free games is set to "188" is displayed on the video display unit 110. Also, all of the processing operations of the BONUS symbols that are displayed in the display window 150 complete, and thus, the light emission by the backlight device M7 is stopped, and the numeric portions of all of the BONUS symbols are set in a display mode such that these portions cannot be visually recognized or is made inconspicuous. The main CPU 222 displays a final number of free games in step S199, and then, completes the number-of-free-games display processing.

The number-of-free-games display processing can be executed: before the selection screen is displayed after a feature game trigger has been established; and when a free game is selected from that selection screen and then the feature game trigger is established. In the number-of-free-games display processing that is executed after the free game has been selected, the values of the respective BONUS symbols are respectively added to the remaining number of free games, and the added value is displayed on the video display unit 110 as the number of (new) free games together with its related effect.

Figure 35B:
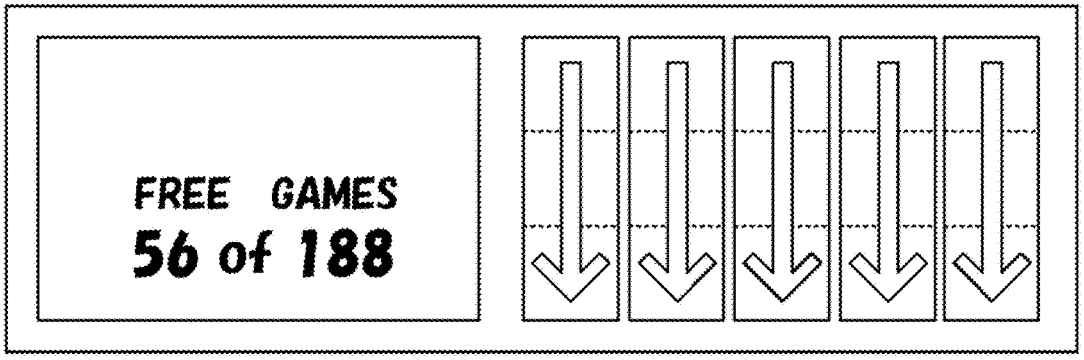

Also, in the free game, as shown in FIG. 35B, the number of free games ("188" in the example of the figure) and the number of games consumed up to now ("56" in the example of the figure) are displayed on the video display unit 110 together with its related effect. Further, at this time, the displayed contents of the video display unit 110 and the contents of effect including output of voice (such as background music BGM), lamp tuning ON, and these effects are changed according to the number of games consumed up to now, the remaining number of games, or the number of free games, whereby the display mode or the like can be controlled. Also, the light emission by the backlight device M7 is controlled according to the number of games consumed up to now, the remaining number of games, or the number of free games, whereby effect can be conducted in such a manner that the colors of the BONUS symbols are changed with a predetermined timing and within a period of time.

The number of games that has been consumed up to now, the remaining number of games, and the number of free games, as mentioned above, can be classified into several levels according to the values, and according to the classified levels, the contents of effect can be switched.

Although in the embodiment, effect relevant to the free game is conducted for the BONUS symbols that are displayed on the video display unit 110 or the display window 150, in addition to this, the data display 174 can be controlled to display a variety of information including effect information. For example, an invoking message or information or the like according to a situation of free game can be displayed.

Modification Example 1

In the embodiment, the light emission by the backlight device M7 is conducted for the first to fifth reels M3*a* to M3*e*; in a case where a value of BONUS symbol is set to a Low value, emission of green light is conducted, and the numeric portion is displayed in a green color, and in a case where the value of the BONUS symbol is set to a High value, emission of red light is conducted, the numeric portion is displayed in a red color, whereas, in addition to the timings mentioned above, a variety of patterns are taken into an account with respect to timings of start and stop of the light emission by the backlight device M7.

Figure 36:
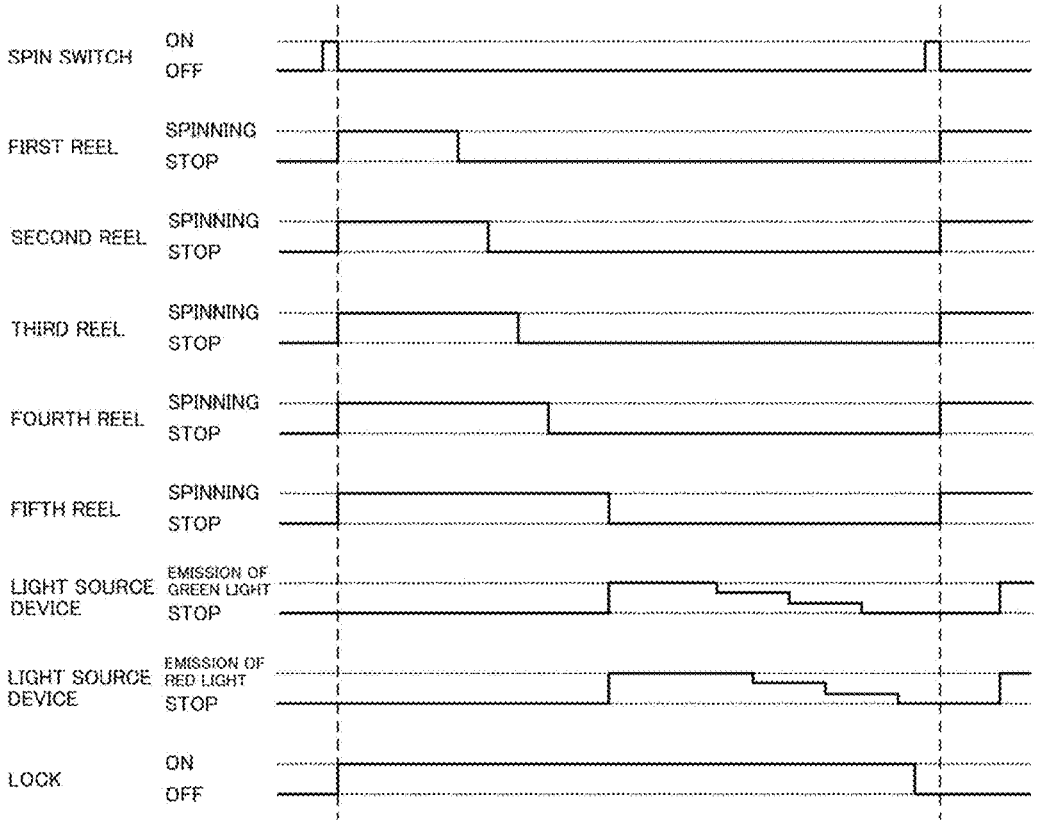
FIG. 36 is a schematic view showing a timing of light emission by a backlight device.

For example, as shown in FIG. 36, while the first to fifth reels M3*a* to M3*e* are spinning, the light emission by the backlight device M7 is stopped, and after spinning of all of the reels (the first to fifth reels M3*a* to M3*e*) has stopped, the light emission by the backlight device M7 can be started. Although in FIG. 36, light emission is started after spinning of all of the reels has stopped, such light emission can be started after elapse of a predetermined period of time after the stoppage. Also, as shown in FIG. 36, in a case where spinning stop timings of the first to fifth reels M3*a* to M3*e* are respectively different, after spinning of the reels has stopped, the light emission by the backlight device M7, corresponding to the stopped reels, can be started individually started.

By such emission by the backlight device M7, a player cannot obtain a hint such as arrangement or intensity of green or red colors in a respective one of the reels, and cannot predict whether or not the number of free games is large or small, etc. However, because of such a situation, the player concentrates on the reel spinning stop timings, etc., whereby the player's sense of expectation or tense atmosphere can be enhanced.

Modification Example 2

Figure 37:
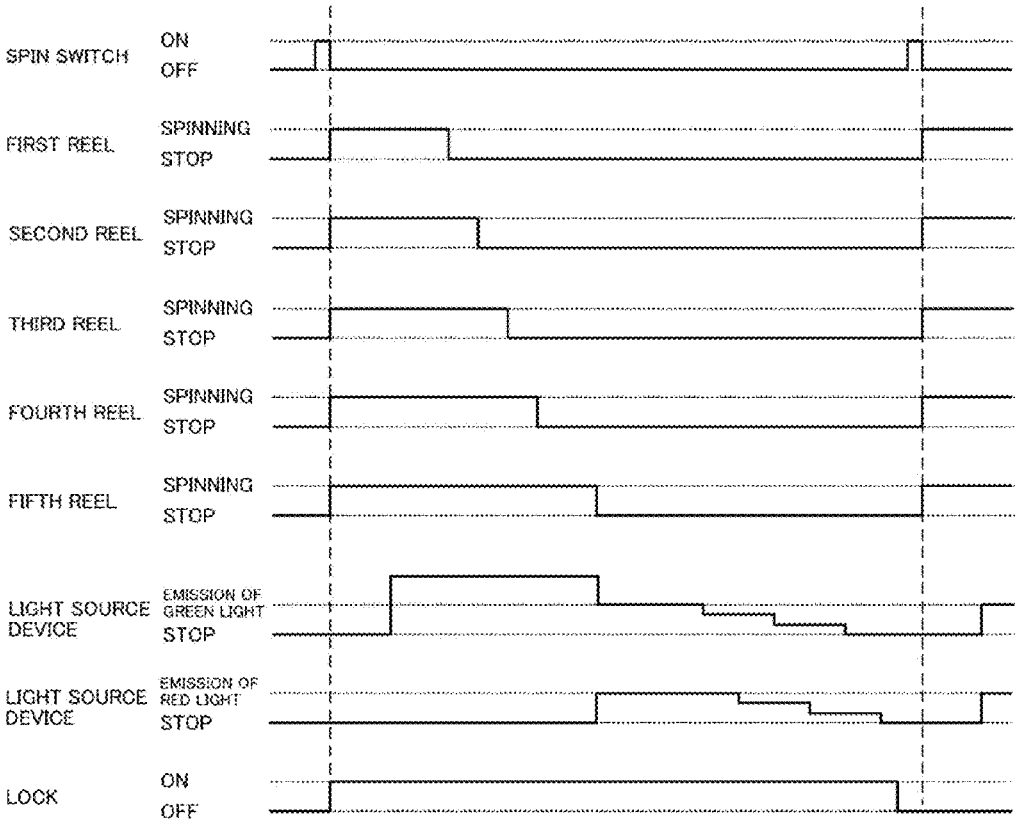
FIG. 37 is a schematic view showing a timing of light emission by a backlight device.

For example, as shown in FIG. 37, when light emission is started while the first to fifth reels M3*a* to M3*e* spin, with respect to all of the BONUS symbols of a respective one of the reels, green light is emitted so as to display Low values regardless of whichever of Low and High values are associated to the BONUS symbols, whereas after spinning of the reels has stopped, with respect to a BONUS symbol of a High value, the backlight device M7 is controlled to switch to emission of red light so as to actually display the High value. In an example of FIG. 37, by symbol lottery processing, six BONUS symbols are determined so as to be displayed in the display window 150, and in a case where values of three of the six BONUS symbols are set to the Low values, and the remaining three are set to the High values, after elapse of a predetermined period of time after the reels have spun, emission of green light is conducted for all of the six BONUS symbols, and with respect to a BONUS symbol of a High value after the reels have spun, the emission mentioned above is switched to emission of red light. Conversely, light emission is first conducted for all of the BONUS symbols, and a BONUS symbol associated with a Low value obtained thereafter can be controlled to emit green light so as to actually display the Low value.

Also, during spinning of the first to fifth reels M3*a* to M3*e*, with respect to all of the BONUS symbols, green light is emitted so as to display Low values, whereas a BONUS symbol associated with a High value after elapse of a predetermined period of time thereafter can be controlled so as to emit red light so as to actually display the High value. Conversely, emission of red light is first conducted for all of the BONUS symbols, a BONUS symbol associated with a Low value thereafter can be controlled to emit green light so as to actually display the Low value.

With the use of such light emission by the backlight device M7, during spinning of the reels, although a player can obtain a hint such as arrangements or intensities of green light and red light in a respective one of the reels during spinning of the reels, this hint is inaccurate information, and thus, the player cannot predict whether or not the number of free games is large or small, etc. However, because of such a situation, the player concentrates his or her consciousness on the reel spinning stop timings, etc., whereby the player's sense of expectation or tense atmosphere can be enhanced.

Figure 38A:
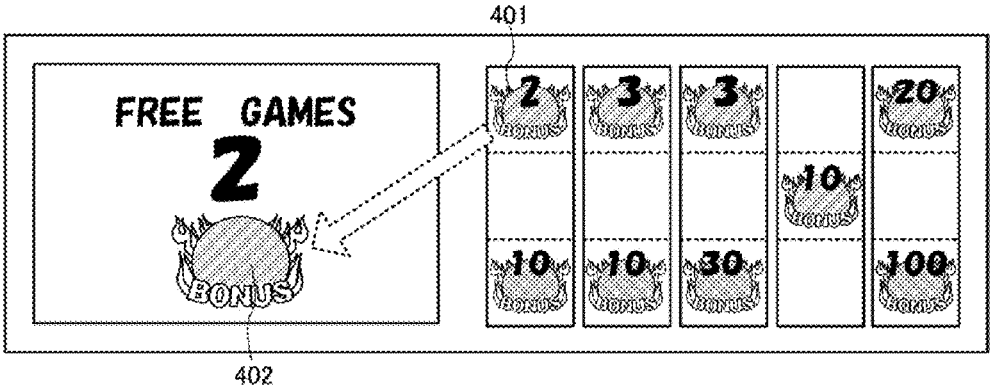
FIGS. 38A and 38B are views showing a display mode in a video display unit and a display window.
Figure 38B:
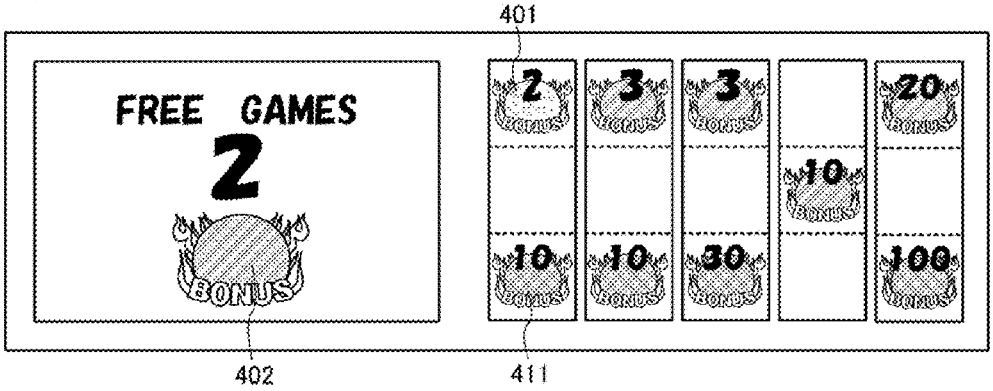

While the embodiment has described a configuration in which numeric portions of BONUS symbols are switched to a green color or a red color with the use of the light emission by the backlight device M7, as shown in FIGS. 38A and 38B, among the BONUS symbols, display of a portion constituting a background of the numeric portion can be controlled to switch to a green color or a red color. FIG. 38A shows a situation in which number-of-free games display processing relevant to the first reel M3*a* is conducted, and the value "2" of a BONUS symbol is displayed on the video display unit 110. FIG. 38B shows a state in which the number-of-free-games display processing relevant to the first reel M3*a* completes, and with respect to a BONUS symbol targeted to be processed (the first reel M3*a*, the symbol on the first line), which is displayed in the display window 150, the light emission by the backlight device M7 is stopped so as to indicate that the processing completes, and a green display portion turns to another color. Although in this example, a display of green and red colors is switched for a portion constituting a background of the numeric portion, the display may be switched at another portion.

In addition, although in the embodiment, in a case where a value of a BONUS symbol is set to a Low value, a green color is associated therewith, and in a case where the value mentioned above is set to a High value, a red color is associated therewith, a variety of combinations of other colors can be employed.

Further, although the embodiment has presumptively described a gaming machine 10 including a reel unit M1 of a mechanical reel system up to now, as described above, the present invention can be carried out by a gaming machine of a video reel system which displays simulative reels or in which the video reel system and a mechanical reel system coexist. In a gaming machine including video reels, scrolling or scrolling stop of the reels is displayed on the video display unit 110 under the control of the main CPU 222. Switching of a display color relevant to a numeric portion of a BONUS symbol in the display window 150 can be achieved by displaying image data on the video display unit 110.

Furthermore, the present invention can be carried out by a gaming machine 10 including relevant top button. In a case where a player presses a stop button relevant to a respective one of the reels (within a predetermined period of time), the gaming machine 10 determines a symbol on a respective one of the reels to be displayed in a stopped state in the display window 150 in consideration of this pressing operation. At this time, by controlling the backlight device M7, of course, at least one of green and red light beams can be emitted during spinning of the reels or after stop of the spinning, and emissions of at least green and red light beams can be started or stopped as well.

(Roulette Game Processing)

Figure 39:
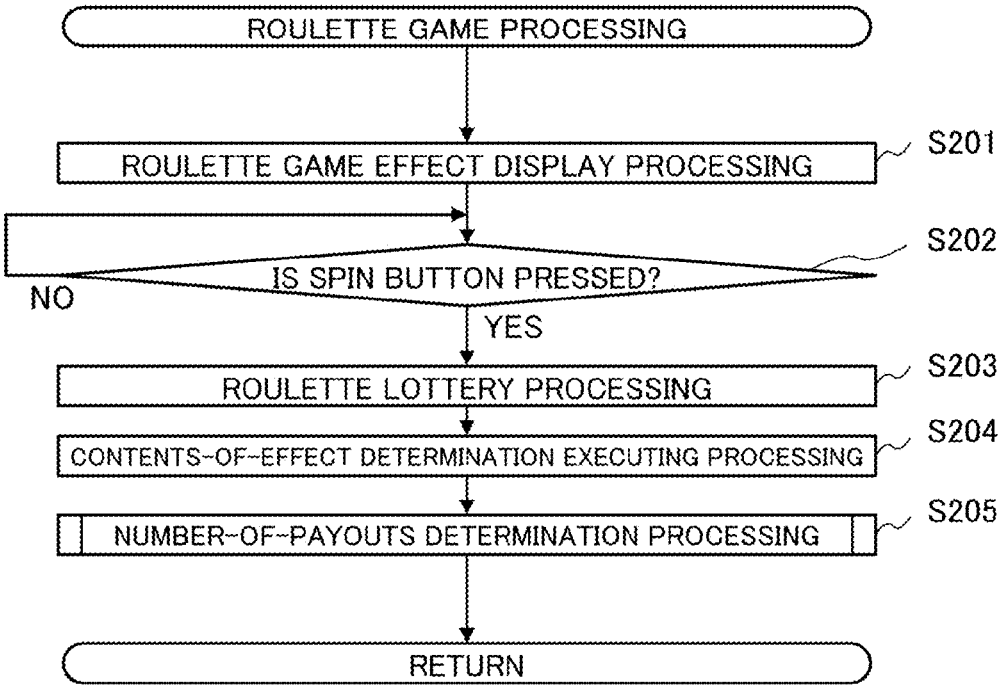
FIG. 39 is a flowchart of roulette game processing in a gaming machine.
Figure 40A:
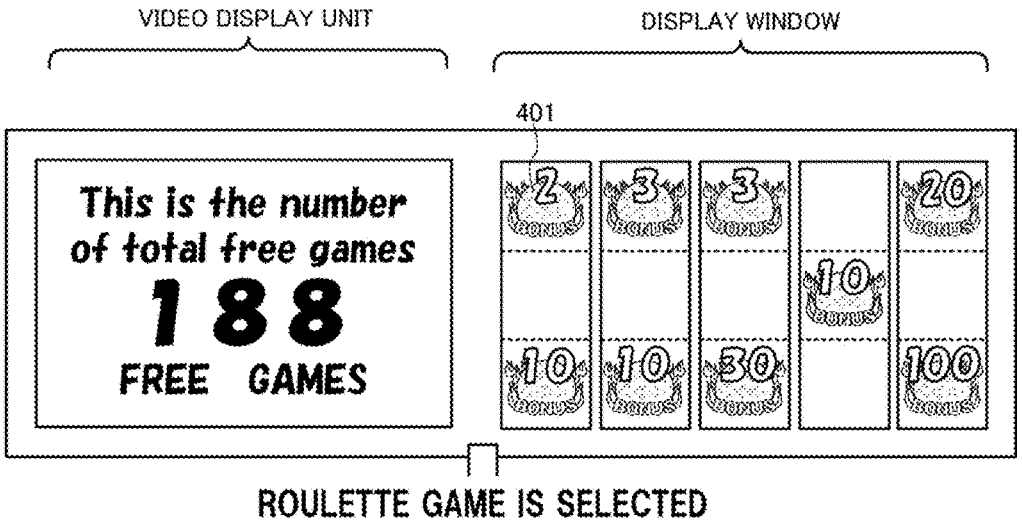
FIGS. 40A, 40B and 40C are views showing a transition of display in a video display unit and a display window 150.
Figure 40B:
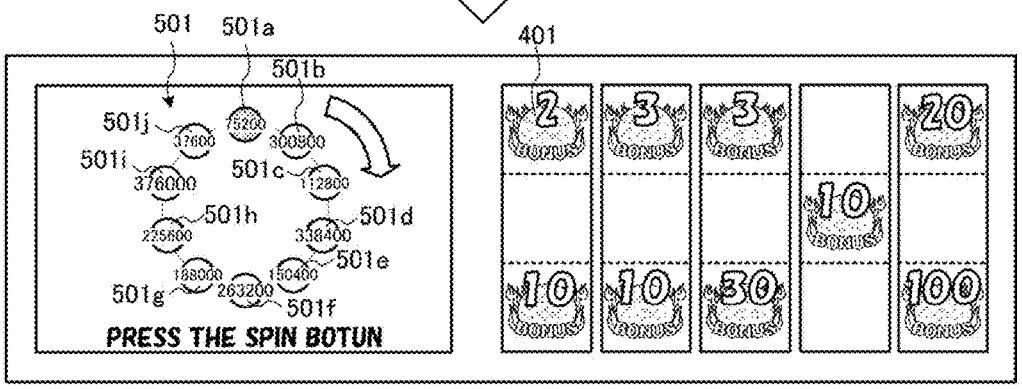
Figure 40C:
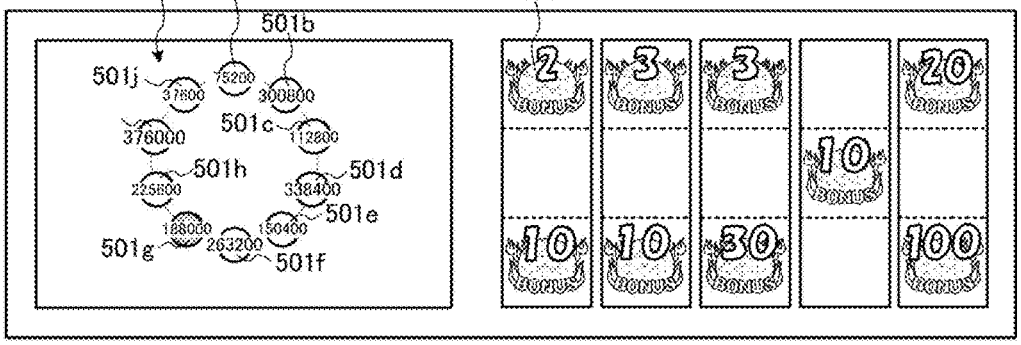

Next, with reference to FIG. 39 to FIG. 41B, roulette game processing will be described. FIG. 39 is a flowchart of the roulette game in the gaming machine 10 according to an embodiment of the present invention, and FIGS. 40A, 40B and 40C are views showing a pattern of display transition in the video display unit 110 and in the display window 150 of the symbol display unit 40. In addition, FIGS. 41A and 41B are views schematically showing an example of a roulette payout table and a formula for obtaining an expectation value of the number of payouts.

The roulette game processing is invoked in a case where a game selected by a player on a selection screen is not a free game in the feature game processing shown in FIG. 26, that is, in a case where it is determined that a roulette game is selected. First, the effect control processing portion 312 operatively executed by the main CPU 222 conducts control in such a manner as to display an effect video image in the video display unit 110 in order to conduct effect according to start of the roulette game (step S201). For example, as shown in FIG. 40A, after a gross total of the number of free games has been displayed by number-of-free game display processing, a selection screen (refer to FIG. 32D is displayed, and when a player selects a roulette game from the selection screen, a roulette board 501 as shown in FIG. 40B is displayed on the video display unit 110. It is to be noted that a state of FIG. 40A corresponds to a state of FIG. 35A.

On the roulette board 501, circular regions (roulette frames 501*a* to 501*j*) are arranged in a circumferential shape, and in a respective one of the display regions, the number of payouts in a case where a winning display region is established is displayed. Ten display regions respectively correspond to ten entries (No. 1 to No. 10) shown in a roulette payout table of FIG. 41A, and the number of payouts displayed in a respective one of the display regions is computed based on payment of a corresponding entry. In the roulette payout table, the payment and winning probability are set for each entry, whereby an expectation value of a payment in roulette is determined Also, the number of payouts in a respective one of the display regions is expressed by Formula 1 below:

$$\text{Number of payouts}(i)=\text{Payment}(i)\times FG\times 20 \quad \text{(Formula 1)}$$

The number of payouts (i) of Formula 1 corresponds to the number of payouts displayed in an i-th display region, and for example, a first display region is a display region 501*a*. A payment (i) corresponds to a payment of the i-th (No.=i) entry in the roulette payout table, and for example, a payment of a first entry is set to 20. Also, an acronym FG denotes the number of free games that is obtained and displayed in the number-of-free games display processing shown in FIG. 27, and in the case of this example, the number of free games is set to 188 (refer to FIG. 40A. Further, numeral "20" in Formula 1 is a bet multiplier, and is the number of bets assigned to one payline, for example. (A 600 bets is possible. It is to be noted that the number of paylines is set to 30 as described above.)

In accordance with computation of Formula 1 above, 20 (payment of the first entry)×188×20=75200 is displayed in the display region 501*a*; 80 (payment of the second entry)×188×20=300800 is displayed in a display region 501*b*, and subsequently, the corresponding numeric values are similarly computed and displayed in display regions leading up to display region 501*j*.

Also, as shown in FIG. 40B, according to the values of the number of payouts shown in the respective display regions, the size of a numeral displaying the number of payouts can be controlled to change. For example, a group in which the number of payouts is small (a payment is set to 10 to 60) is displayed by a small size numeral; a group in which the number of payments is middle (a payment is set to 70 to 90) is displayed by a middle size numeral; and a group in which the number of payouts is large (a payment is set to 100) is displayed by a large size numeral. It is to be noted that a display method of changing a size of a font for display the number of payouts is shown as a mere example. For example, a variety of display methods such as changing a font or a font color for displaying the number of payouts or changing a color of a display region or its peripheral background color are taken into an account. Further, in addition to such a display, a voice (such as background music (BGM)) is output by the speaker 112, whereby the lamp 114 can be lit.

Also, as long as it is evident that the display of a value indicative of the number of payouts is associated with a corresponding display region, the fact may be displayed at any position of the video display unit 110. Further, such a value indicative of the number of payments can be displayed before a spin button adapted to instruct start of the roulette is pressed. In this manner, a player can recognize the number of payouts in advance, enabling the player to feel a sense of expectation and tense atmosphere depending on a result of a roulette lottery.

In addition, although, while a roulette game is played, the displayed contents of the display window 150 are maintained in a state after the number of free games has been computed, as shown in FIG. 40A, a variety of effects can also be conducted in such a manner that emission of the backlight M7 is controlled for the progress or situation of the roulette game to change a color of a BONUS symbol or the like.

Next, it is determined whether or not the spin button is pressed in a state in which the display of FIG. 40B is made (step S202). This determination is repeated until the spin button has been pressed, and the display of FIG. 40B is maintained. When it is determined that the spin button is pressed, roulette lottery pressing is conducted (step S203). First, the random number generating processing portion 302 operatively executed by the main CPU 222 extracts random number values for determination of roulette, and the symbol determination processing portion 304 operatively executed by the main CPU 222 determines whichever a winning display region may be, from among ten display regions arranged on the roulette board that is displayed in the video display unit 110, by referring to the roulette payout table shown in FIG. 41A.

In the roulette payout table shown in FIG. 41A, weights are associated with entries of No. 1 to No. 10 respectively corresponding to the display regions (501*a* to 501*j*), and winning probabilities of the respective display regions are set. For example, a winning probability of the display region assigned with No.=1 is set to 25/165, and a winning probability of a display region assigned with No.=2 is set to 5/165. Although, in the roulette payout table shown in FIG. 41A, a field representing a total of weights is provided, this field is merely shown for the sake of convenience.

Next, the effect control processing portion 312 operatively executed by the main CPU 222 conducts contents-of-effect determination executing processing (step S204). The main CPU 222 determines the contents of effect according to a result or the like of roulette lottery processing, and executes effect depending on the determined contents of effect. For example, the main CPU 222 conducts control in such a manner that a video image for effect is displayed on the video display unit 110, a voice is output by the speaker 112, the lamp 114 is lit, and effect processing is applied to these contents, etc. It is to be noted that a part of the effect processing in the step 204 can be conducted before or in parallel to the roulette lottery processing of the step S203.

The effect executed in step S204 finally displays a result of the roulette lottery processing. For example, when the spin button is pressed in the state shown in FIG. 40B, the display regions are sequentially lit along the direction indicated by the arrow, and a state in which lottery processing is conducted is expressed (although internal lottery processing completes in the embodiment), and subsequently (for example, after elapse of a predetermined period of time, or alternatively, after turning ON of the display regions has been shifted a predetermined number of times), as shown in FIG. 40C, the shifting to turning ON of the display regions stops and blinks, and a state in which an effect is continued for one display region (501*g* in the embodiment) is established. In this manner, as a result of the roulette lottery processing, the fact that the winning display region 501*g* is established is notified.

Next, the main CPU 222 conducts the number-of-payouts determination processing mentioned above (step S205). The number of payouts at this time is obtained by Formula 1 above, and is set to "188000" whose number is the same as that displayed in the display region 501*g*. Afterwards, the roulette game processing is completed.

As has been described hereinabove, the roulette game mentioned above is a roulette game that can merely be played by making a roulette lottery processing operation once. Such a roulette game is provided, whereby a player can play a roulette game that completes for a short period of time and a plurality of unit games (an allowable number of free games), and can select a free game that can be enjoyed over a longer period of time than the roulette game by the player's own will. Also, the roulette game can be played by a plurality of roulette lottery processing operations, for example, by two or more lottery processing operations. In addition, the player can specify or select the number of roulette lottery processing operations. However, in such a case as well, it is preferable that the number of roulette lottery processing operations be set to be smaller than the number of free games.

As described above, in the gaming machine, a player can select whether or not to play a free game or to play a roulette game after keeping track of the number of free games. Also, at this time, the number of unit games in the free game (the number of free games) is set to 8 to 420 (refer to FIG. 29), and the number of roulette games is basically set to 1. Therefore, as the number of free games increases more significantly, a difference in time intervals between the free game and the roulette game becomes more remarkable. Hence, the player can determine which game to select in consideration of the player's preference of game or time to spare or the like.

However, with respect to these two games, in a case where the expectation values of the number of payouts are greatly different from each other, a sense of unfairness can occur, and a player is forced to select a game in consideration of the expectation values of the number of payouts as well. Therefore, in the gaming machine according to the present invention, with respect to the free game and the roulette game, the expectation values of the number of payouts are made equal to each other (or are made substantially equal to each other), whereby the player can select a game according to the player's preference or time to spare or the like without worrying about any advantage or disadvantage which may occur on a game by game basis.

Now, the expectation values of the number of payouts in the free game and the roulette game will be described. As shown in FIG. 41B, the expectation value of the number of payouts in the free game is obtained by expectation value of payment×number of free games (FG) in a unit game. The expectation value of payment in the unit game can be obtained by summing a product between a payment relative to a combination of symbols as shown in the payout table of FIG. 19 and a probability that the combination is established, with respect to all of the symbol combinations. This is an expectation value of a payment in one unit game, and thus, this expectation values and the number of free games (FG) are multiplied each other, whereby the expectation value of the number of payouts in the entire free games can be obtained. A probability that a symbol combination is established is a value that is obtained by dividing a weight relevant to establishment of that combination based on a total weight, and this value can be obtained from the payout table of FIG. 19, the payline definition table of FIG. 17, and the symbol determination table of FIG. 18.

It is to be noted that the symbol combinations include all of the combinations whose payments exist, and combinations including a (ANY) symbol or a "WILD" symbol permitting an arbitrary symbol or the like are taken into an account. Also, in FIG. 41B, the expectation value of the number of payouts in the free game is conceptually expressed by a simple formula, whereas the number of free games to be added (retriggered) in a case where a feature game trigger is established in the free game is also taken into an account.

On the other hand, the expectation value of the number of payouts in the roulette game is obtained by the expectation value in the formula of roulette game×the number of free games (FG)×20 (the bet multiplier). The expectation value of the payment in the roulette game can be obtained by summing a product between a payment relative to a respective one of the display regions as shown in the roulette payout table of FIG. 41A and the winning probability of that display region with respect to all of the display regions. A winning probability of a display region is a value that is obtained by dividing a weight relevant to that display region by a total weight, and can be obtained from the roulette payout table of FIG. 41A.

The gaming machine of the present invention is configured to have a relationship that the expectation value of the number of payouts in the free game and the expectation value of the number of payouts in the roulette game are equal to or substantially equal to each other. In a case where there exists a difference between these expectation values, it is desirable that a slight difference be set to an extent such that a player does not feel a sense of unfairness at the time of game selection.

The number of payouts in the roulette game is computed in consideration of the number of free games (FG) so that its related expectation value changes in association with the expectation value of the number of payouts in the free game. Also, when the number of payouts in the roulette game is obtained, a computational formula can be set so that the expectation value of the number of payouts in the free game and the expectation value of the number of payouts in the roulette game are equal to or substantially equal to each other.

Further, at least one of: computational formulas for computing the expectation value of the payment of the unit game in the free game and the number of payouts in the free game; and computational formulas for computing the expectation value of the payment in the roulette game and the number of payouts in the roulette game, can be adjusted in order to establish the relationship to an extent such that the expectation value of the number of payouts in the free game and the expectation value of the number of payouts in the roulette game are equal to or substantially equal to each other. Furthermore, the expectation value of the payment of the unit game in the free game can be adjusted by changing the payment or the establishment probability relevant to a respective one of the symbol combinations, and the expectation value of the payment in the roulette game can be adjusted by changing the number of display regions or the winning probability.

Although in the present embodiment, the configuration was employed so that in a case where the feature game trigger is established, either the free game or the roulette game is selected from the selection screen, a configuration can also be employed so as to make the selection from among three or more game options.

Modification Example 4

Figure 24:
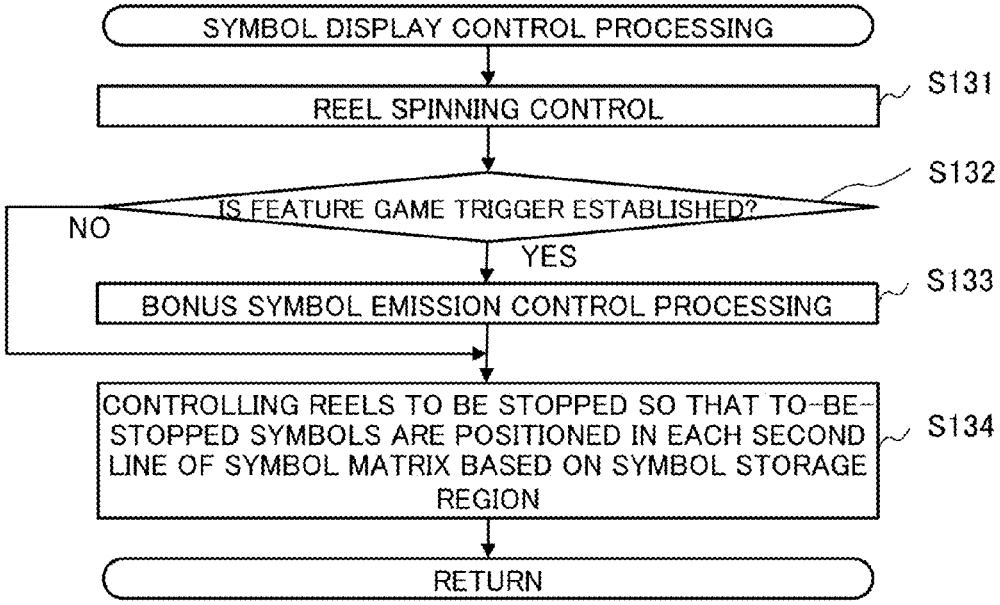
FIG. 24 is a flowchart of symbol display control processing in a gaming machine.

In the embodiments described above, it is determined whether or not a combination of symbols store in a symbol storage region coincides with a feature game trigger (step S115 of FIG. 23); in a case where it is affirmatively determined, a lottery is conducted by referring to the BONUS symbol value determination table shown in FIG. 29; the values of the respective symbols are determined (step S116 to step S118 of FIG. 23); and then, the respective BONUS symbols are controlled to be emitted by the backlight device M7, based on information for identifying whether the values of the BONUS symbols are Low or High (step S133 of FIG. 24). As a result, in a case where a value of a BONUS symbol is set to a Low value (for example, "2"), green light is emitted by the backlight device M7 and the BONUS symbol whose numeric portion "2" is colored in a green color is displayed, and in a case where a value of a BONUS symbol is set to a High value (for example, "10"), red light is emitted by the backlight device M7, and the BONUS symbol whose numeric portion "10" is represented in a red color is displayed.

In contract to the configuration of the embodiments as described above, in Modification Example 4, a construction is employed in such a manner that, even if a case where it is determined that a combination of the symbols stored in the symbol storage region coincides with a feature game trigger, for example, in a case where a specific condition is met in such a manner that all of ten BONUS symbols are displayed in the display window 150 (a Kind number=10), and with respect to all of the BONUS symbols, light emission of a predetermined color such as a red color, for example, is conducted by the backlight device M7 without conducting no lottery for determining a value of a BONUS symbol.

Figure 42:
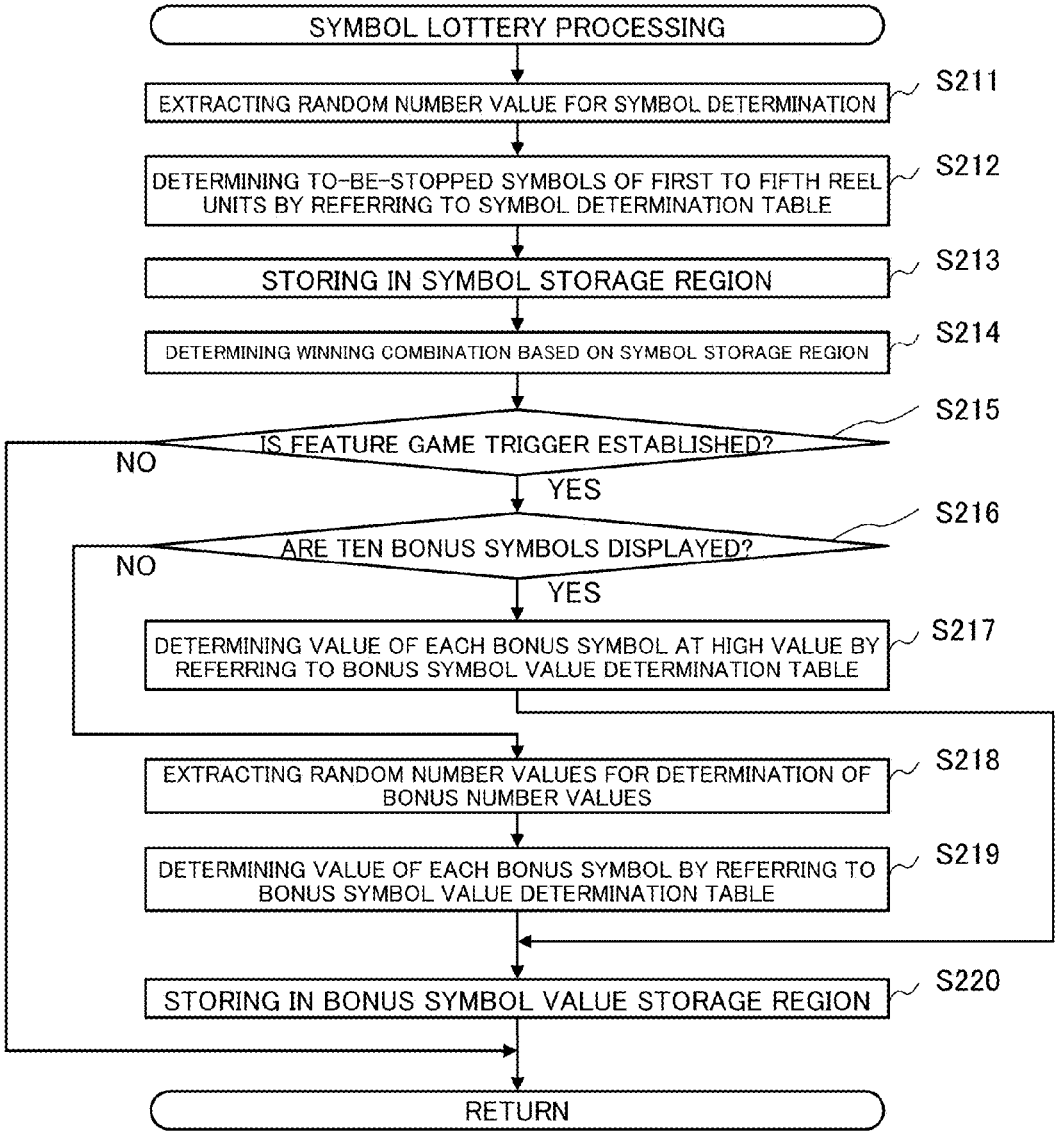
FIG. 42 is a view of a flowchart of number-of-free-games display processing in an modification example.

Now, with reference to FIG. 42, symbol lottery processing of Modification Example 4 of the present invention will be described in more detail. As described above, in Modification Example 4, symbol lottery processing which is partially different from the symbol lottery processing shown in FIG. 23 is conducted. Step S211 to step S215 are basically processing operations that are basically the same as those of step S111 to S115 of FIG. 23, and thus, a description will be given with respect to the processing operations of step S216 and subsequent. In step S215, when the prize determination processing portion 310 operatively executed by the main CPU 222 determines that a feature game trigger is established, it is further determined whether or not ten BONUS symbols are displayed in the display window 150 (step S216).

As is evident from the symbol determination table in FIG. 18, two BONUS symbols are respectively arranged on each reel with one symbol being placed therebetween. A case in which ten BONUS symbols are displayed denotes a case in which all of BONUS symbols set are displayed in the display window 150, and at this time, BONUS symbols are arranged on the first line and the third line of all the reels (the first to fifth reels M3*a* to M3*e*).

When it is determined that ten BONUS symbols are displayed, the symbol determination processing portion 304 operatively executed by the main CPU 222 determines the values of the respective BONUS symbols at High values, based on the BONUS symbol value determination table shown in FIG. 29 (step S217). At this time, a lottery according to the respective BONUS symbols is not conducted.

On the other hand, when it is determined that ten BONUS symbols are not displayed, the symbol determination processing portion 304 operatively executed by the main CPU 222 determines a value of a BONUS symbol by a lottery (step S218 and step S219). This processing is the same as those of step S116 and step S117 of FIG. 23.

Lastly, the main CPU 222 stores the values of the respective BONUS symbols determined and information for identifying whether the values are Low or High, in the BONUS symbol value storage region (step S220). In a case where it is determined that ten BONUS symbols are displayed, with respect to all of the ten BONUS symbols, a High value that corresponds to a respective one of the symbols and information indicating that the value is High is stored. Alternatively, it is determined that the ten BONUS are not displayed, the values of the respective BONUS symbols determined and information for identifying whether the values are Low or High is stored. After the processing of step S220, the symbol lottery processing is completed.

Figure 43:
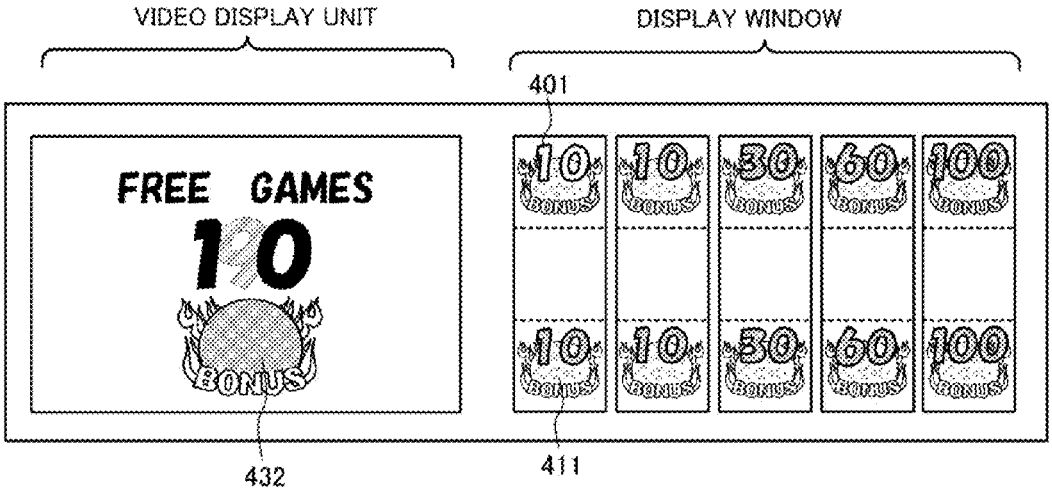
FIG. 43 is a view showing a transition of display in a video display unit and a display window in a modification example.

Next, with reference to FIG. 43, a description will be given with respect to a pattern of display transition at the time of free game display processing in the video display unit 110 in Modification Example 4 and the display window 150 of the symbol display unit 40. FIG. 43 shows a state in which symbols are displayed to be stopped in the display window 150 by reel spinning control, and as a result, a condition for feature game trigger is met, and BONUS symbols whose Kind number=10 are arranged. Two BONUS symbols are displayed on each reel, and at a numeric portion, a High value that corresponds to a respective symbol ID is displayed (refer to the BONUS symbol value determination table of FIG. 29). Further, the values of all the BONUS symbols are determined at High values, and thus, according to this determination, the emission of red light is conducted by the backlight device M7, and as a result, the numeric portion is displayed in a red color.

Although in the video display unit 110, the number of free games are displayed as "0" in an initial state of display of the number of free games, a value "10" relevant to processing of the first BONUS symbol 401, that is, the value "10" of the BONUS symbol displayed on the first line of the first reel M3*a* in the display window 150 is acquired, and a cumulative value "10" is displayed as the number of free games. When the processing of the BONUS symbol 401 completes, the light emission by the backlight device M7 to this symbol is stopped, blinking of red color for the numeric portion "10" of the BONUS symbol 401 is completed (turned OFF), and the numeric portion "10" is controlled so that it cannot be visually recognized or is made inconspicuous. Further, on the video display unit 110, a pattern 432 corresponding to this BONUS symbol is displayed. In this example, a part of the pattern 43 is displayed in a red color which is the same as that specified in accordance with emission control of the BONUS symbol 401. Subsequently, the progress of adding of the number of free games is shown in the same manner as that of display transition shown in FIG. 33A to FIG. 35B.

With the configuration of Modification Example 4, in a case where all of the BONUS symbols are displayed, the values for all of the BONUS symbols are determined at High values, and the number of free games is always 320 that is a maximum value (in the case of the BONUS symbol value determination table of FIG. 29). A probability that all of the BONUS symbols are displayed is extremely low, and moreover, symbols are arranged in such a manner that the maximum value can be expected, and in such a case, a construction is employed in such a manner that the maximum value is always assigned, whereby a player's sense of expectation or interest can be enhanced more remarkably.

Although in Modification Example 4, control that is different from usual is conducted in a case where a specific condition is met in such a manner that all of the ten BONUS symbols are displayed in the display window 150, this specific condition can be variously set. For example, a condition can be set to an extent such that a condition for feature trigger is met and a predetermined number or more of, namely seven to nine BONUS symbols, are displayed; or alternatively, a condition can be set to an extent such that a manner that the condition for feature trigger is met and the BONUS symbols on a respective one of the reels are displayed in a specific arrangement (such that all the BONUS symbols are displayed on the second line or are not displayed on a line the same as that of an adjacent reel, etc.).

Also, although in Modification Example 4, a color of a numeric portion of a BONUS symbol is controlled to be displayed in a red color based on identification of High that is fixedly determined, the color can be controlled to be displayed in a green color or another color. In addition, the value of the BONUS symbol can be determined by employing a table other than the BONUS symbol value determination table or a fixed value or the like.

Further, in a case where such a specific condition is met, the display mode or the like can be controlled by setting the displayed contents for the video display unit 110 and the contents of effects for the specific condition including output of voice (such as background music (BGM)), lamp turning ON, and these effects or the like. Also, in this case, the effects relevant to the number-of-free-games display processing can be controlled so as to be an effect which is different from that at the time of the play of a normal game.

What is claimed is:

1. A gaming machine in which a payment is determined based on rearranged symbols, the gaming machine comprising:

a reel assembly including a plurality of reels in which a plurality of symbols are assigned on outer surfaces and a backlight illuminating a respective one of the reels from inside;

predetermined symbols included in the plurality of symbols, each of the predetermined symbols being capable of displaying a symbol varied according to a light emitting color of the backlight;

a controller for controlling a first game to rearrange the plurality of symbols in a display region on a first display, the controller being programmed to execute processing operations of (1-1) to (1-5) below:

(1-1) determining symbols to be rearranged, by a first lottery;

(1-2) determining values that respectively correspond to the predetermined symbols meeting a second condition by a second lottery, in a case where the rearranged symbols meet a first condition;

(1-3) switching a light emitting color of the backlight so that each of the predetermined symbols meeting the second condition displays a symbol determined according to a corresponding value among the values;

(1-4) obtaining a number of second games based on a sum of the values; and (1-5) displaying the number of second games on a second display.

2. The gaming machine according to claim 1, wherein the processing operation of (1-3) switching the light emitting color is executed after the predetermined symbols meeting the second condition have been rearranged.

3. The gaming machine according to claim 2, wherein the processing operation of (1-3) switches the light emitting color of the backlight so as to display a symbol different from the symbol to be displayed after the predetermined symbols have been rearranged, before the predetermined symbols meeting the second condition are rearranged and during spinning of the reels.

4. The gaming machine according to claim 1, wherein the processing operation of (1-3) switches the light emitting color of the backlight so that each of the predetermined symbols meeting the second condition displays a numeric shape representing the corresponding value.

5. The gaming machine according to claim 1, wherein the processing operation of (1-4) includes a processing operation of (1-4-1), sequentially adding respectively the values thereto in order to obtain the number of second games, and the processing operation of (1-5) includes a processing operation of (1-5-1) displaying display information including the number of second games obtained by the adding processing.

6. The gaming machine according to claim 5, wherein in the adding processing, the values are added in a predetermined sequential order according to rearranged positions in the display region of the predetermined symbols meeting the second condition.

7. The gaming machine according to claim 5, wherein the processing operation of (1-5-1) includes a processing operation of (1-5-1-2) changing a display mode or a voice of the display information relative to the second display, based on at least any one of rearranged positions in the display regions of the predetermined symbols targeted to be added, values that correspond to the predetermined symbols targeted to be added, and the number of second games before added or after added.

8. The gaming machine according to claim 5, wherein the processing operation of (1-3) switches the light emitting color of the backlight so that the predetermined symbols targeted to be added change displays of the symbols in an exact timing with partway or completion of the adding processing.

9. A gaming machine in which a payment is determined based on rearranged symbols, the gaming machine comprising:

a value-input mechanism by which a credit to be bet can be added to the gaming machine;

a validator;

an award payout mechanism that pays out a gaming medium;

a first display having a display region in which symbols associated with a respective one of a plurality of scroll lines are to be displayed;

a controller, which controls a first game in which the symbols associated with the scroll lines are moved and displayed in the display region; which, via the validator, identifies a physical gaming medium that has been added to the gaming machine; which establishes a credit balance for a player based at least in part on the gaming medium that has been added to the gaming machine; and which, as a result of the player having bet a credit, executes processing operations of (2-1) to (2-5) below:

(2-1) determining symbols to be rearranged, by a first lottery;

(2-2) determining values that respectively correspond to predetermined symbols meeting a second condition by a second lottery, in a case where the rearranged symbols meet a first condition, said predetermined symbols capable of displaying a symbol varied according to a light emitting color of a backlight;

(2-3) changing a display or color of at least part of each of the predetermined symbols meeting the second condition in accordance with a corresponding value among the values;

(2-4) obtaining a number of second games based on a sum of the values; and (2-5) displaying the number of second games on a second display.

10. The gaming machine according to claim 9, wherein the display or color is changed after the predetermined symbols meeting the second condition have been rearranged.

11. The gaming machine according to claim 10, wherein the processing operation of (2-3) controls the predetermined symbols to be changed to a display mode different from a display mode to displayed after the predetermined symbols have been rearranged, before the predetermined symbols meeting the second condition are rearranged.

12. The gaming machine according to claim 9, wherein the processing operation of (2-3) includes a processing operation of (2-3-2) controlling each of the predetermined symbols meeting the second condition to display a numeric shape representing the corresponding value.

13. The gaming machine according to claim 9, wherein the processing operation of (2-4) includes a processing operation of (2-4-1) sequentially adding respectively the values thereto in order to obtain the number of second games, and the processing operation of (2-5) includes a processing operation of (2-5-1) includes displaying the number of second games obtained by the adding processing on the second display with the progress of the adding processing.

14. A gaming machine in which a payment is determined based on rearranged symbols, the gaming machine comprising:

a value-input mechanism by which a credit to be bet can be added to the gaming machine;

a validator;

an award payout mechanism that pays out a gaming medium;

a first display having a display region in which symbols associated with a respective one of a plurality of scroll lines are to be displayed;

a controller for controlling a first game in which the symbols associated with the scroll lines are moved and displayed in the display region; which via the validator, identifies a physical gaming medium that has been added to the gaming machine; which establishes a credit balance for a player based at least in part on the gaming medium that has been added to the gaming machine; and which as a result of the player having a bet credit the controller being programmed to execute processing operations of (3-1) to (3-5) below:

(3-1) determining symbols to be rearranged, by a first lottery;

(3-2) determining values that respectively correspond to predetermined symbols meeting a second condition by a second lottery, in a case where the rearranged symbols meet a first condition, said predetermined symbols capable of displaying a symbol varied according to a light emitting color of a backlight;

(3-3) changing a display or color of at least part of each of the predetermined symbols meeting the second condition in accordance with a corresponding value among the values;

(3-4) obtaining a number of second games based on a sum of the values; and (3-5) displaying the number of second games on a second display, wherein the processing operation of (3-4) includes a processing operation of (3-4-1) sequentially adding respectively the values thereto in order to obtain the number of second games, the processing operation of (3-5) includes a processing operation of (3-5-1) includes displaying the number of second games obtained by the adding processing on the second display with the progress of the adding processing, and in the adding processing, the values are added in a predetermined sequential order according to rearranged positions in the display regions of the predetermined symbols meeting the second condition.

15. A gaming machine in which a payment is determined based on rearranged symbols, the gaming machine comprising:

a value-input mechanism by which a credit to be bet can be added to the gaming machine;

a validator;

an award payout mechanism that pays out a gaming medium;

a first display having a display region in which symbols associated with a respective one of a plurality of scroll lines are to be displayed;

a controller for controlling a first game in which the symbols associated with the scroll lines are moved and displayed in the display region; which via the validator, identifies a physical gaming medium that has been added to the gaming machine; which establishes a credit balance for a player based at least in part on the gaming medium that has been added to the gaming machine; and which as a result of the player having a bet credit the controller being programmed to execute processing operations of (4-1) to (4-5) below:

(4-1) determining symbols to be rearranged, by a first lottery;

(4-2) determining values that respectively correspond to predetermined symbols meeting a second condition by a second lottery, in a case where the rearranged symbols meet a first condition, said predetermined symbols capable of displaying a symbol varied according to a light emitting color of a backlight;

(4-3) changing a display or color of at least part of each of the predetermined symbols meeting the second condition in accordance with a corresponding value among the values;

(4-4) obtaining a number of second games based on a sum of the values; and (4-5) displaying the number of second games on a second display, wherein the processing operation of (4-4) includes a processing operation of (4-4-1) sequentially adding respectively the values thereto in order to obtain the number of second games, the processing operation of (4-5) includes a processing operation of (4-5-1) includes displaying the number of second games obtained by the adding processing on the second display with the progress of the adding processing, and the processing operation of (4-5-1) includes a processing operation of (4-5-1-2) changing a display mode or a voice of the display information relative to the second display, based on at least either of rearranged positions in the display regions of the predetermined symbols targeted to be added, values that correspond to the predetermined symbols targeted to be added, and the number of second games before added or after added.

16. A gaming machine in which a payment is determined based on rearranged symbols, the gaming machine comprising:

a value-input mechanism by which a credit to be bet can be added to the gaming machine;

a validator;

an award payout mechanism that pays out a gaming medium;

a first display having a display region in which symbols associated with a respective one of a plurality of scroll lines are to be displayed;

a controller for controlling a first game in which the symbols associated with the scroll lines are moved and displayed in the display region; which via the validator, identifies a physical gaming medium that has been added to the gaming machine; which establishes a credit balance for a player based at least in part on the gaming medium that has been added to the gaming machine; and which as a result of the player having a bet credit the controller being programmed to execute processing operations of (5-1) to (5-5) below:

(5-1) determining symbols to be rearranged, by a first lottery;

(5-2) determining values that respectively correspond to predetermined symbols meeting a second condition by a second lottery, in a case where the rearranged symbols meet a first condition, said predetermined symbols capable of displaying a symbol varied according to a light emitting color of a backlight;

(5-3) changing a display or color of at least part of each of the predetermined symbols meeting the second condition in accordance with a corresponding value among the values;

(5-4) obtaining a number of second games based on a sum of the values; and (5-5) displaying the number of second games on a second display, wherein the processing operation of (5-4) includes a processing operation of (5-4-1) sequentially adding respectively the values thereto in order to obtain the number of second games, the processing operation of (5-5) includes a processing operation of (5-5-1) includes displaying the number of second games obtained by the adding processing on the second display with the progress of the adding processing, and the processing operation of (5-3) includes a processing operation of (5-3-3) controlling the predetermined symbols targeted to be added, to change displays of the symbols in an exact timing with partway or completion of the adding processing.

17. A gaming machine in which a payment is determined based on rearranged symbols, the gaming machine comprising:

a reel assembly including a plurality of reels in which a plurality of symbols are assigned on outer surfaces and a backlight illuminating a respective one of the reels from inside;

predetermined symbol included in the plurality of symbols, each of the predetermined symbols being capable of displaying a symbol varied according to a light emitting color of the backlight; and a controller for controlling a first game in which the plurality of symbols are rearranged in a display region, the controller being programmed to execute processing operations (6-1) to (6-6) below:

(6-1) determining symbols to be rearranged, by a first lottery;

(6-2) determining first values that respectively correspond to the predetermined symbols meeting a second condition either without conducting a lottery, in a case where the rearranged symbols meet a first condition;

(6-3) determining second values that respectively correspond to the predetermined symbols meeting a fourth condition by a second lottery, in a case where the rearranged symbols meet a third condition;

(6-4) switching a light emitting color of the backlight so that each of the predetermined symbols meeting the second condition or the fourth condition displays a symbol determined in accordance with a corresponding value among the first and second values;

(6-5) obtaining a number of second games based on a sum of the first and second values; and (6-6) displaying the number of second games on a second display.

18. A gaming machine in which a payment is determined based on rearranged symbols, the gaming machine comprising:

a value-input mechanism by which a credit to be bet can be added to the gaming machine;

a validator;

an award payout mechanism that pays out a gaming medium;

a first display having a display region in which a symbol associated with a respective one of a plurality of scroll lines is displayed;

a controller , which controls a first game in which the symbols associated with the scroll lines are moved and rearranged in the display region; which, via the validator, identifies a physical gaming medium that has been added to the gaming machine; which establishes a credit balance for a player based at least in part on a gaming medium that has been added to the gaming machine; and which, as a result of the player having bet a credit, executes processing operations of (7-1) to (7-6) below:

(7-1) determining symbols to be arranged, by a first lottery;

(7-2) determining first values that respectively correspond to predetermined symbols meeting a second condition without conducting a lottery, in a case where the rearranged symbols meet a first condition, said predetermined symbols capable of displaying a symbol varied according to a light emitting color of a backlight;

(7-3) determining second values that respectively correspond to the predetermined symbols meeting a fourth condition by a second lottery, in a case where the rearrange symbols meet a third condition;

(7-4) changing a display or color of at least part of each of the predetermined symbols meeting the second condition or the fourth condition in accordance with a corresponding value among the first and second values;

(7-5) obtaining a number of second games based on a sum of the first and second values; and (7-6) displaying the number of second games on a second display.

* * * * *